US011415338B2

(12) United States Patent
Chakir et al.

(10) Patent No.: US 11,415,338 B2
(45) Date of Patent: Aug. 16, 2022

(54) HEAT EXCHANGER ASSEMBLY

(71) Applicant: OVH, Roubaix (FR)

(72) Inventors: Anas Chakir, Halluin (FR); Hadrien Bauduin, Villeneuve d'Ascq (FR); Ali Chehade, Templeuve (FR); Henryk Klaba, Roubaix (FR)

(73) Assignee: OVH, Roubaix (FR)

( * ) Notice: Subject to any disclaimer, the term of this patent is extended or adjusted under 35 U.S.C. 154(b) by 4 days.

(21) Appl. No.: 16/989,317

(22) Filed: Aug. 10, 2020

(65) Prior Publication Data

US 2021/0063049 A1 Mar. 4, 2021

(30) Foreign Application Priority Data

Aug. 30, 2019 (EP) ..... 19315106

(51) Int. Cl.
*F24F 13/24* (2006.01)
*F24F 13/02* (2006.01)
(Continued)

(52) U.S. Cl.
CPC ..... *F24F 13/24* (2013.01); *F24F 13/0263* (2013.01); *F28F 3/06* (2013.01);
(Continued)

(58) Field of Classification Search
CPC .. F24F 13/24; F24F 13/0263; F24F 2013/242; F28F 3/06; F28F 9/0075; F28F 2013/242; F28F 2265/28
See application file for complete search history.

(56) References Cited

U.S. PATENT DOCUMENTS 3,384,165 A * 5/1968 Mathews ..... F28F 9/0136 165/122
4,149,588 A * 4/1979 Waters ..... F28D 15/0275 165/11.1
(Continued)

FOREIGN PATENT DOCUMENTS

CN 1782601 A 6/2006
CN 104654825 A 5/2015
(Continued)

OTHER PUBLICATIONS

European Search Report with regard to the counterpart European Patent Application No. EP 19315106.5 completed Feb. 7, 2020.
(Continued)

*Primary Examiner* — Devon Russell
(74) *Attorney, Agent, or Firm* — BCF LLP

(57) ABSTRACT

A heat exchanger assembly includes: a frame; a heat exchanger panel mounted to the frame and configured to exchange heat with air flowing therethrough, the heat exchanger panel being disposed at an inclined orientation; a fan assembly disposed vertically above the heat exchanger panel; and a sound dampening device disposed within an interior space of the heat exchanger assembly such that air is pulled into the interior space through the heat exchanger panel and then flows through the sound dampening device before being discharged from the heat exchanger assembly via the fan assembly. The sound dampening device includes baffle members having sound absorbing material and spaced apart from one another for allowing air flow therebetween. Each baffle member extends at an angle relative to a plane extending through the upper and lower ends of the heat exchanger panel so as to direct air flow upwardly toward the fan assembly.

19 Claims, 45 Drawing Sheets

(51) Int. Cl.
*F28F 3/06* (2006.01)
*F28F 9/007* (2006.01)

(52) U.S. Cl.
CPC ..... *F28F 9/0075* (2013.01); *F24F 2013/242* (2013.01); *F28F 2265/28* (2013.01)

(56) References Cited

U.S. PATENT DOCUMENTS

| | | | | |
|---|---|---|---|---|
| 4,688,472 | A | 8/1987 | Inglis | |
| 4,691,766 | A | 9/1987 | Wurz et al. | |
| 7,391,611 | B2 | 6/2008 | Ko et al. | |
| 7,806,228 | B2 | 10/2010 | Dyck et al. | |
| 7,864,530 | B1 | 1/2011 | Hamburgen et al. | |
| 8,113,010 | B2 | 2/2012 | Carlson | |
| 8,210,308 | B2 | 7/2012 | Penner et al. | |
| 8,770,340 | B2 | 7/2014 | Cursetjee | |
| 8,813,908 | B1 | 8/2014 | Liu et al. | |
| 10,113,816 | B2 * | 10/2018 | Akiyoshi | F24F 1/0029 |
| 10,260,772 | B2 | 4/2019 | Mouratidis | |
| 10,480,820 | B2 * | 11/2019 | Hjorth | F24H 3/06 |
| 2006/0131101 | A1 | 6/2006 | Crocker | |
| 2010/0329850 | A1 | 12/2010 | Feisthammel et al. | |
| 2012/0279689 | A1 | 11/2012 | Wang et al. | |
| 2014/0262147 | A1 * | 9/2014 | Pawlick | F28D 1/0426 165/67 |
| 2016/0313015 | A1 * | 10/2016 | Uhlenbusch | B60H 1/00664 |
| 2017/0276397 | A1 * | 9/2017 | Mouratidis | F24F 13/08 |
| 2017/0292735 | A1 | 10/2017 | Hjorth et al. | |
| 2017/0292789 | A1 * | 10/2017 | Hjorth | F28F 9/001 |
| 2018/0106266 | A1 | 4/2018 | Bertels | |

FOREIGN PATENT DOCUMENTS

| | | | |
|---|---|---|---|
| CN | 204555739 | U | 8/2015 |
| CN | 206876012 | U | 1/2018 |
| CN | 109059244 | A | 12/2018 |
| CN | 109844418 | A | 6/2019 |
| WO | 2017/171571 | A1 | 10/2017 |

OTHER PUBLICATIONS

English Abstract for CN1782601 retrieved on Espacenet on Aug. 6, 2020.
English Abstract for CN104654825 retrieved on Espacenet on Aug. 6, 2020.
English Abstract for CN109059244 retrieved on Espacenet on Aug. 6, 2020.
Office Action with regard to the counterpart CN Patent Application No. 2020108858961 dated Mar. 1, 2022.
English Abstract for CN206876012 retrieved on Espacenet on Mar. 5, 2022.
English Abstract for CN204555739 retrieved on Espacenet on Mar. 5, 2022.
English Abstract for CN109844418 retrieved on Espacenet on Mar. 5, 2022.

* cited by examiner

HEAT EXCHANGER ASSEMBLY

CROSS-REFERENCE

The present application claims priority from European Patent Application No. 19315106.5, filed on Aug. 30, 2019, the entirety of which is incorporated herein by reference.

FIELD OF TECHNOLOGY

The present disclosure relates to heat exchanger assemblies such as dry coolers.

BACKGROUND

Heat exchanger assemblies are used to evacuate heat from environments that require a generally cool operating temperature. For instance, data centers typically rely on heat exchanger assemblies such as dry coolers to provide adequate cooling to the electronic devices (e.g., servers and others) operating therein. However, since dry coolers are installed outside of the data centers (e.g., on their roofs) to evacuate heated air into the surroundings, operation of dry coolers in populated areas can be problematic due to their high levels of sound emission which can be bothersome to inhabitants in the vicinity thereof.

Typically, sound emission from a heat exchanger assembly such as a dry cooler mainly results from the suction of air at the level of the dry cooler's fan impellers where heated air is aspirated from an interior space of the dry cooler and discharged therefrom. Notably, sound emissions have been found to be generated both at the "entrance" of the fan impellers (where air flow traverses the fan impellers) and at the "exit" thereof (where air flow is expelled by the fan impellers). As such, many solutions have been proposed to address this problem, including devices which are attached to the heat exchanger assembly for treatment of air flow at both the exit and entrance of the fan impellers. However, these devices tend to be bulky and add to the height of the heat exchanger assembly, which makes it impractical. In addition, these solutions can be expensive to implement and due to their significant size, difficult to install (in some cases needing heavy lifting equipment such as a crane). In some cases, outer acoustic barriers have been implemented to surround or even completely enclose a dry cooler. However, such acoustic barriers are also expensive and have a significant footprint and thus take up a lot of otherwise usable space, making it a less than ideal solution.

Furthermore, while it is generally desirable to maximize the size of the fans of a dry cooler to increase its efficiency, this tends to even further exacerbate the already significant levels of sound emission of the dry cooler. In a similar manner, reducing the width of the dry cooler assembly to have a more compact and convenient dry cooler can have a detrimental effect on its sound emission as the fan becomes bigger in comparison.

Similar problems may apply to other types of heat exchanger assemblies (e.g., a chiller, a condenser).

Therefore, there is a need for a heat exchanger assembly which overcomes or reduces at least some of the above-described drawbacks.

SUMMARY

It is an object of the present technology to ameliorate at least some of the inconveniences present in the prior art.

According to an aspect of the present technology, there is provided a heat exchanger assembly. The heat exchanger assembly includes: a frame; a heat exchanger panel mounted to the frame and configured to exchange heat with air flowing therethrough, the heat exchanger panel having a lower end and an upper end, the heat exchanger panel being disposed at an inclined orientation such that the upper and lower ends thereof are offset from one another, the heat exchanger panel comprising: a tubing arrangement for circulating fluid therein; and a plurality of fins in thermal contact with the tubing arrangement, the fins being spaced apart from one another for air to flow therebetween and into an interior space of the heat exchanger assembly; a plurality of enclosing panels connected to the frame and defining in part the interior space of the heat exchanger assembly; a fan assembly disposed vertically above the heat exchanger panel, the fan assembly comprising a fan impeller rotatable about a fan rotation axis to pull air into the interior space of the heat exchanger assembly through the heat exchanger panel and evacuate heated air upwardly from the interior space of the heat exchanger assembly through the fan assembly; and a sound dampening device disposed within the interior space of the heat exchanger assembly such that air pulled into the interior space through the heat exchanger panel and then flows through the sound dampening device before being discharged from the heat exchanger assembly via the fan assembly, the sound dampening device comprising: a plurality of baffle members comprising a sound absorbing material, the baffle members being spaced apart from one another for allowing air flow therebetween, each of the baffle members extending at an angle relative to a plane extending through the upper and lower ends of the heat exchanger panel so as to direct air flow upwardly toward the fan assembly.

In some embodiments, each of the baffle members has a first portion and a second portion extending from the first portion; the first portion is positioned closer to the heat exchanger panel than the second portion such that air pulled into the heat exchanger assembly and flowing through the sound dampening device traverses along the first portion of each of the baffle members before reaching the second portion thereof; and the second portion extends upwardly at an angle relative to the first portion to deflect air flow incoming from a direction of the first portion.

In some embodiments, the second portion of each baffle member extends generally vertically.

In some embodiments, the first portion of each baffle member extends at an angle between 40° and 75° inclusively relative to a horizontal plane.

In some embodiments, a spacing between consecutive ones of the baffle members is variable.

In some embodiments, each of the baffle members has an upper end and a lower end; and the lower end of a given one of the baffle members is positioned vertically lower than the upper end of a consecutive one of the baffle members positioned below the given one of the baffle members.

In some embodiments, the baffle members are first baffle members; the sound dampening device further comprises: a plurality of second baffle members affixed to the first baffle members, the second baffle members extending perpendicular to the first baffle members and to the plane extending through the upper and lower ends of the heat exchanger panel, the second baffle members being spaced apart from one another, the first baffle members and the second baffle members forming air ducts therebetween.

In some embodiments, the first baffle members and the second baffle members form a rectangular grid defining the air ducts.

In some embodiments, each of the second baffle members has a generally triangular shape.

In some embodiments, each of the second baffle members comprises: a first edge; a second edge extending perpendicularly to the first edge; and a third edge extending diagonally relative to the first and second edges, the third edge being adjacent to the heat exchanger panel.

In some embodiments, a spacing between consecutive ones of the second baffle members is variable.

In some embodiments, the heat exchanger assembly further comprises: a plurality of acoustic panels connected to the enclosing panels for acoustically insulating the interior space of the heat exchanger assembly.

In some embodiments, the heat exchanger panel is a first heat exchanger panel; the fan assembly is a first fan assembly, and the fan rotation axis is a first fan rotation axis; the sound dampening device is a first sound dampening device; and the heat exchanger assembly further comprises: a second heat exchanger panel mounted to the frame and configured to exchange heat with air flowing therethrough, the second heat exchanger panel having a lower end and an upper end, the second heat exchanger panel being disposed at an inclined orientation such that the upper and lower ends thereof are offset from one another, the first and second heat exchanger panels being disposed in a V-configuration such that a distance between the upper ends of the first and second heat exchanger panels is greater than a distance between the lower ends of the first and second heat exchanger panels, the second heat exchanger panel comprising: a tubing arrangement for circulating fluid therein; and a plurality of fins in thermal contact with the tubing arrangement of the second heat exchanger panel, the fins of the second heat exchanger panel being spaced apart from one another for air to flow therebetween and into the interior space of the heat exchanger assembly; a second fan assembly disposed vertically above the second heat exchanger panel, the second fan assembly comprising: a fan impeller rotatable about a second fan rotation axis to pull air into the interior space of the heat exchanger assembly through the second heat exchanger panel and evacuate heated air upwardly from the interior space of the heat exchanger assembly through the second fan assembly; and a second sound dampening device disposed within the interior space of the heat exchanger assembly such that air is pulled into the interior space through the second heat exchanger panel and then flows through the second sound dampening device before being discharged from the heat exchanger assembly via the second fan assembly, the second sound dampening device comprising: a plurality of baffle members comprising a sound absorbing material, the baffle members of the second sound dampening device being spaced apart from one another for allowing air flow therebetween, each of the baffle members of the second sound dampening device extending at an angle relative to a plane extending through the upper and lower ends of the second heat exchanger panel so as to direct air flow upwardly toward the second fan assembly.

In some embodiments, the frame includes: a first leg and a second leg laterally spaced apart from the first leg; at least one lower transversal member extending laterally and interconnecting the first and second legs; a first upstanding member and a second upstanding member laterally spaced apart from the first upstanding member, the first and second upstanding members extending upwardly from the first and second legs; an upper transversal member extending laterally and connected to upper ends of the first and second upstanding members; and an upper frame assembly affixed to the upper transversal member and supporting the first and second fan assemblies, wherein: the first and second heat exchanger panels are disposed on opposite sides of a vertical plane extending through the first and second upstanding members; and the first fan rotation axis and the second fan rotation axis are disposed on opposite sides of the vertical plane extending through the first and second upstanding members.

In some embodiments, the sound absorbing material is one of: a foam material, fiberglass, mineral wool and cotton.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF DRAWINGS

Further aspects and advantages of the present technology will become better understood with reference to the description in association with the following in which.

DETAILED DESCRIPTION

Figure 1:
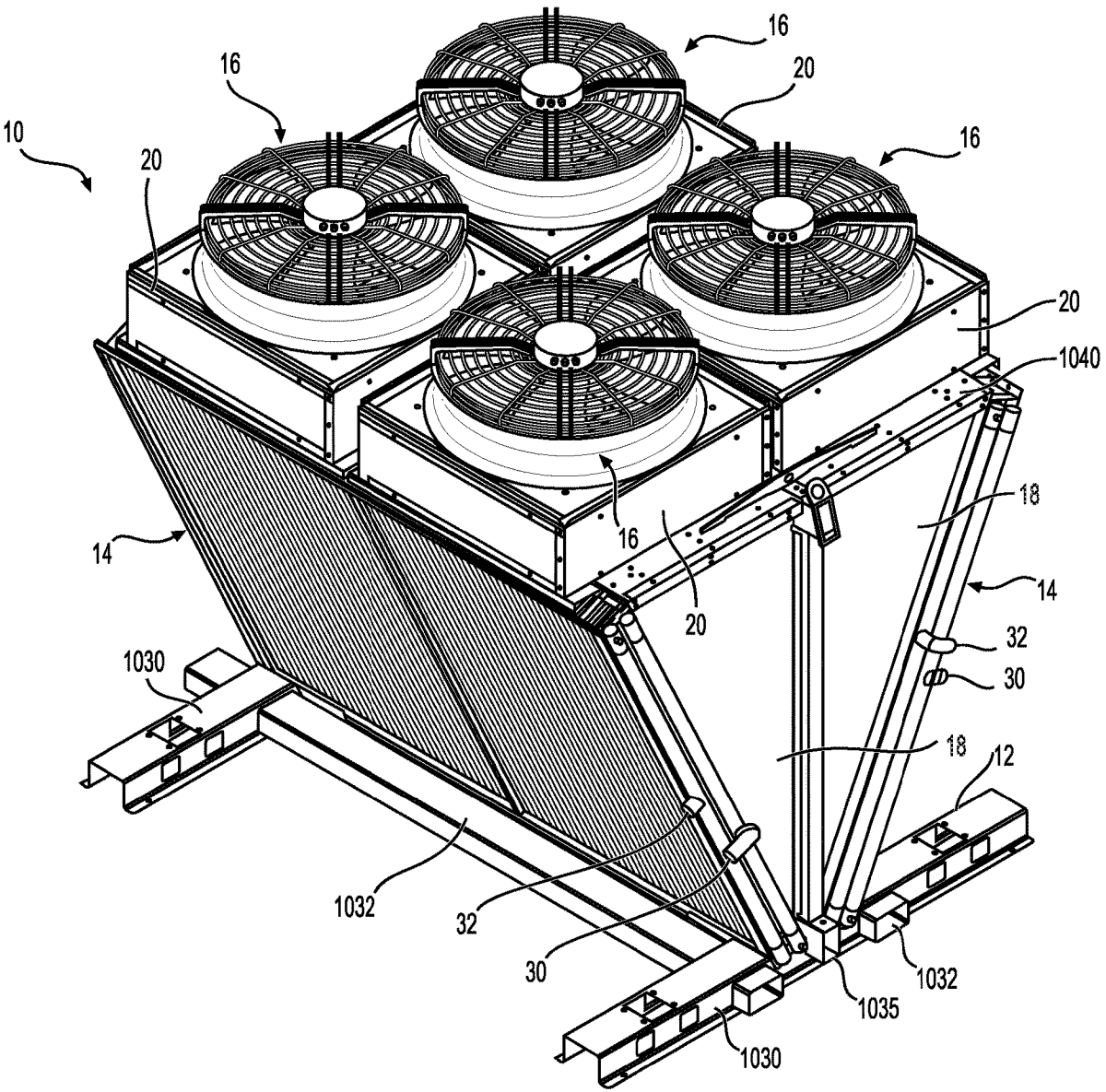
FIG. 1 is a perspective view of a heat exchanger assembly according to an embodiment of the present technology.

As seen in FIG. 1, there is provided a heat exchanger assembly 10 in accordance with an embodiment of the present technology. In this embodiment, the heat exchanger assembly 10 is a dry cooler 10. However, it is contemplated that any other suitable type of heat exchanger assembly (e.g., a condenser, a chiller) may be constructed in the manner that will be described below.

The dry cooler 10 comprises a frame 12 which supports the dry cooler 10 on a support surface (e.g., a roof of a building), a plurality of heat exchanger panels 14 for exchanging heat with air flowing therethrough, and a plurality of fan assemblies 16 for pulling air through the heat exchanger panels 14 and discharging air from an interior space 25 of the dry cooler 10. A plurality of enclosing panels 18, 19 (FIG. 6) are also affixed to the frame 12 to define in part the interior space 25 of the dry cooler 10.

As will be described in greater detail below, the dry cooler 10 is also provided with casings 20 (each one associated with a respective one of the fan assemblies 16) to attenuate sound emissions generated by the dry cooler 10.

Figure 18:
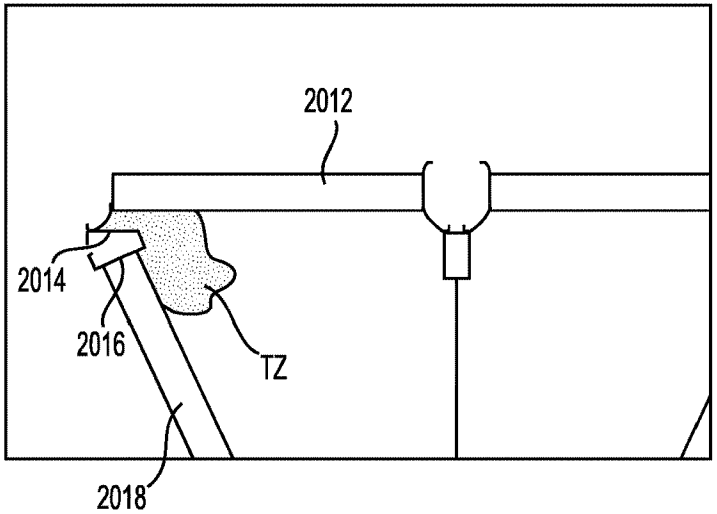
FIG. 18 (PRIOR ART)
FIG. 18 is a cross-sectional view of part of the conventional dry cooler of FIG. 17.
Figure 17:
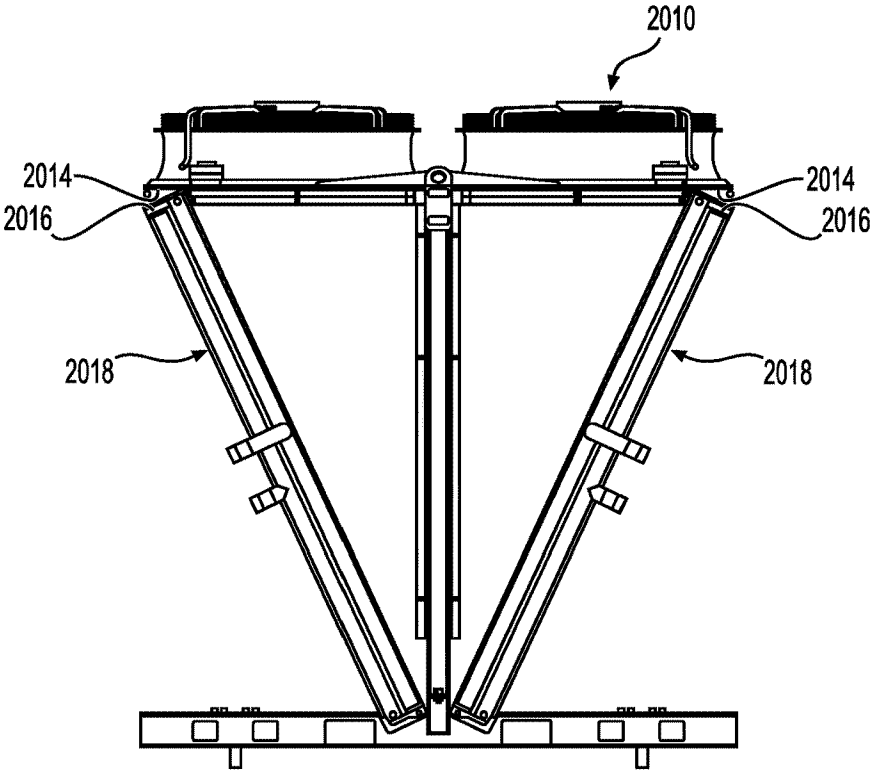
FIG. 17 (PRIOR ART)
FIG. 17 is a side elevation view of a conventional dry cooler according to the prior art.
Figure 19:
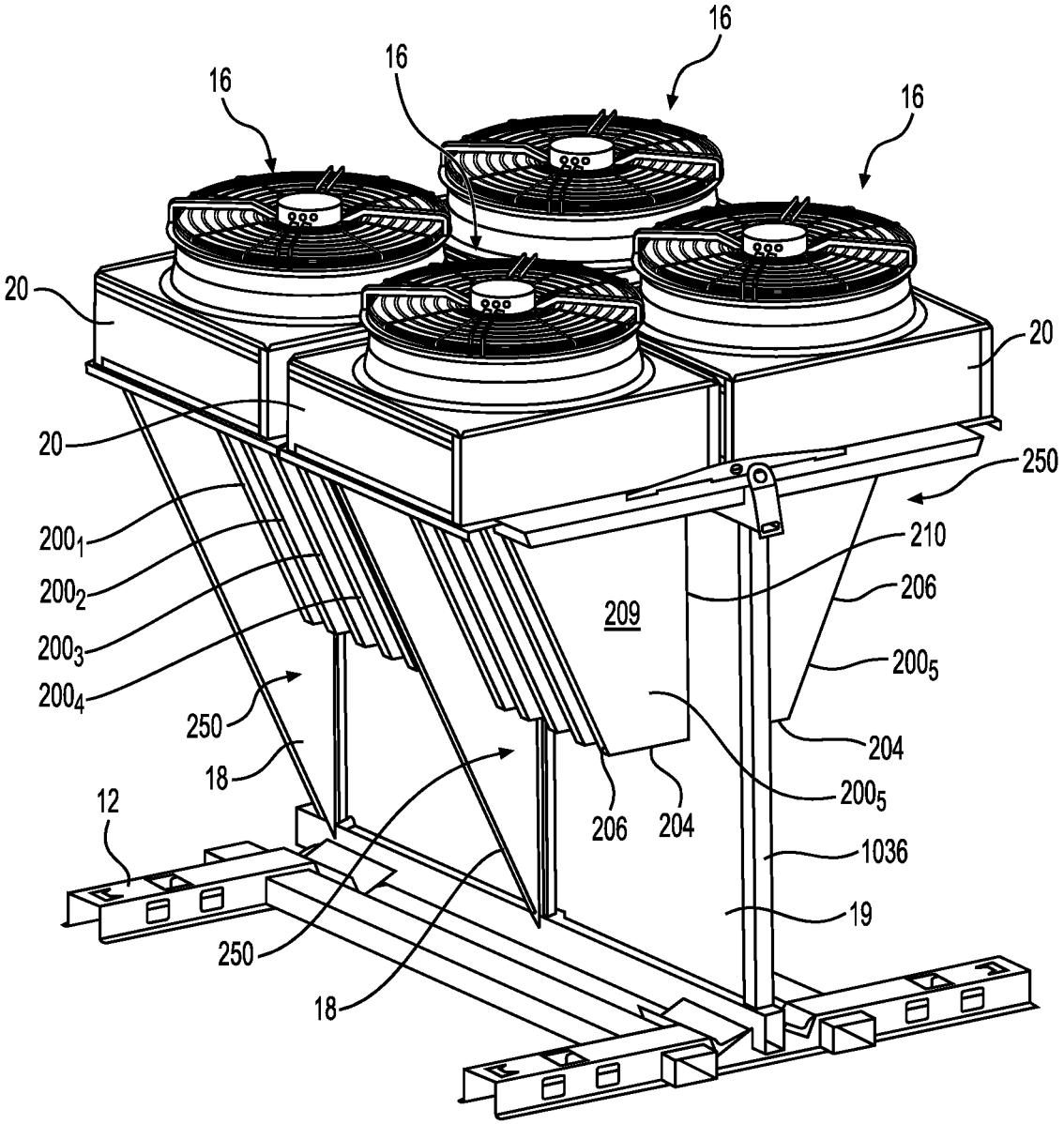
FIG. 19 is a perspective view of part of the heat exchanger assembly in accordance with another embodiment in which the heat exchanger assembly has sound dampening devices disposed in an interior space of the heat exchanger assembly, the heat exchanger panels being removed to expose the sound dampening devices.

Notably, with reference to FIGS. 17 and 18, a significant source of sound emission in a conventional dry cooler 2010 has been found to be caused by a "blade-passing effect" which involves part of a fan impeller 2012 of the dry cooler 2010 passing over a plate member 2014 disposed atop an upper end 2016 of a heat exchanger panel 2018. In particular, with reference to FIG. 18 which illustrates a cross-section of the conventional dry cooler 2010, a fluid flow analysis has shown that the proximity of the fan impeller 2012 to the plate member 2014 causes the flow of air within the dry cooler 2012 to be turbulent at zone TZ between the fan impeller 2012 and the plate member 2014. This turbulent flow has been identified as a significant source of noise produced by the conventional dry cooler 2010, in addition to generating significant vibrations which can negatively affect the life cycle of certain components of the dry cooler 2010. It should be pointed out that the blade-passing effect is in part a result of a desire to produce a narrower dry cooler 2010 (which makes it easier to transport and affords more space in the environment in which it is installed) while simultaneously having a fan impeller 2012 of a significant diameter to improve the efficiency of the dry cooler 2010. As will be described below, the casings 20 of the dry cooler 10 alleviate this blade-passing effect such that the dry cooler 10 is relatively quiet in comparison to the conventional dry cooler 2010.

Figure 5:
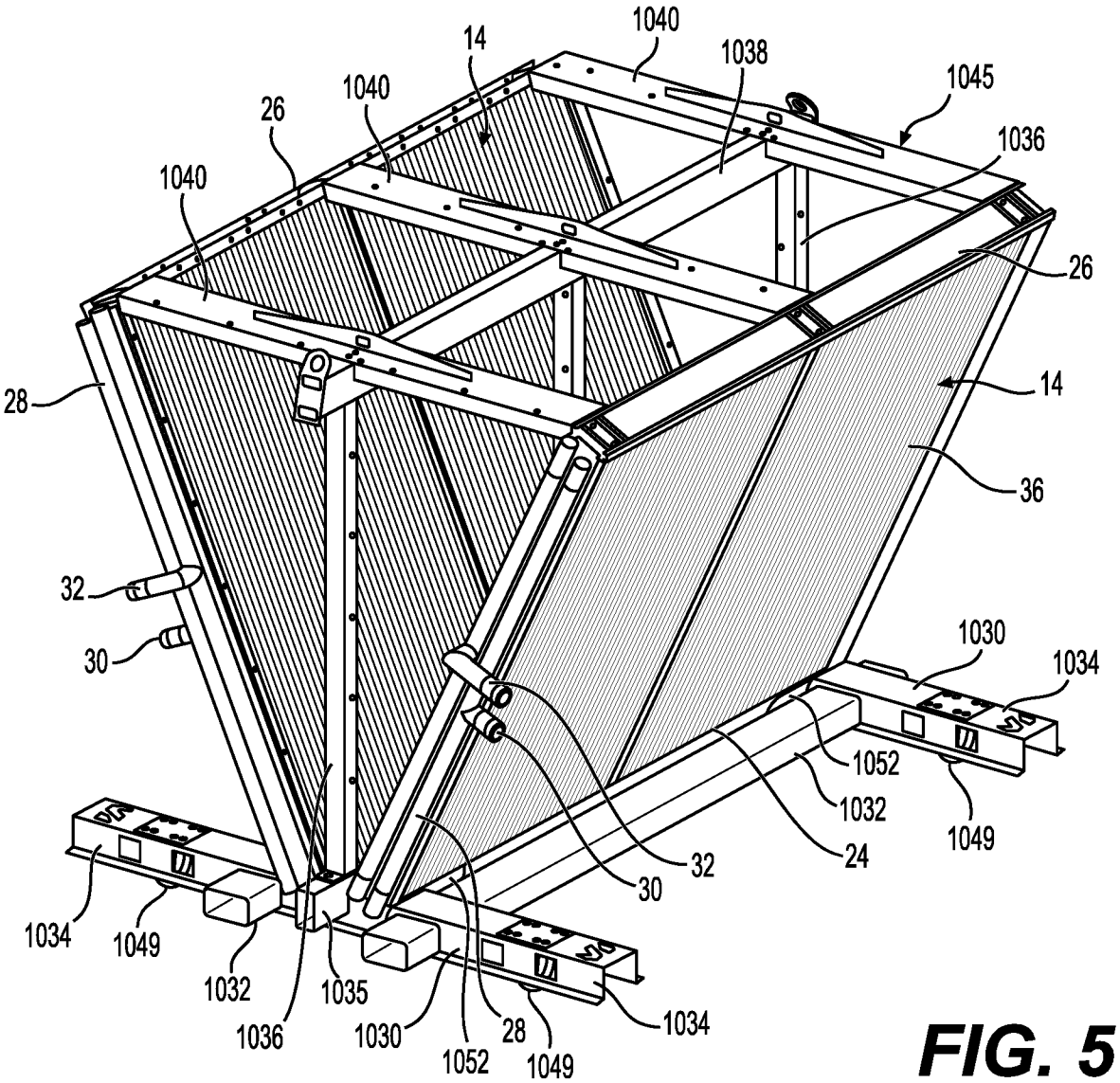
FIG. 5 is a perspective view of a frame and heat exchanger panels of the heat exchanger assembly of FIG. 1.
Figure 6:
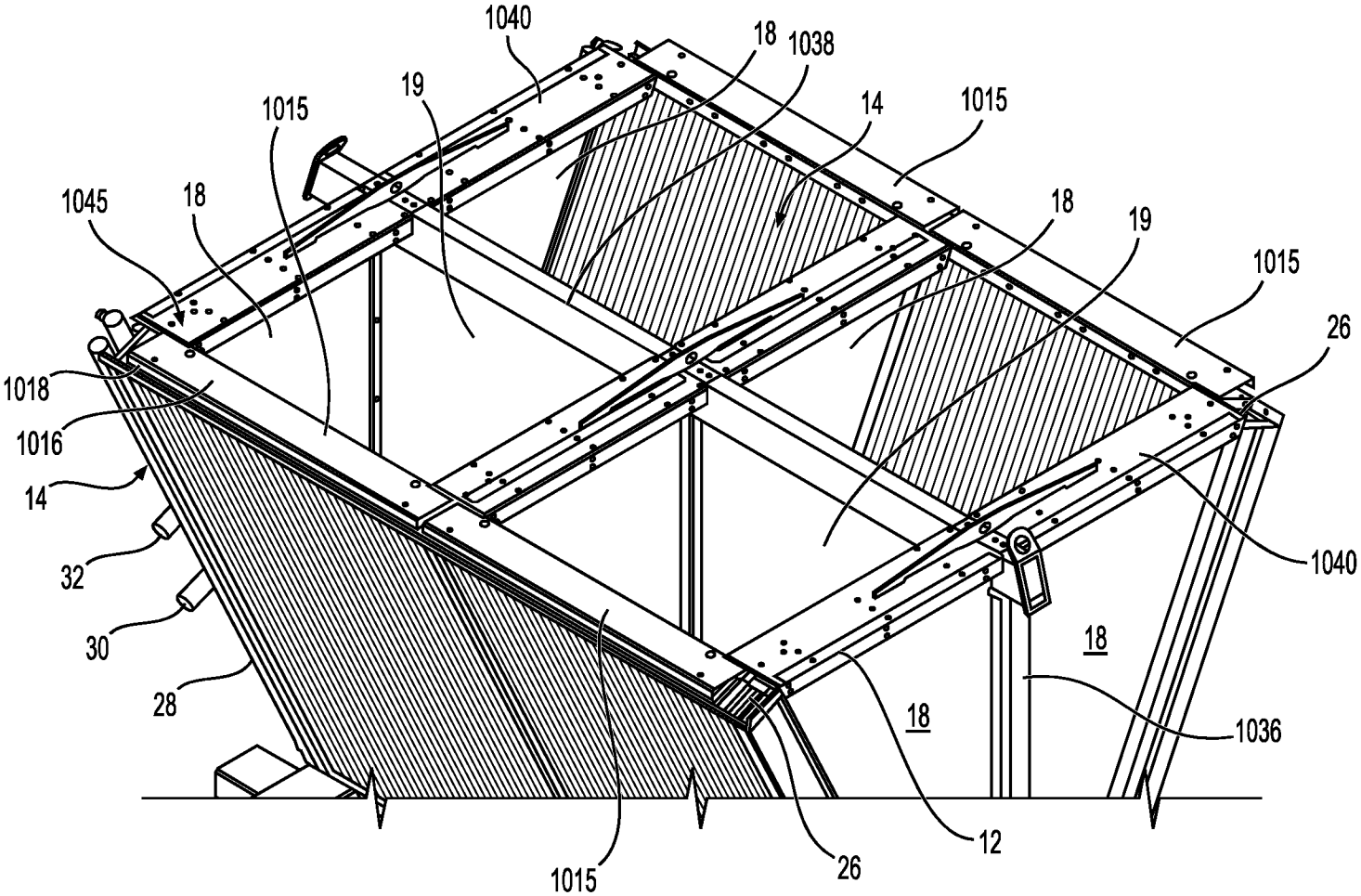
FIG. 6 is a perspective view of part of the frame and heat exchanger panels of the heat exchanger assembly of FIG. 1.
Figure 7:
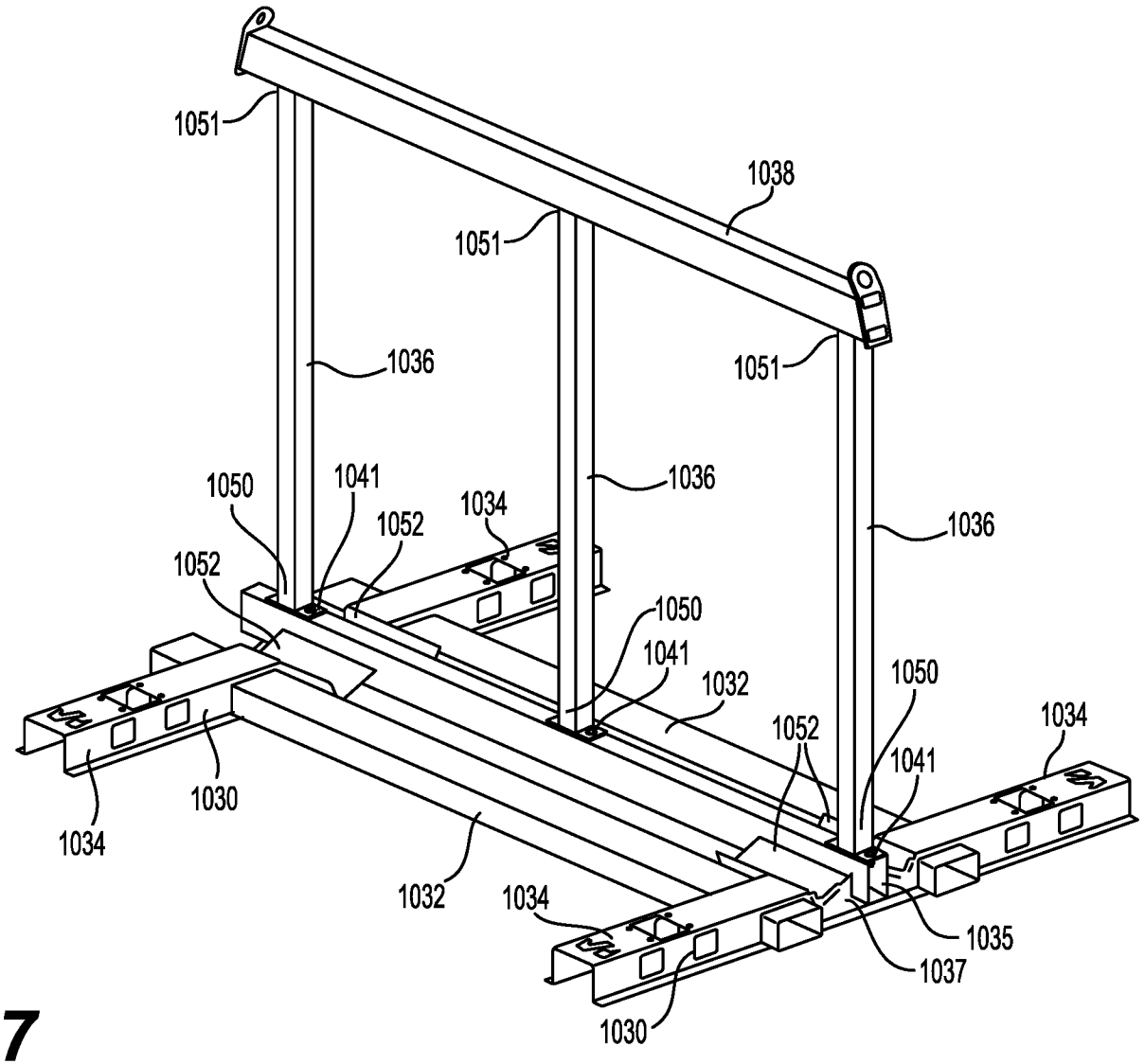
FIG. 7 is a perspective view of part of the frame of the heat exchanger assembly of assembly FIG. 1.
Figure 8:
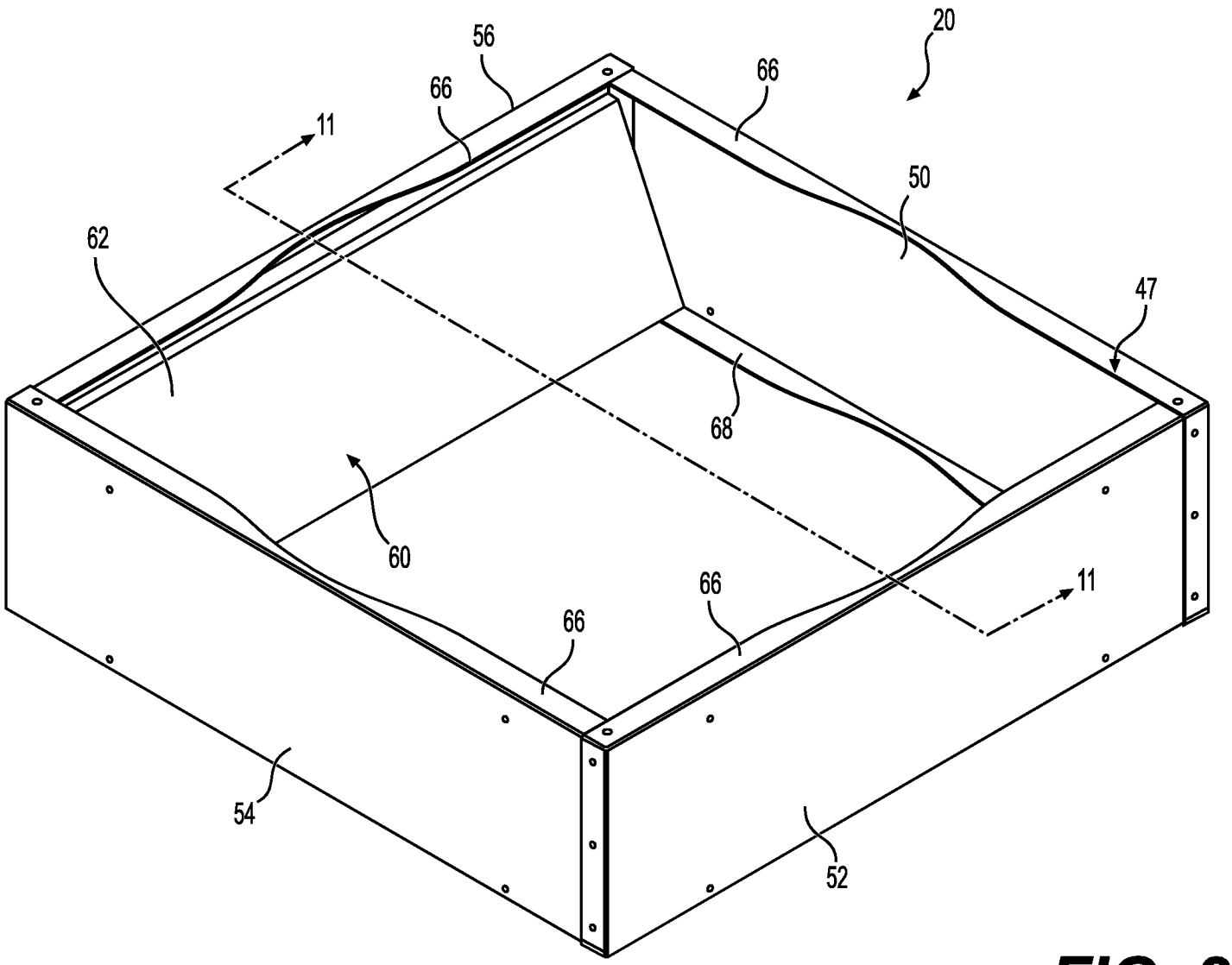
FIG. 8 is perspective view of a casing of the heat exchanger assembly of FIG. 1.
Figure 9:
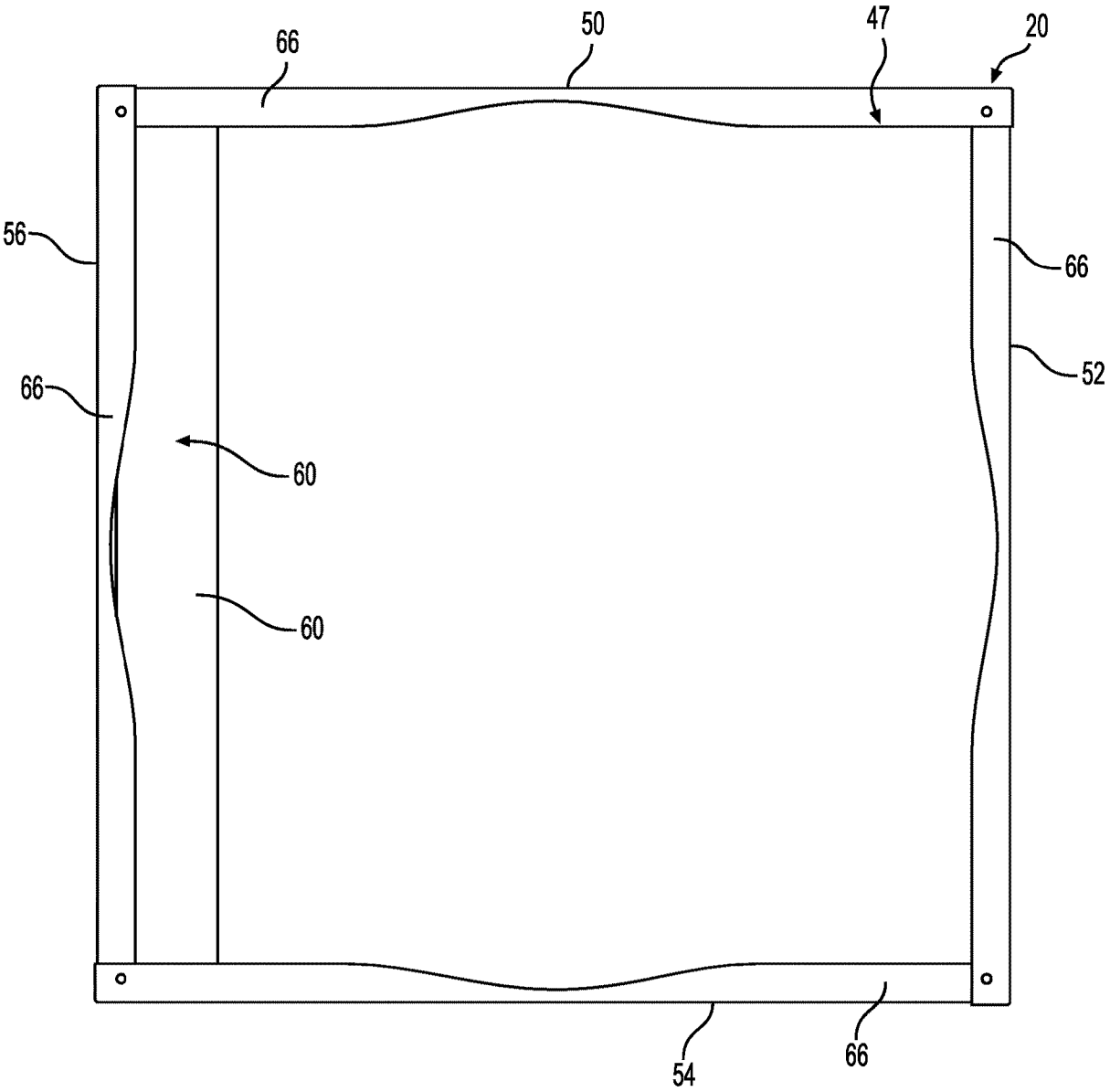
FIG. 9 is a top plan view of the casing of FIG. 8.
Figure 10:
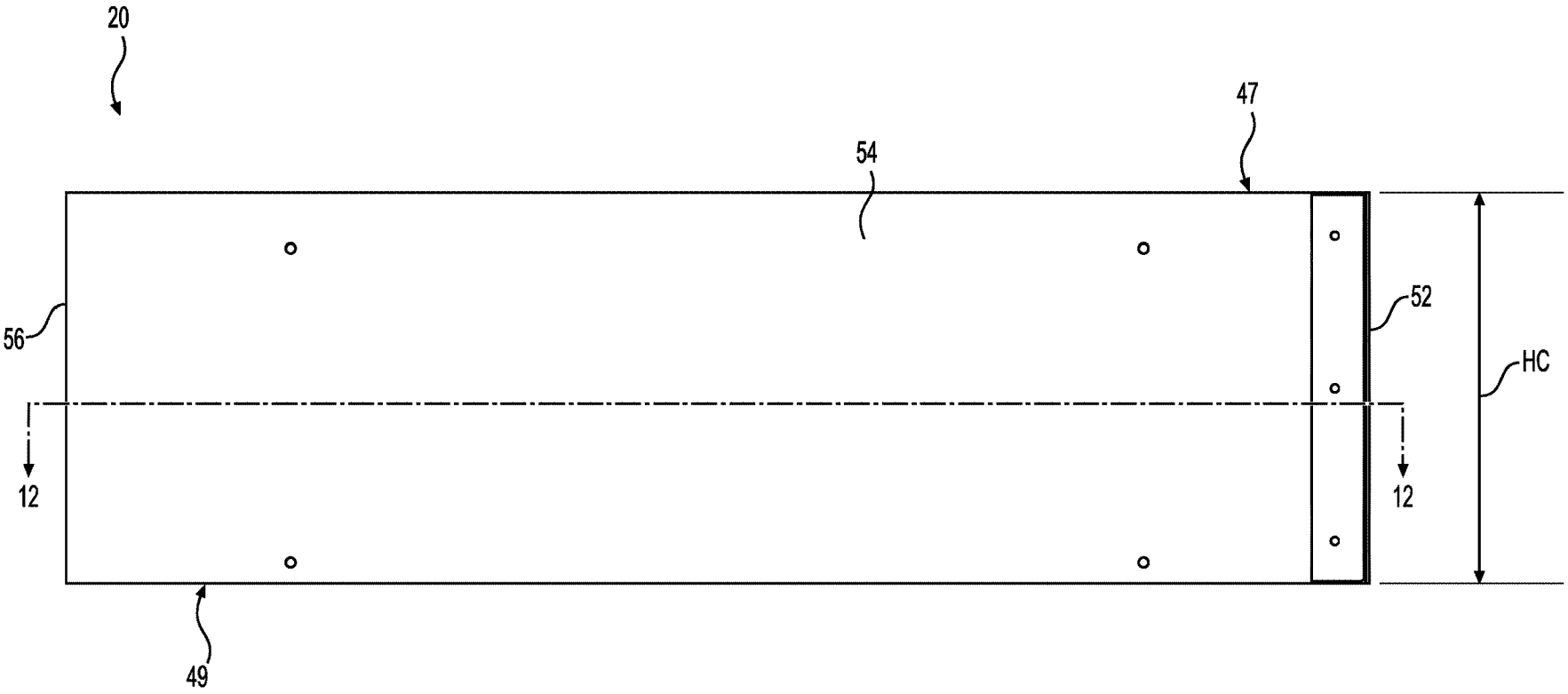
FIG. 10 is a side elevation view of the casing of FIG. 8.

Returning now to the dry cooler 10 of the present technology, with reference to FIGS. 5 to 7, the frame 12 is configured to support various components of the dry cooler 10. To that end, the frame 12 comprises two legs 1030 laterally spaced apart from one another and which support the dry cooler 10 on the support surface. Each of the legs 1030 extends from a first end to a second end and has opposite end portions 1034 and a central portion 1037 between the end portions 1034. In this embodiment, the end portions 1034 of each of the legs have a U-shaped cross-section while the central portion 1037 has a generally planar configuration forming a wall that extends along a plane extending vertically and parallel to the legs 1030. In some embodiments, the dry cooler 10 may include wheels 1049 (e.g., caster wheels) (FIG. 5) that are connected to the end portions 1034 of the legs 1030 such that the dry cooler 10 can be more easily displaced. For instance, this may facilitate moving the dry cooler 10 in/out of a container for transport.

Interconnecting the legs 1030 is a lower transversal member 1035 which extends laterally (i.e., transversally to the legs 1030) and interconnects the legs 1030 of the frame 12. In this embodiment, the lower transversal member 1035 is centered between the ends of each of the legs 1035 and is thus connected to the central portion 1037 of each of the legs 1030. More specifically, in this example, each of the legs 1030 has a cut-out configured to support therein part of the lower transversal member 1035. To that end, the cut-out has a shape and dimensions designed to receive the lower transversal member 1035.

A pair of bracing members 1032 also extend laterally (i.e., parallel to and spaced apart from the lower transversal member) to interconnect the legs 1030. More specifically, the end portions 1034 of each of the legs 1030 have a rectangular groove for receiving a respective one of the bracing members 1032. The bracing members 1032 may be connected to the legs 1030 in any suitable way. In this example, the bracing members 1032 are fastened (e.g., welded) to the legs. The bracing members 1032 are positioned such that the lower transversal member 1035 is disposed between the bracing members 1032. The bracing members 1032 may be used to lift the dry cooler 10 via a forklift or other work vehicle, with the forks thereof being engaged within the cavity of each of the bracing members.

A plurality of angular members 1052 are located between the legs 1030 and are configured to support the heat exchanger panels 14 of the dry cooler 10. In this embodiment, four angular members 1052 are provided, with each angular member 1052 being disposed between a respective one of the bracing members 1032 and the lower transversal member 1035 such that two of the angular members 1052 are located on one side of the lower transversal member 1035 while the other two angular members 1052 are located on the opposite side of the lower transversal member 1035. Moreover, in this embodiment, each of the angular members 1052 is connected to a respective one of the legs 1030 and to the lower transversal member 1035. It is contemplated that, in alternative embodiments, the angular members 1052 could be connected solely to the lower transversal member 1035. The angular members 1052 have an angular configuration for conforming to the orientation of lower ends 24 of the heat exchanger panels 14. Notably, each angular member 1052 includes two upwardly oriented faces that are transversal (e.g., perpendicular) to one another and converge at a junction. In this embodiment, the angular member is a bent component such that the junction is a bend in the angular member.

The frame 12 further comprises three upstanding members 1036 laterally spaced apart from one another and extending upwardly (e.g., vertically) from the lower transversal member 1035. Notably, each of the upstanding members 1036 extends from a lower end portion 1050 that is connected to the lower transversal member 1050 to an upper end portion 1051. The upstanding members 1036 can be connected to the lower transversal member 1035 in any suitable way. In this embodiment, as shown in FIG. 7, fasteners (e.g., bolts) fasten a flange 141 at the lower end portion 1050 of each of the upstanding members 1036 to the lower transversal member 1035. An upper transversal member 1038, extending laterally and connecting the upper end portions 1051 of the upstanding members 1036, is disposed above the lower transversal member 1035. The upper transversal member 1038 is connected to the upstanding members 1036 in any suitable way (e.g., welded).

An upper frame assembly 1045 is affixed to the upper transversal member 1038 and is configured to support the casings 20. The upper frame assembly 1045 comprises three upper retaining members 1040 which extend transversally to the upper transversal member 1038 and parallel to the legs 1030. The upper retaining members 1040 are laterally spaced apart from one another and are connected to the upper transversal member 1038. More specifically, an underside of each of the upper retaining members 1040 has a cut-out of an appropriate shape and size for receiving part of the upper transversal member 1038.

In this embodiment, the lower transversal member 1035, the upstanding members 1036, the upper transversal member 1038 and the upper retaining members 1040 are tubular, defining an interior space therein. This may allow the frame to support a greater load than if the members were made of sheet metal as is typically the case in conventional dry cooler assemblies.

As best seen in FIG. 5, the heat exchanger panels 14 are mounted to the frame 12 and configured to exchange heat with air flowing therethrough. In this embodiment, the dry cooler 10 includes two heat exchanger panels 14, each being disposed on opposite sides of a vertical plane extending through the upstanding members 1036 of the frame 12, such that the heat exchanger panels 14 are arranged on each side of the lower transversal member 1035 of the frame 12. The lower end 24 of each heat exchanger panel 14 is supported by a respective one of the angular members 1052 of the frame 12 while an upper end 26 of each heat exchanger panel 14 is affixed to the upper frame assembly 1045. In particular, the upper end 26 of each of the heat exchanger panels 14 is connected to the ends of upper retaining members 1040 via fasteners (e.g., bolts). Moreover, the lower end 24 of each of the heat exchanger panels 14 is supported by at least one of the angular members 1052 of the frame 12 such that the lower end 24 of each of the heat exchanger panels 14 is disposed between the bracing members 1032 of the frame 12. The lower end 24 of each of the heat exchanger panels 14 is fastened (e.g., bolted) to the angular members 1052.

Figure 4:
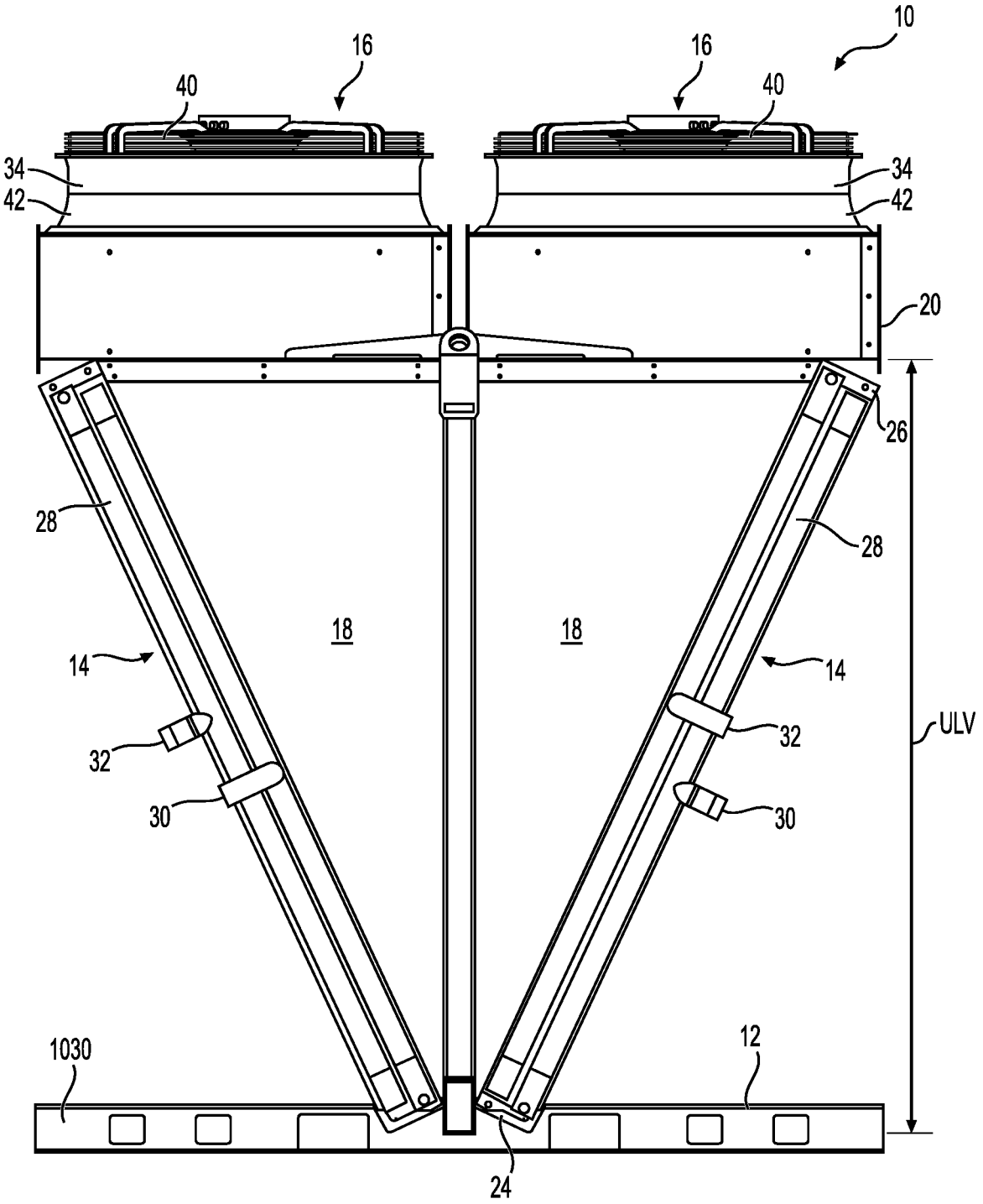
FIG. 4 is a side elevation view of the heat exchanger assembly of FIG. 1.

Notably, as best seen in FIG. 4, each of the heat exchanger panels 14 is disposed in an inclined orientation such that the upper and lower ends 24, 26 thereof are offset from one another. In particular, the two heat exchanger panels 14 are disposed in a V-configuration such that a distance between the upper ends 26 of the heat exchanger panels 14 is greater than a distance between the lower ends 24 of the heat exchanger panels 14. For instance, an angle formed between the heat exchanger panels 14 may be approximately 50°. This configuration reduces the footprint, or amount of ground space occupied by the dry cooler 10 and facilitates its transport, notably in shipping containers, or heavy-duty trailers, and the like.

Moreover, as shown in FIG. 6, four outer fan supporting members 1015 are connected to respective ones of the heat exchanger panels 14 and are configured to support respective ones of the fan assemblies 16. In particular, the outer fan supporting members 1015 are provided to support an outer part of a corresponding one of the fan assemblies 16 due to a significant diameter of a fan impeller thereof which extends beyond the innermost point of an upper end 26 of the corresponding heat exchanger panel 14. As such, each of the outer fan supporting members 1015 is disposed vertically above the upper end 26 of one of the heat exchanger panels 14. Notably, the upper end 26 of each heat exchanger panel 14 is disposed vertically below two of the outer fan supporting members 1015. Each outer fan supporting member 1015 is generally elongated and extends laterally (i.e., parallel to the upper transversal member 1038). Each outer fan supporting member 1015 has a flat plate portion 1016 and two lip portions 1018 (only one of which is shown in the Figures) extending downwardly and perpendicularly from the flat plate portion 1016. Both the flat plate portion 1016 and the lip portions 1018 extend along an entire length of the outer fan supporting member 1015. The flat plate portion 1016 is configured for affixing the corresponding fan assembly 16 thereto. Notably, the flat plate portion 1016 is provided with openings for receiving corresponding fasteners therein to affix the fan assembly 16 to the flat plate portion 1016. The innermost lip portion 1018 is affixed to the upper end 26 of the corresponding heat exchanger panel 14.

It is to be understood that the expression "vertically above" used herein to describe the positioning of components refers to a component being vertically higher than another component while simultaneously being at least partly laterally and longitudinally aligned with that component. Similarly, the expression "vertically below" used herein refers to a component being vertically lower than another component while simultaneously being at least partly laterally and longitudinally aligned with that component.

It is contemplated that, in other embodiments, two outer fan supporting members 1015 may be provided instead of four, with each outer fan supporting member 1015 extending above the upper end 26 of one of the heat exchanger panels 14.

As both heat exchanger panels 14 are configured identically in this embodiment, only one of the heat exchanger panels 14 will be described in detail below. It is understood that the same description applies to the other heat exchanger panel 14.

Figure 2:
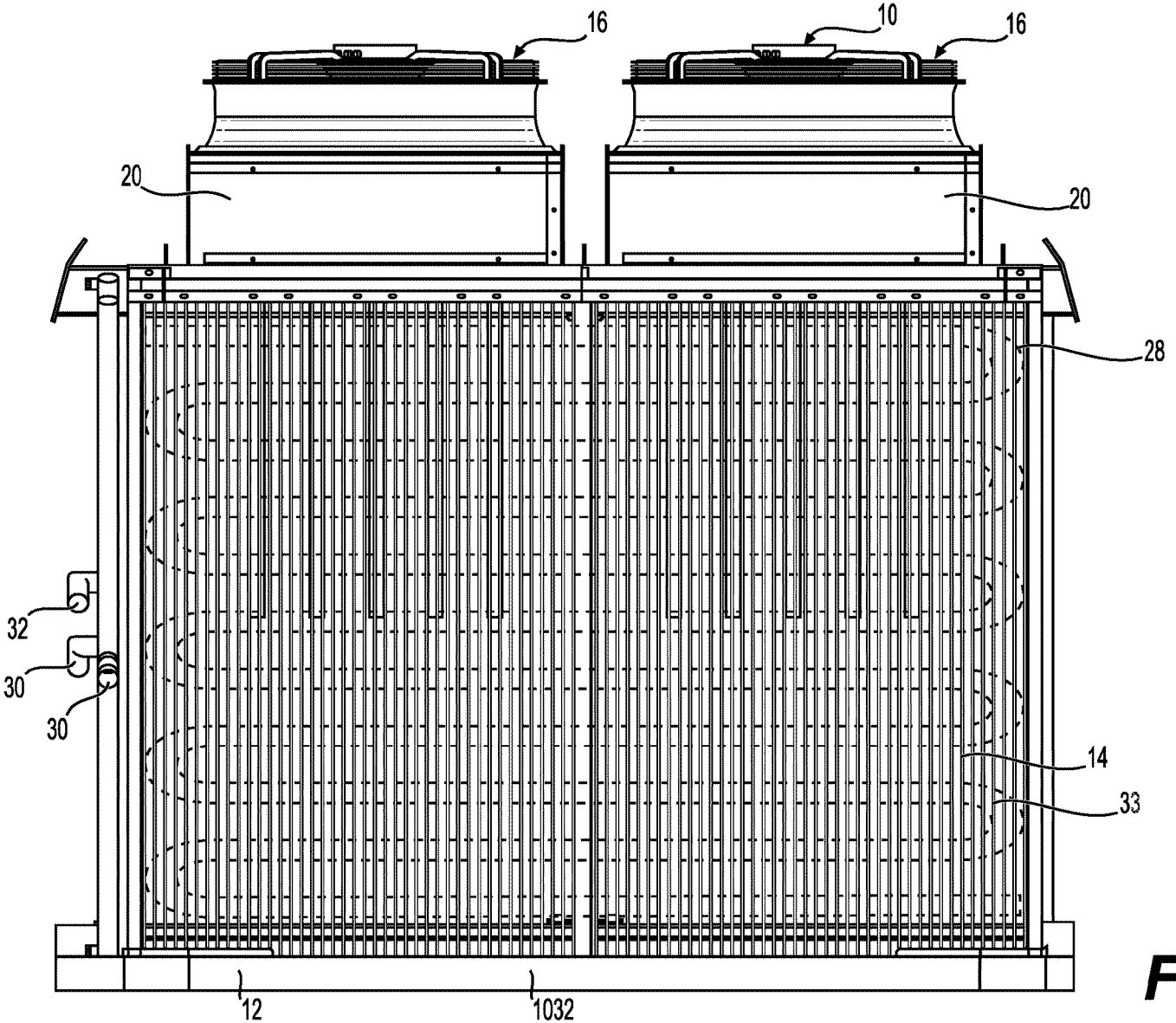
FIG. 2 is a front elevation view of the heat exchanger assembly of FIG. 1.
Figure 3:
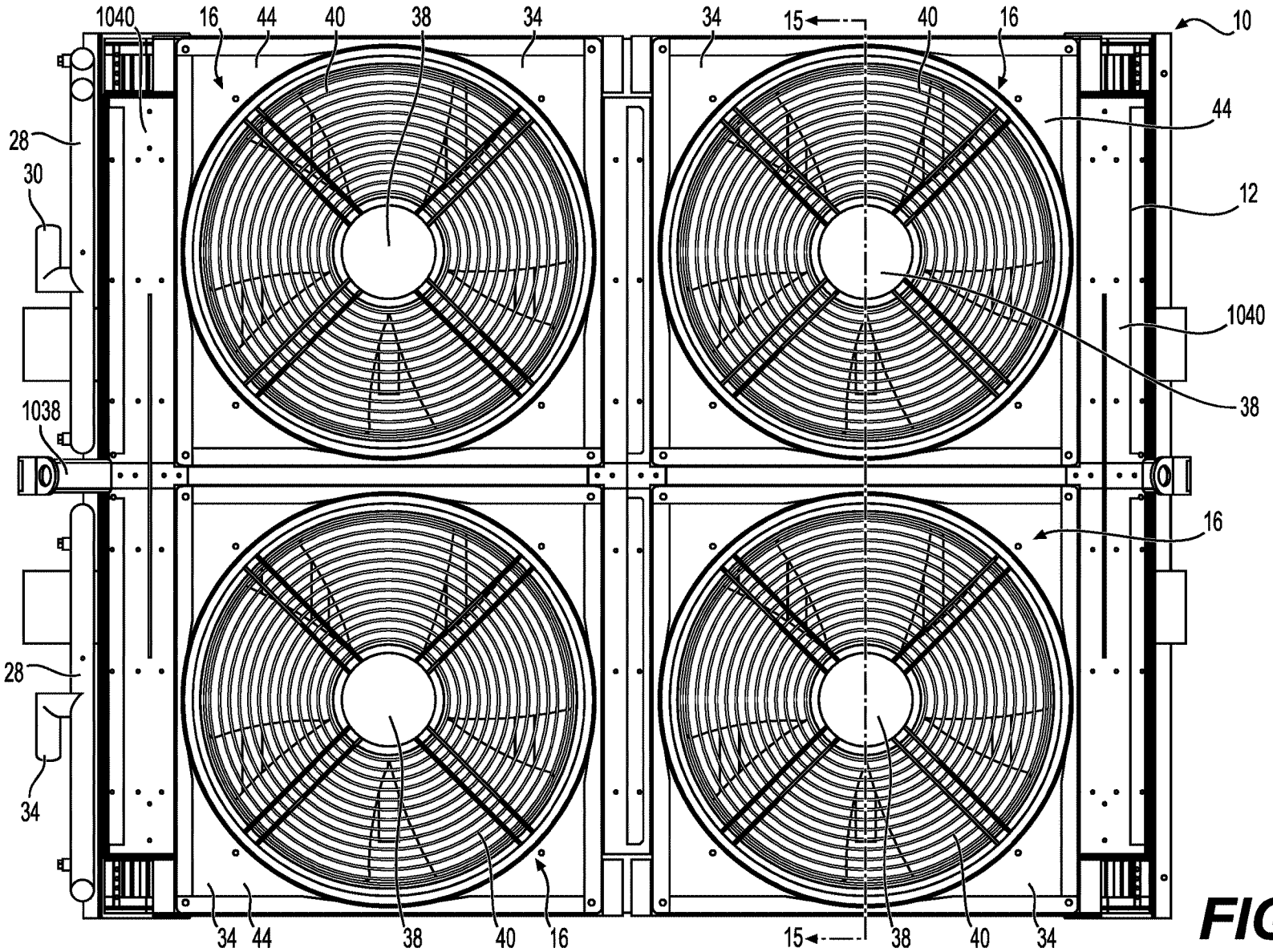
FIG. 3 is a top plan view of the heat exchanger assembly of FIG. 1.

The heat exchanger panel 14 comprises a tubing arrangement 28 for circulating fluid therein, best seen in FIG. 2. In this embodiment, the fluid circulated in the tubing arrangement 28 is water; however, it is contemplated that other fluids or additional fluids (e.g., glycol) could circulate within the tubing arrangement 28 as well. The fluid enters the tubing arrangement 28 through a fluid intake 30, and exits the tubing arrangement through a fluid outtake 32. As air is pulled into the dry cooler 10 through the heat exchanger panel 14, heat is transferred from water circulating in the tubing arrangement 28 to the air being pulled into the dry cooler 10. As such, the water circulating in the tubing arrangement 28 is cooled while, conversely, the air pulled into the dry cooler 10 is heated.

As best seen in FIG. 2, the heat exchanger panel 14 also comprises a plurality of fins 33 in thermal contact with the tubing arrangement 28 to facilitate heat exchange between fluid circulating in the tubing arrangement 28 and air pulled into the dry cooler 10. The fins 33 are spaced apart from one another for air to flow therebetween and into the interior space 25 of the dry cooler 10.

In alternative embodiments, each heat exchanger panel 14 may be replaced by a plurality of heat exchanger panels (e.g., two heat exchanger panels) arranged to be laterally-adjacent to one another (i.e., disposed side-by-side) to form a series of laterally-adjacent heat exchanger panels. In such embodiments, each series of laterally-adjacent heat exchanger panels would thus be disposed on opposite sides of the vertical plane extending through the upstanding members 1036 of the frame 12.

As shown in FIGS. 1, 4 and 6, the enclosing panels 18, 19 are connected to the frame 12 and define in part the interior space 25 of the dry cooler 10. More specifically, the enclosing panels 18, 19 define in part the lateral outer boundaries of the interior space 25 of the dry cooler 10 and also sub-divide the interior space 25 into sub-compartments, each sub-compartment being associated with a respective one of the fan assemblies 16. The enclosing panels 18, 19 include side enclosing panels 18 and middle enclosing panels 19 which extend perpendicularly to one another. Notably, the side enclosing panels 18 generally extend along a longitudinal plane (extending parallel to the legs 1030 of the frame 12) while the middle enclosing panels 19 generally extend along a lateral plane perpendicular to the longitudinal plane. In this embodiment, the dry cooler 10 includes six side enclosing panels 18 and two middle enclosing panels 19.

Each of the side enclosing panels 18 is connected to a respective one of the upstanding members 1036 of the frame 12, to an adjacent portion of an upper retaining member 1040, and to a respective one of the heat exchanger panels 14. As such, each upstanding member 1036 of the frame 12 is connected to two of the side enclosing panels 18. The side enclosing panels 18 which are disposed at the lateral extremities of the dry cooler 10 define outer walls of the dry cooler 10. On the other hand, the side enclosing panels 18 which are disposed between the lateral extremities of the dry cooler 10, namely between laterally-adjacent ones of the fan assemblies 16, define inner walls of the dry cooler 10 that sub-divide the interior space of the dry cooler 10 into laterally-adjacent sub-compartments. Given the inclined orientation of the heat exchanger panels 14, in this embodiment, the side enclosing panels 18 are generally triangular in shape.

Each of the middle enclosing panels 19 is connected to adjacent ones of the upstanding members 1036 of the frame 12, to an adjacent portion of the upper transversal member 1038 and to the lower transversal member 1035. The middle enclosing panels 19 thus define inner walls of the dry cooler 10 that sub-divide the interior space 25 of the dry cooler 10 into longitudinally-adjacent sub-compartments. Therefore, together, the middle enclosing panels 19 and the side enclosing panels 18 which are disposed between the lateral extremities of the dry cooler 10 define the inner walls of the dry cooler 10 which sub-divide the interior space 25 of the dry cooler 10, and together with the other side enclosing panels 18 allow for each fan assembly 16 to have an isolated volume within which to pull air into and evacuate air therefrom. In this embodiment, the middle enclosing panels 19 are generally rectangular.

With reference to FIGS. 1 to 4, the fan assemblies 16 are disposed above and mounted to the casings 20 such that the casings 20 are disposed between the fan assemblies 16 and the upper ends 26 of the heat exchanger panels 14. As each fan assembly 16 is configured identically in this embodiment, only one of the fan assemblies 16 will be described in detail herein. It is understood that the same description applies to the other fan assemblies 16.

Figure 12:
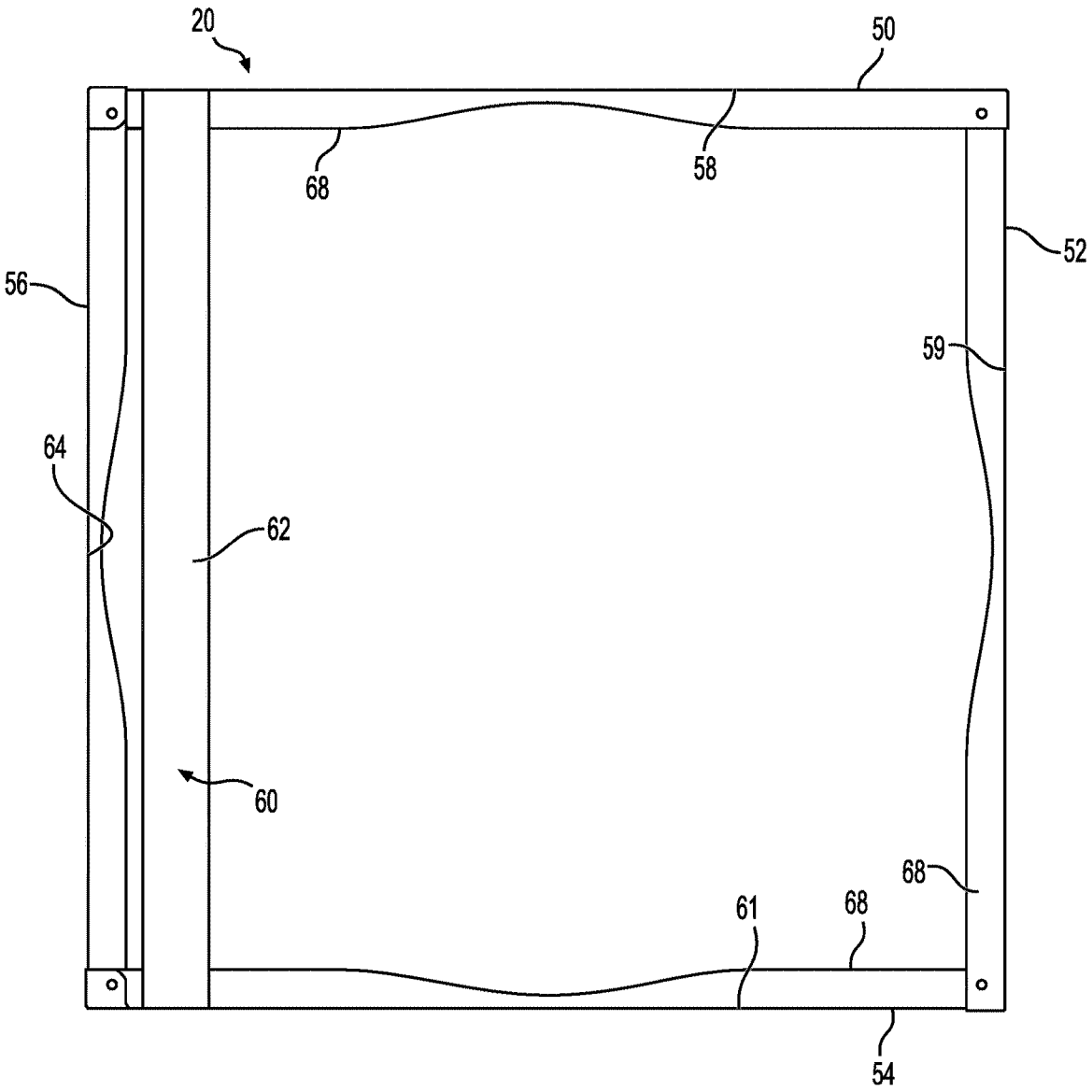
FIG. 12 is a cross-sectional view of the casing of FIG. 8 taken along line 12-12 in FIG. 10.
Figure 13:
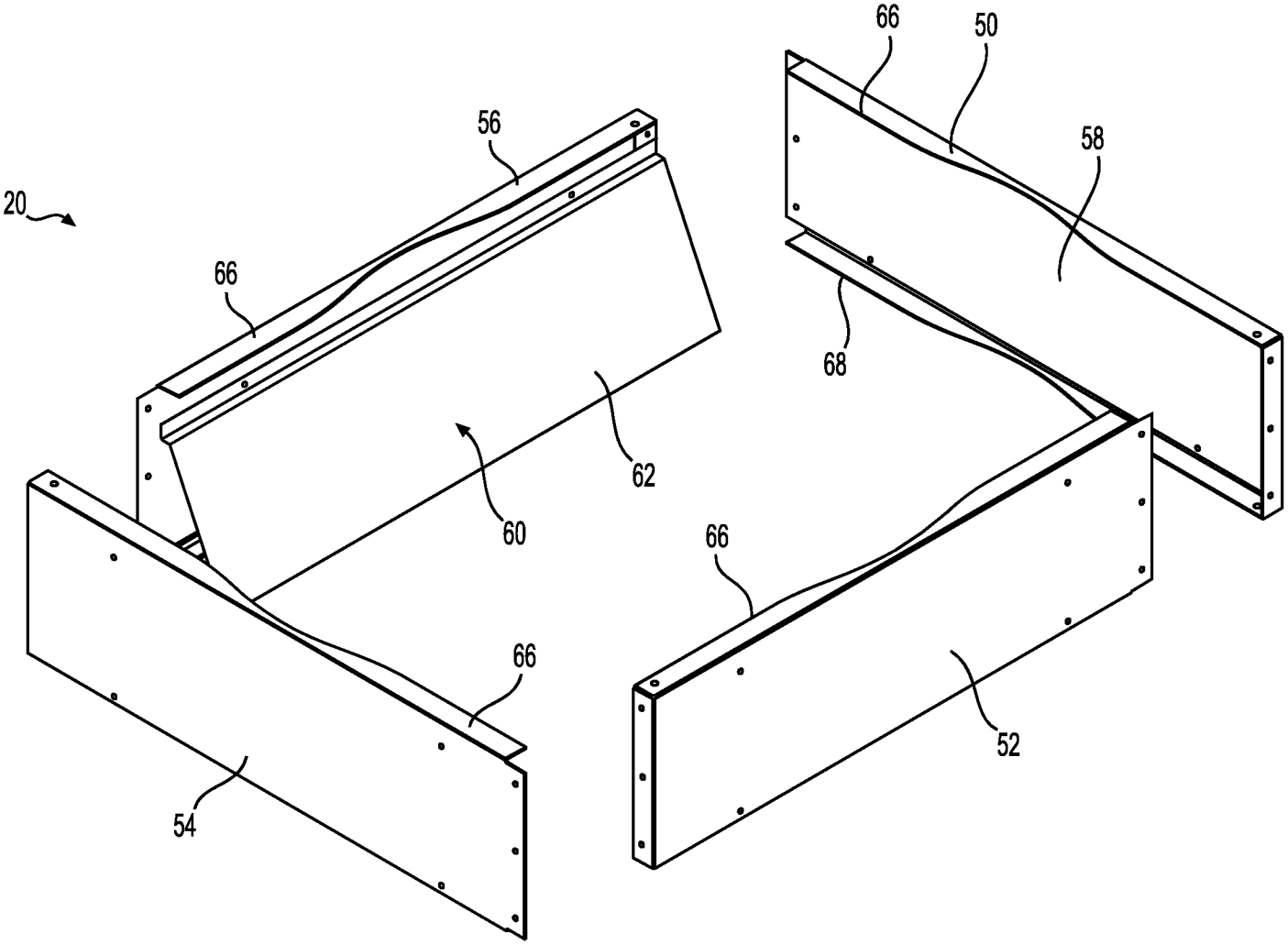
FIG. 13 is an exploded view of the casing of FIG. 8.
Figure 15:
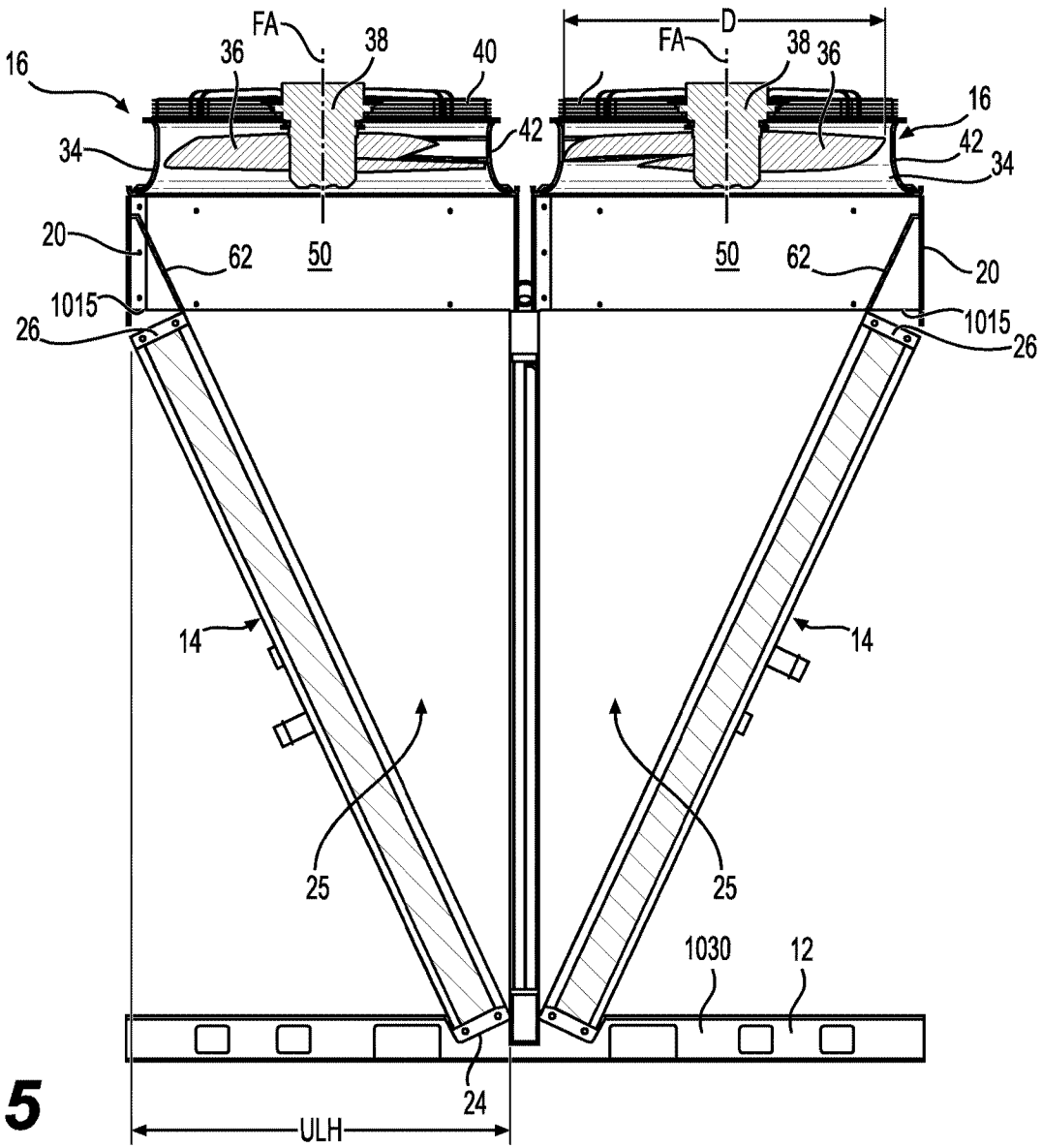
FIG. 15 is a cross-sectional view of the heat exchanger assembly of FIG. 1 taken along line 15-15 in FIG. 3.
Figure 16:
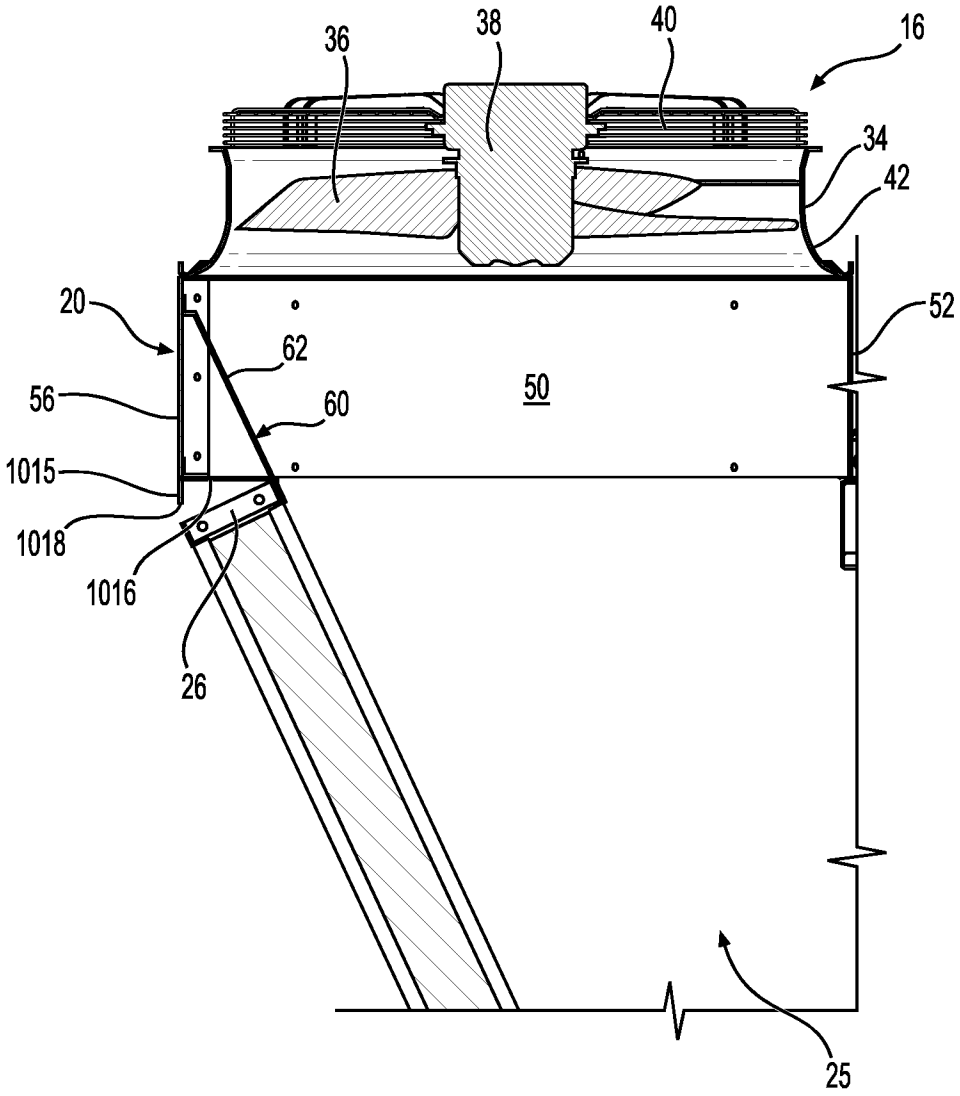
FIG. 16 is a part of the cross-sectional view of FIG. 11 shown in greater detail.

The fan assembly 16 comprises a fan mount 34 and a fan impeller 36 connected thereto (shown in FIGS. 15, 16). The fan mount 34 has an outer flange portion 44 and an annular portion 42 extending upwardly from the outer flange portion 44. The outer flange portion 44 of the fan mount 34 is connected to an upper end 47 of the corresponding casing 20, while the fan impeller 36 connects to the fan mount 34 via a motor 38 (FIG. 12) that is supported by the annular portion 42 of the fan mount 34. More specifically, a grill 40 covers and is affixed to the upper end of the annular portion 42 of the fan mount 34 and supports the motor 38 centrally thereof. The fan impeller 36 is rotatable by the motor 38 about a fan rotation axis FA extending generally vertically (i.e., parallel to the upstanding members 1036 of the frame 12).

The fan impeller 36 is of a significant size to provide the dry cooler 10 with efficient performance. For instance, in this embodiment, the fan impeller 36 has a diameter D of 950 mm. Given its significant size, the fan impeller 36 is sized and positioned such that part of the fan impeller 36 rotates vertically above the upper end 26 of a corresponding one of the heat exchanger panels 14. The fan impeller 36 is surrounded by the annular portion 42 of the fan mount 34. The fan impeller 36 may have an even greater diameter in other embodiments. For instance, in some embodiments, rather than having the middle enclosing panels 19, a larger fan impeller may be provided generally centered between the two heat exchanger panels disposed in the V-configuration.

The fan assemblies 16 are thus arranged to evacuate heated air upwardly from the interior space 25 of the dry cooler 10. Notably, in use, rotation of the fan impeller 36 of each fan assembly 16 causes ambient air to be pulled into dry cooler 10 through the corresponding heat exchanger panel 14. As air is pulled in, heat is transferred from fluid circulating in the tubing arrangement 28 of the heat exchanger panel 14 to the air, such that the air becomes heated. The heated air is then rejected upwardly from the interior space 25 of the dry cooler 10 through the fan assembly 16.

It is contemplated that, in other embodiments, rather than having two, or four fan assemblies 16 (i.e., a plurality of fan assemblies on each side of a vertical plane extending through the upstanding members 1036 of the frame 12), the dry cooler 10 may have a plurality of fan assemblies arranged laterally-adjacent to one another to form a single row of laterally-adjacent fan assemblies.

Figure 14:
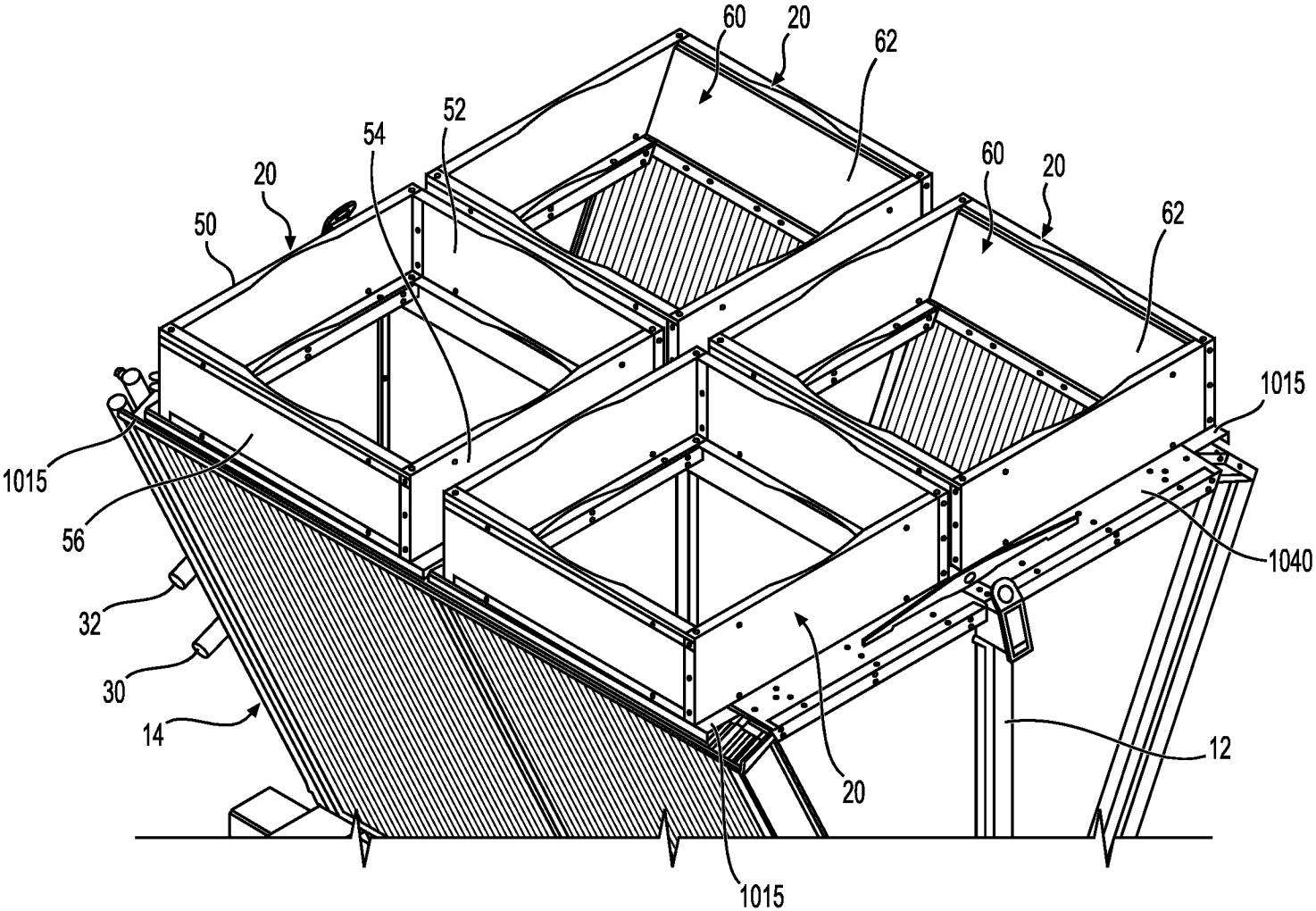
FIG. 14 is a perspective view of the heat exchanger assembly of FIG. 1 with fan assemblies thereof removed.

With reference to FIG. 14, the casings 20 are mounted to the upper frame assembly 1045. Specifically, each casing 20 is disposed between the upper frame assembly 1045 and a corresponding one of the fan assemblies 16. As such, each casing 20 is positioned between the corresponding fan assembly 16 and the upper end 26 of the corresponding heat exchanger panel 14, thus distancing the fan impeller from the outer fan supporting member 1015 disposed above the upper end 26 of the heat exchanger panel 14. This increased spacing between the fan impeller 36 and the outer fan supporting members 1015 results in a reduction in the turbulence and velocity of air at the area between the fan impeller and the outer fan supporting member 1015 compared to the conventional dry cooler 2010 of FIGS. 17 and 18, which in turn significantly reduces the blade-passing effect and the sound generated thereby. Furthermore, the distance created between the fan assembly 16 and the upper end 26 of the heat exchanger panel 14 allows for the installation of further means of noise reduction below the fan assembly 16 such as grids and the like, which can further reduce the blade-passing effect and sound generated by the dry cooler 10.

In this embodiment, each casing 20 is configured identically and therefore only one of the casings 20 will be described in detail herein. It is understood that the same description applies to the other casings 20.

With reference to FIGS. 8 to 13, the casing 20 includes four upright wall members 50, 52, 54, 56 which define the outer walls and thus the outer shape of the casing 20. In particular, in this embodiment, the upright wall members 50, 52, 54, 56 are affixed (e.g., welded) to one another to form the generally box-like shape of the casing 20. In particular, the two upright wall members 50, 54 extend generally parallel to one another while the two upright wall members 54, 56 extend generally parallel to one another (and perpendicularly to the upright wall members 50, 54). Each of the upright wall members 50, 52, 54, 56 has an upper lip portion 66 and a lower lip portion 68, and a central portion extending therebetween. The upper and lower lip portions 66, 68 of each of the upright wall member members 50, 52, 54, 56 extend perpendicularly to the central portion. The upper lip portions 66 of the upright wall members 50, 52, 54, 56 define an upper end 47 of the casing 20. Similarly, the lower lip portions 68 of the upright wall members 50, 52, 54, 56 define a lower end 49 of the casing 20. The upper end 47 thus accommodates the fan mount 34 of the fan assembly 16 so as to secure the fan mount 34 (e.g., via fasteners) to the upper end 47, while the lower end 49 is disposed atop the upper frame assembly 1045 (atop the corresponding outer fan supporting member 1015 and two of the upper retaining members 1040) and secured thereto.

Figure 11:
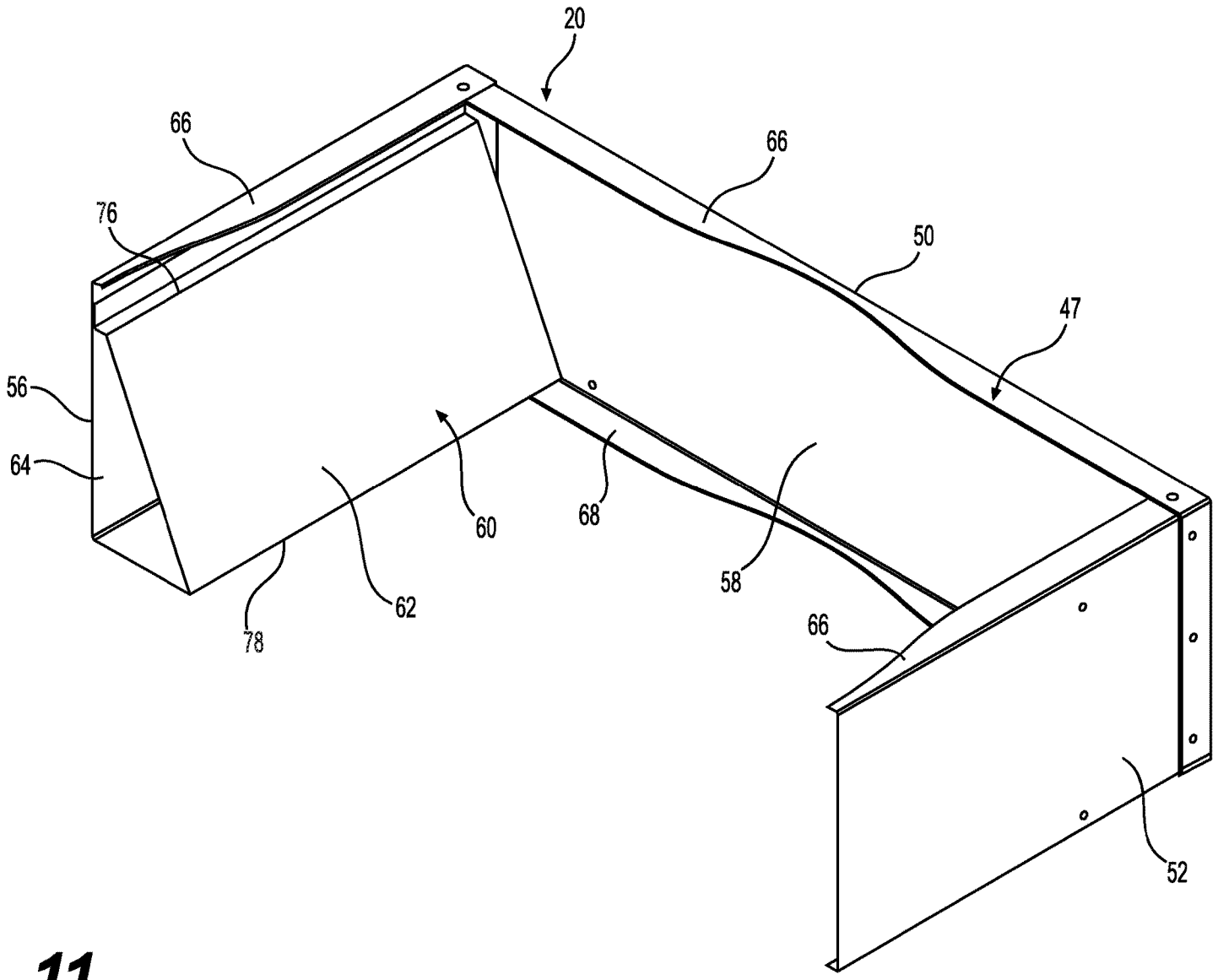
FIG. 11 is a perspective view of a cross-section of the casing of FIG. 8 taken along line 11-11 in FIG. 8.

As will be understood, the casing 20 is open from its upper end 47 and its lower end 49 so as to allow air to flow from the corresponding heat exchanger panel 14 towards the corresponding fan assembly 16. Notably, the casing 20 has a plurality of inner walls for guiding air from the heat exchanger panel 14 toward the fan assembly 16. In particular, the inner walls of the casing 20 include upright inner walls 58, 59, 61 defined by the upright wall components 50, 52, 54 respectively. The upright inner walls 58, 61 are parallel to one another while the upright inner wall 59 extends transversally to the upright inner walls 58, 61. Another inner wall 62 of the casing 20 is defined by a spoiler 60 of the casing 20 which is affixed (e.g., welded) to the upright wall member 56 and thus substantially covers an inner wall 64 of the upright wall member 56 (FIG. 11). The upright inner wall 59 faces the inner wall 62. Thus, as will be understood, the inner walls 58, 59, 61 and the spoiler 60 of the casing 20 are arranged so as to define in part the interior space 25 of the dry cooler 10.

The spoiler 60 is provided to modify the dynamics of air flow between the heat exchanger panel 14 and the fan assembly 16. As shown in FIG. 11, the spoiler 60 has a lower portion 70 and a sloped portion 72 extending at angle to the lower portion 70. Notably, the lower portion 70 extends generally horizontally while the sloped portion 72 extends at an acute angle relative to the lower portion 70. The sloped portion 72 defines the inner wall 62 of the casing 20 and therefore the inner wall 62 may be referred to as a sloped wall 62. The sloped wall 62 is oriented to extend outwardly away from the fan rotation axis FA of the corresponding fan assembly 16. As such, in a given vertical plane containing the fan rotation axis and extending through the sloped wall 62, a distance between an upper end 76 of the sloped wall 62 and the fan rotation axis FA of the corresponding fan assembly 16 is greater than a distance between a lower end 78 of the sloped wall 62 and the fan rotation axis FA. As shown in FIG. 16, the sloped wall 62 is disposed adjacent to the upper end 26 of the corresponding heat exchanger panel 14 and extends generally parallel to the inclined orientation of the heat exchanger panel 14 such that part of the fan impeller 36 rotates vertically above the sloped wall 62. As such, an angle θ is formed between the sloped wall 62 of the casing 20 and a vertical plane VP extending laterally (parallel to the inner walls 59, 64). In this embodiment, as shown in FIG. 11, the angle θ between the sloped wall 62 of the casing 20 and the vertical plane VP is about 25°. The angle θ can be smaller or greater than 25° in other embodiments. For instance, in some embodiments, the angle θ may be between about 20° and about 40° inclusively, between about 20° and about 35° inclusively, or between about 20° and about 30° inclusively.

The angular orientation of the sloped wall 62 of the casing 20 has been found to further decrease the turbulent flow of air generated by the blade-passing effect. Therefore, the angular orientation of the sloped wall 62 results in an even greater reduction in sound emission by the dry cooler 10 than if the fan impeller 36 were only distanced further from the outer fan supporting member 1015. Furthermore, this decrease in turbulent flow further optimizes air flow at the entrance of the fan assembly 16 (as air enters the fan assembly 16 from the heat exchanger panel 14) and increases the overall performance of the dry cooler 10. By the same token, the life span of the fan impeller 36 is extended due to the reduced turbulent air flow compared to conventional dry coolers such as the conventional dry cooler 2010 of FIGS. 17 and 18, notably due to an accompanying reduction in vibrations.

While the casing 20 reduces turbulent air flow within the interior space 25, it also increases a height of the dry cooler 10. To that end, the casing 20 is configured to elevate the corresponding fan assembly 16 sufficiently to distance the fan impeller 36 from the upper end 26 of the corresponding heat exchanger panel 14 while simultaneously avoiding having an excessively tall dry cooler 10 which would be more difficult to accommodate during transportation thereof. As such, a height HC (FIG. 10) of the casing 20, measured from the upper end 47 to the lower end 49, is significant enough for the sloped wall 62 to extend over a sufficiently long distance and thus positively affecting air flow, but not so significant as to render difficult the transport and/or the storage of the dry cooler 10. For instance, in this embodiment, a ratio of the height HC of the casing 20 over a diameter D of the fan impeller 36 (FIG. 15) is between 0.20 and 0.40. In particular, in this embodiment, the ratio of the height HC of the casing 20 over a diameter D of the fan impeller 36 is approximately 0.30 Furthermore, in this embodiment, a ratio of the height HC of the casing 20 over a vertical distance ULV (FIG. 4) between the upper and lower ends 24, 26 of the heat exchanger panel 14 is between 0.10 and 0.20. In particular, in this embodiment, the ratio of the height HC of the casing 20 over the vertical distance ULV is approximately 0.15.

For instance, in this embodiment, the height H of the casing is about 320 mm. However, it is contemplated that the height H of the casing may be between about 200 mm and 400 mm inclusively or between about 200 mm and 350 mm inclusively.

As will be understood, the provision of the casing 20 allows the installation of a bigger fan impeller 36 on the dry cooler 10 which would otherwise cause excessive turbulent air flow within the dry cooler 10 if it were not for the presence of the casing 20. As mentioned above, a bigger fan impeller 36 (i.e., having a greater diameter) improves the efficiency of the dry cooler 10 and therefore is a desirable improvement. However, the desirability of having a bigger fan impeller 36 also runs contrary to the desire of limiting the width of a dry cooler 10 to facilitate its transport (e.g., to more easily fit in a shipping container). For instance, the dry cooler 10 has a maximal width of about 2200 mm to fit in a shipping container. The casing 20 thus provides the dry cooler 10 with the possibility of having the fan impeller 36 of a significant size while also having the width of the dry cooler 10 be relatively small. For instance, in this embodiment, a ratio of the diameter D of the fan impeller 36 over a horizontal distance ULH (FIG. 15) between the upper and lower ends 24, 26 of the corresponding heat exchanger panel 14 is between 0.80 and 1.20. In particular, in this embodiment, the ratio of the diameter D of the fan impeller 36 over the horizontal distance ULH is approximately 0.90.

In this embodiment, the casing 20 is made of sheet metal. In some embodiments, the sheet metal may be made of any other suitable, including for example one or more of steel, stainless steel, galvanized steel, aluminum, brass, zinc and the like.

As will be described below, in some embodiments, the dry cooler 10 may be provided with sound dampening devices which are disposed in the interior space 25 of the dry cooler 10 (one in each sub-compartment of the interior space 25 as defined by the enclosing panels 18, 19). These sound dampening devices can further dampen the sound generated by the dry cooler 10. Moreover, while a pressure loss can be expected in the air flow within the dry cooler 10 due to the presence of the sound dampening devices therein, this pressure loss has been found to be minimal and therefore does not affect the performance of the dry cooler 10 in a significant manner.

With reference to FIGS. 19 to 23, another embodiment of the dry cooler 10 will be described herein. In this embodiment, the dry cooler 10 is provided with a plurality of sound dampening devices 250 disposed within the interior space 25 of the dry cooler 10 and positioned such that at least a portion of air pulled into the interior space 25 through the heat exchanger panels 14 flows through a respective one of the sound dampening devices 250 before being discharged from the dry cooler 10 via the respective fan assembly 16.

Figure 20:
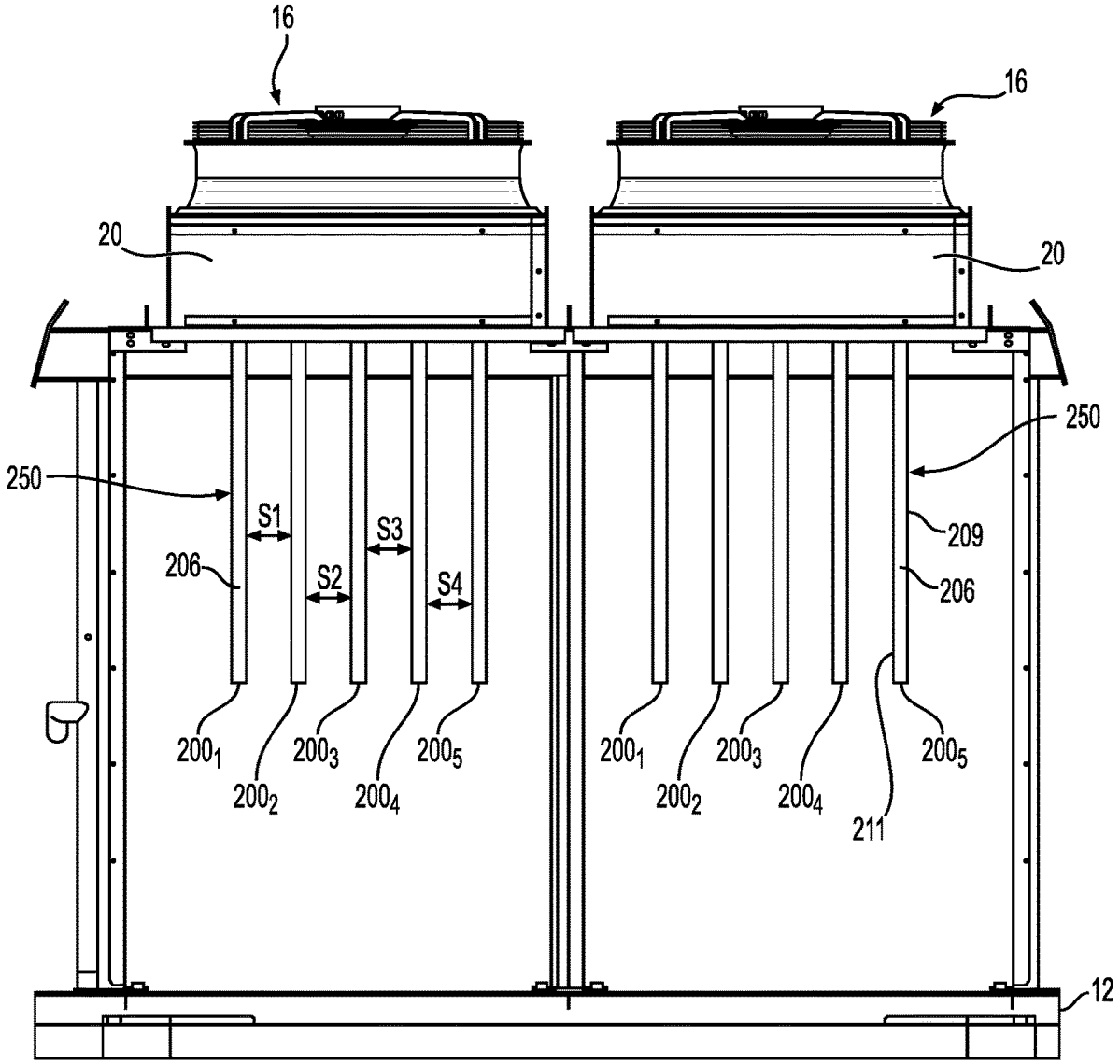
FIG. 20 is a front elevation view of the part of the heat exchanger assembly of FIG. 19.
Figure 21:
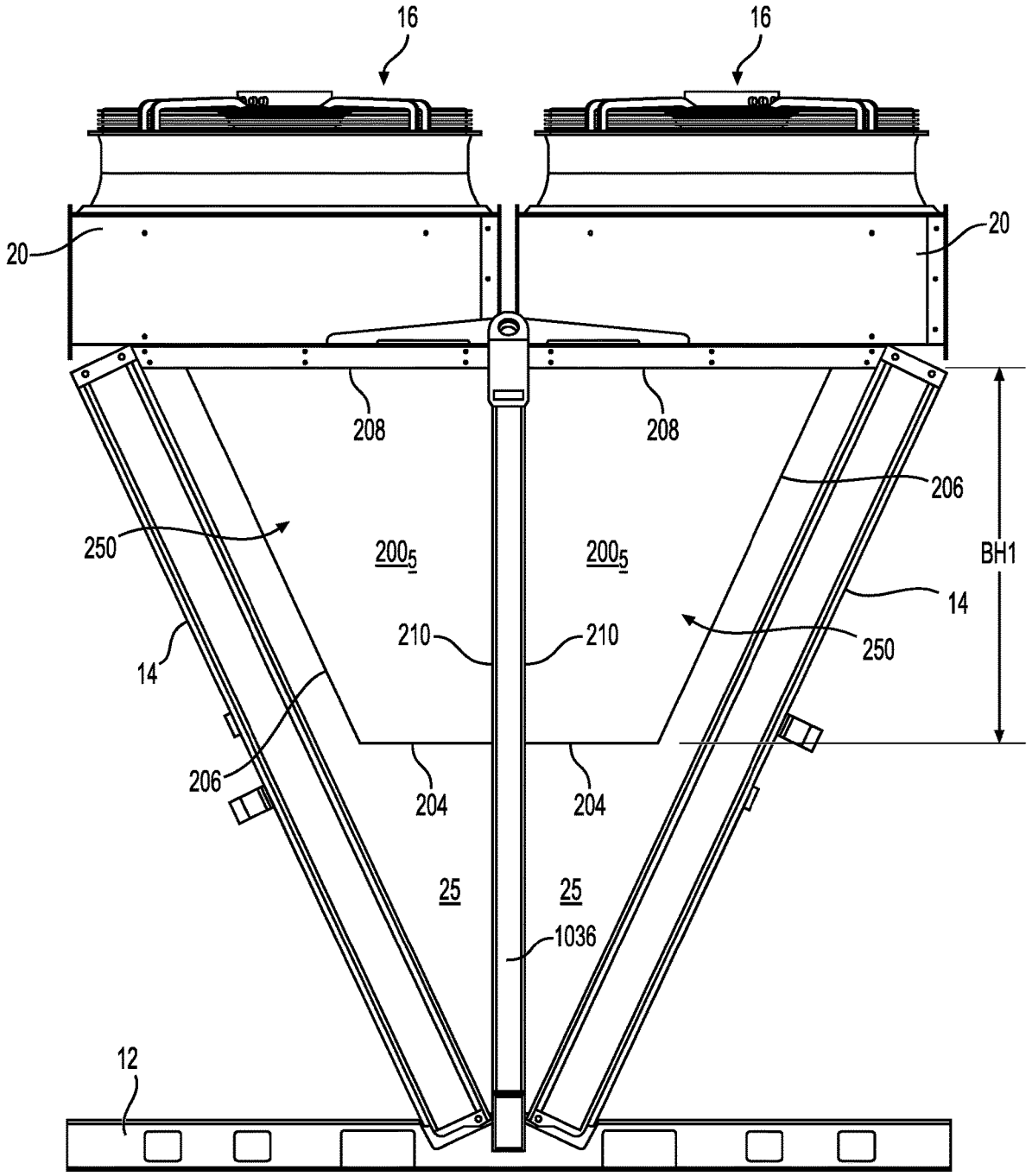
FIG. 21 is a side elevation view of the heat exchanger assembly of FIG. 19, with side enclosing panels thereof removed to expose the sound dampening devices.

Each sound dampening device 250 includes a plurality of baffle members $\mathbf{200}_1$-$\mathbf{200}_5$ which extend perpendicular to a plane extending through the upper and lower ends 26, 24 of the corresponding heat exchanger panel 14 (more clearly seen in FIG. 21). In particular, in this embodiment, the baffle members $\mathbf{200}_1$-$\mathbf{200}_5$ are generally planar and, as shown in FIG. 20, each baffle member $\mathbf{200}_i$ has opposite lateral faces 209, 211 which define a thickness of the baffle member $\mathbf{200}_i$ therebetween. With continued reference to FIG. 20, consecutive ones of the baffle members $\mathbf{200}_1$-$\mathbf{200}_5$ are spaced apart from one another by respective spacings S1, S2, S3, S4. In this embodiment, the spacings S1, S2, S3, S4 are constant such that a distance between consecutive ones of the baffle members $\mathbf{200}_1$-$\mathbf{200}_5$ are the same. However, in other embodiments, the spacings S1, S2, S3, S4 may not be uniform such that the spacing between the consecutive baffle members $\mathbf{200}_1$-$\mathbf{200}_5$ is variable. In particular, the central spacings S2, S3 may be greater than the outer spacings S1, S4. Notably, this can reduce the pressure drop caused by the presence of the sound dampening devices 250 in the interior space 25 since air flow will tend to be concentrated at central zones corresponding to areas of the corresponding heat exchanger panel 14 lying at centrally between two laterally-consecutive side enclosing panels 18 (i.e., aligned with the spacings S2, S3).

Figure 23:
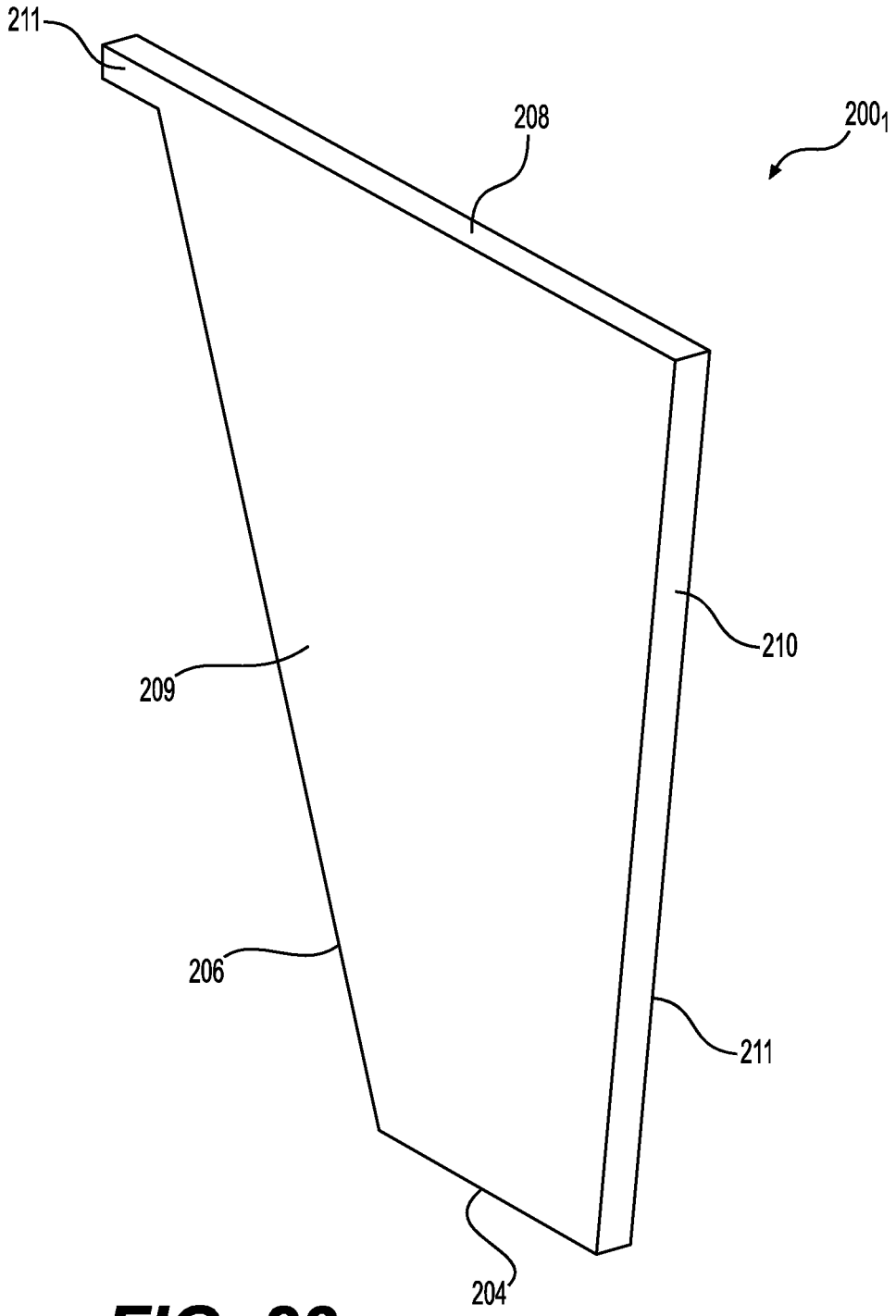
FIG. 23 is a perspective view of a baffle member of one of the sound dampening devices of FIG. 19.
Figure 24:
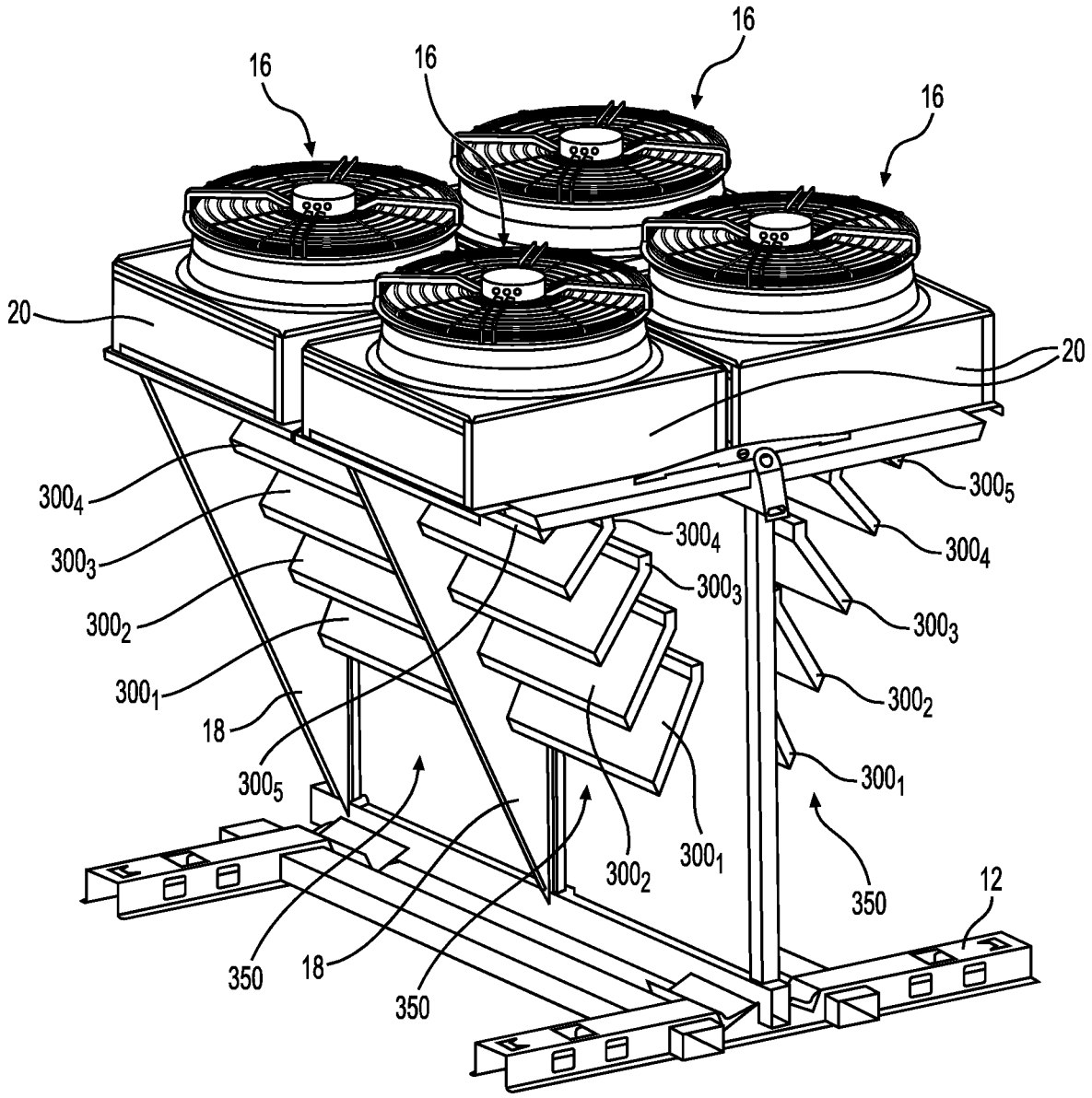
FIG. 24 is a perspective view of part of the heat exchanger assembly provided with sound dampening devices in accordance with another embodiment, the heat exchanger panels and some side enclosing panels being removed to expose the sound dampening devices.
Figure 25:
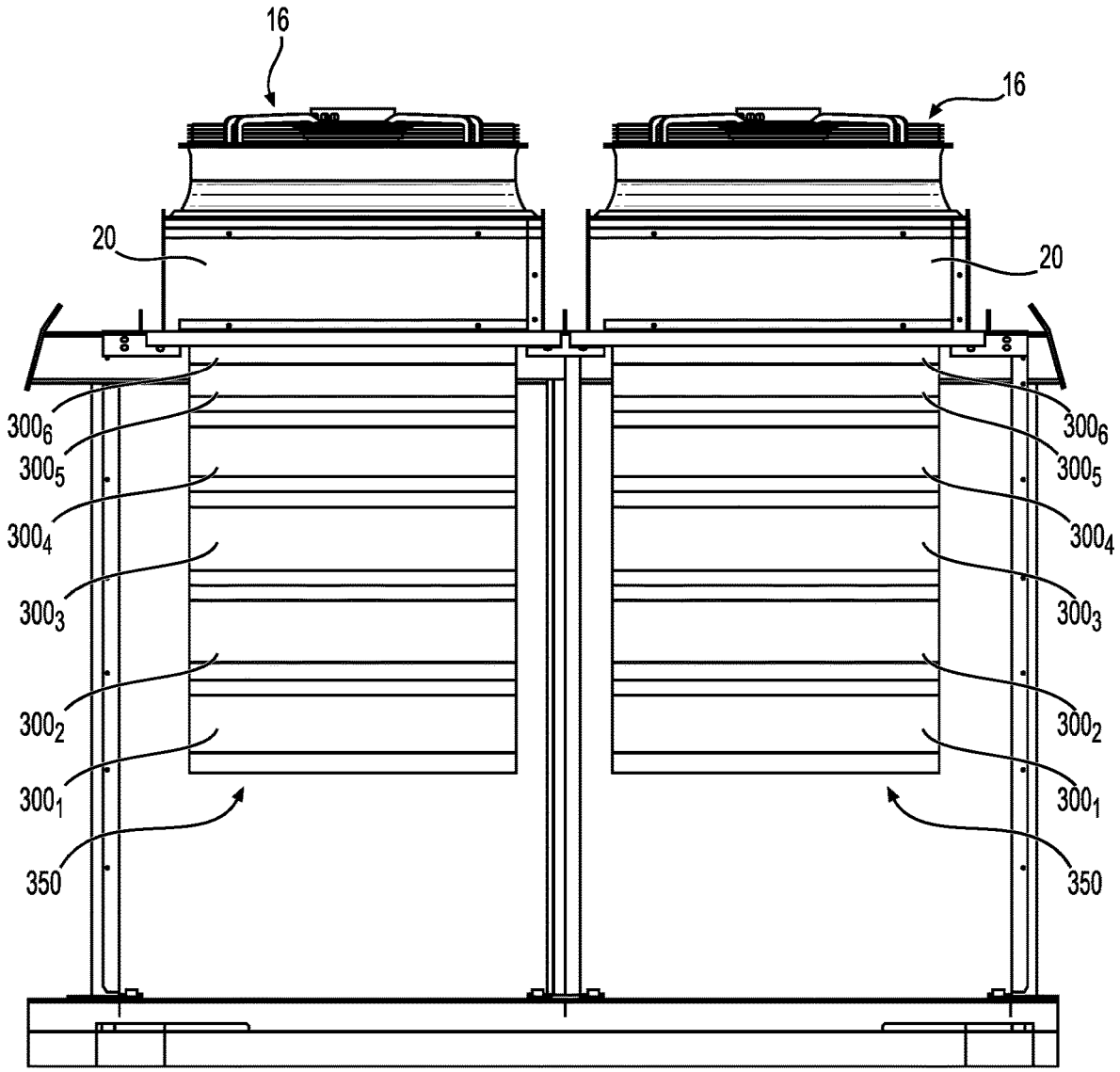
FIG. 25 is a front elevation view of the part of the heat exchanger assembly of FIG. 24.

As shown in FIG. 23, each baffle member $\mathbf{200}_i$ has a generally triangular shape, notably having edges 206, 208, 210 which define its generally triangular shape. In particular, the upper horizontal edge 208 extends perpendicular to the vertical edge 210, while the edge 206 extends diagonally relative to the edges 208, 210. More particularly, the baffle member $200_i$ is shaped like a truncated triangle as the baffle member $200_i$ also has a lower horizontal edge 204 from extending between the lower ends of the edges 206, 210. When the sound dampening device 250 is in position in the interior space 25 of the dry cooler 10, the diagonal edge 206 extends adjacent to the heat exchanger panel 14. The baffle member $200_i$ also has an extension 211 which is defined in part by the upper edge 208. The extension 211 extends outwardly from the diagonal edge 206 in a direction away from the vertical edge 210. The extension 211 is used to hang the baffle member $202_i$ from a frame of the sound dampening device 250.

As shown in FIG. 21, a height BH1 of the baffle member $200_i$ is defined between the lower and upper edges 204, 208. The height BH1 of the baffle member $200_i$ is relatively significant so as to optimize a distance along which the sound dampening device 250 absorbs sound. For instance, in this embodiment, a ratio of the height BH1 of the baffle member $200_i$ over the vertical distance ULV between the lower and upper ends 24, 26 of the corresponding heat exchanger panel 14 is approximately 0.5. This ratio may be even greater in other embodiments. For example, the ratio of the height BH1 of the baffle member $200_i$ over the vertical distance ULV may be between 0.3 and 0.8.

Figure 46:
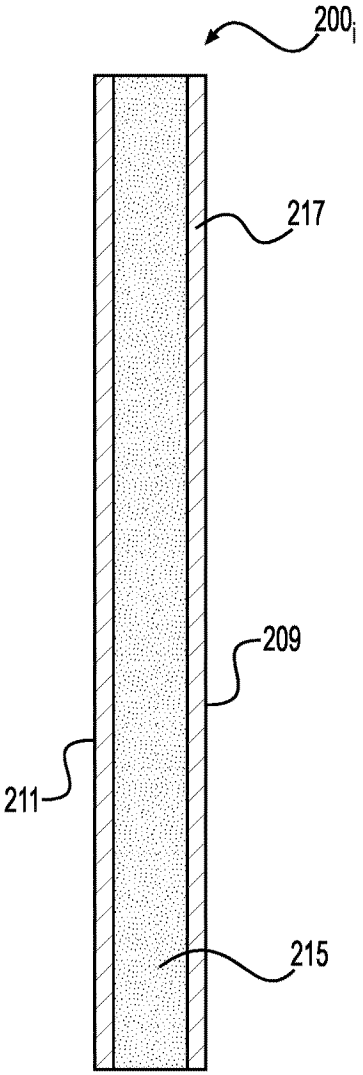
FIG. 46 is a cross-sectional view of part of a baffle member of the sound dampening device of FIG. 24.

With reference to FIG. 46 which shows a cross-section of part of one of the baffle members $200_1$-$200_5$, in this embodiment, each baffle member $200_1$ comprises a sound absorbing material 215 and a protective layer 217 covering the sound absorbing material 215. In some embodiments, the protective layer 217 may cover only part of the sound absorbing material 215. In this embodiment, the protective layer 217 surrounds the sound absorbing material 215 from both faces 209, 211. Moreover, in this embodiment, the sound absorbing material 215 comprise a foam material such as polyurethane foam. However, it is contemplated that any other suitable sound absorbing material may be used, such as for example, fiberglass, mineral wool, or cotton. The protective layer 217 is configured to protect the sound absorbing material, such as from exposure to high heat as well as from tears. In this embodiment, the protective layer 217 is made of metallic material such as aluminum. Other suitable types of materials are also contemplated for the protective layer 217.

The sound dampening device 250 is held in place by a frame (not shown) which is connected to each of the baffle members $200_1$-$200_5$ so as to suspend the baffle members therefrom. Notably, the frame of the sound dampening device 250 is connected to the frame 12 of the heat exchanger assembly 10, and more specifically between the frame 12 and a corresponding one of the casings 20. As such, the baffle members $200_1$-$200_5$ are spaced from the heat exchanger panel 14.

Figure 22:
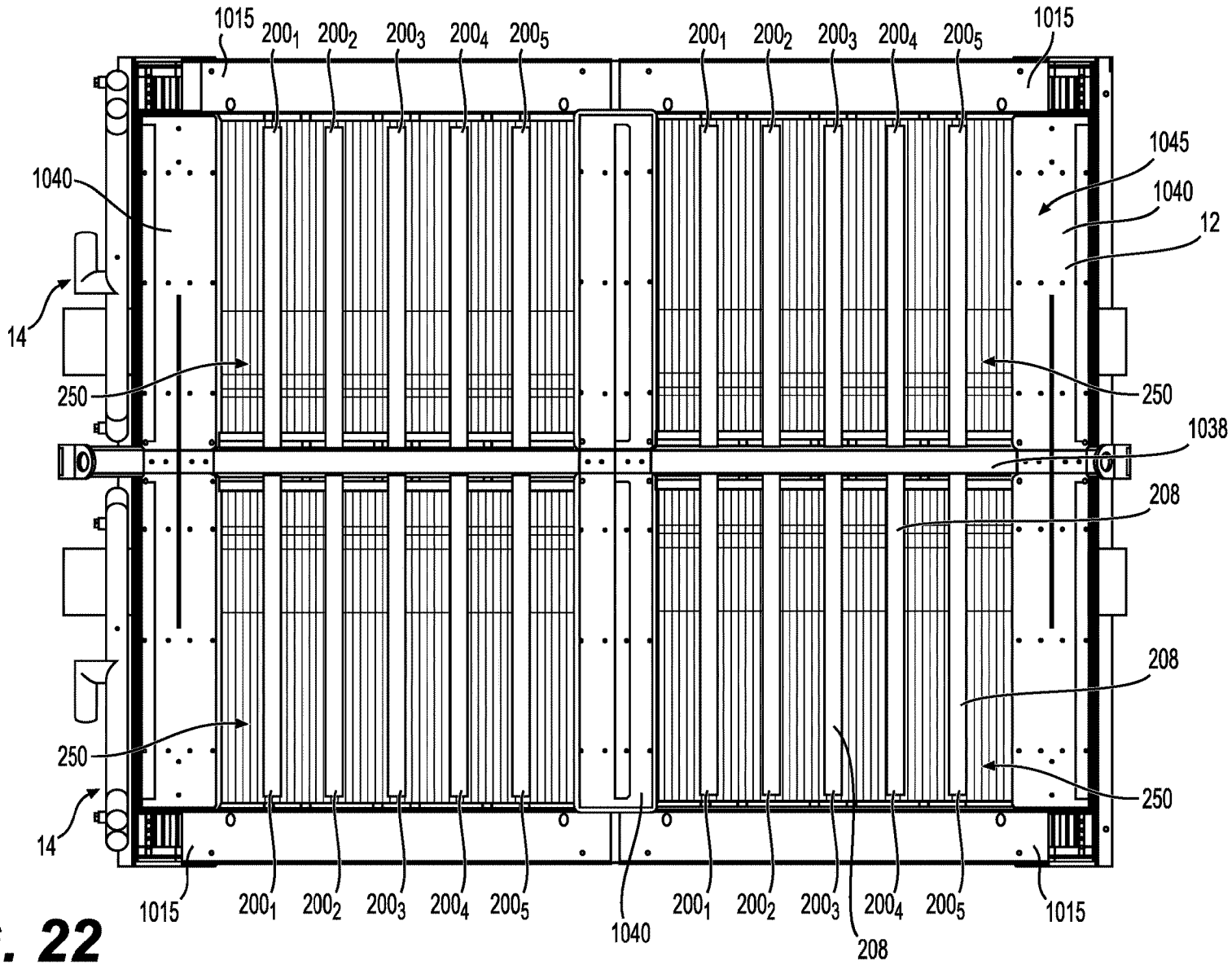
FIG. 22 is a top plan view of the heat exchanger assembly of FIG. 19, with fan assemblies thereof removed to expose the sound dampening devices.

In this embodiment, as shown in FIGS. 20 and 22, each sound dampening device 250 is generally centered between the two side enclosing panels 18 defining the corresponding sub-compartment of the interior space 25 in which the sound dampening device 250 is positioned.

The sound dampening device 250 thus absorbs sound from the air flow prior to its entry into the corresponding fan assembly 16. Since it has been found that the main source of sound generated by the dry cooler 10 is located at the lower end of the fan assembly 16, as air gets aspirated into the fan assembly 16, the sound dampening device 250 thus significantly dampens the sound generated by the dry cooler 10. Notably, the flow of air through the heat exchanger panel 14 is not a significant source of sound and therefore by dampening the sound generated by the dry cooler 10 at the fan assembly 16, the sound generated by the dry cooler 10 is significantly dampened.

Another embodiment of the sound dampening device will now be described with particular reference to FIGS. 24 to 28. In this embodiment, the dry cooler 10 is provided with a plurality of sound dampening devices 350 disposed within the interior space 25 of the dry cooler 10 and positioned such that at least a portion of air pulled into the interior space 25 through the heat exchanger panels 14 flows through a respective one of the sound dampening devices 350 before being discharged from the dry cooler 10 via the respective fan assembly 16.

Each sound dampening device 350 includes a plurality of baffle members $300_1$-$300_5$ spaced apart from one another for allowing air flow therebetween. As will be described in greater detail below, each of the baffle members $300_1$-$300_5$ is shaped and positioned so as to direct air flow upwardly toward the fan assembly 16. This may help reduce formation of vortices in the air flow and thus optimizes performance of the dry cooler 10 provided with the sound dampening devices 250. In particular, the baffle members $300_1$-$300_5$ extend generally at an angle relative to a plane extending through the lower and upper ends 24, 26 of the heat exchanger panel 14 so as to direct air flow upwardly toward the fan assembly 16. As such, as shown in FIG. 27, an upper end 308 of each baffle member $300_i$ is located vertically higher than a lower end 306 thereof.

Figure 28:
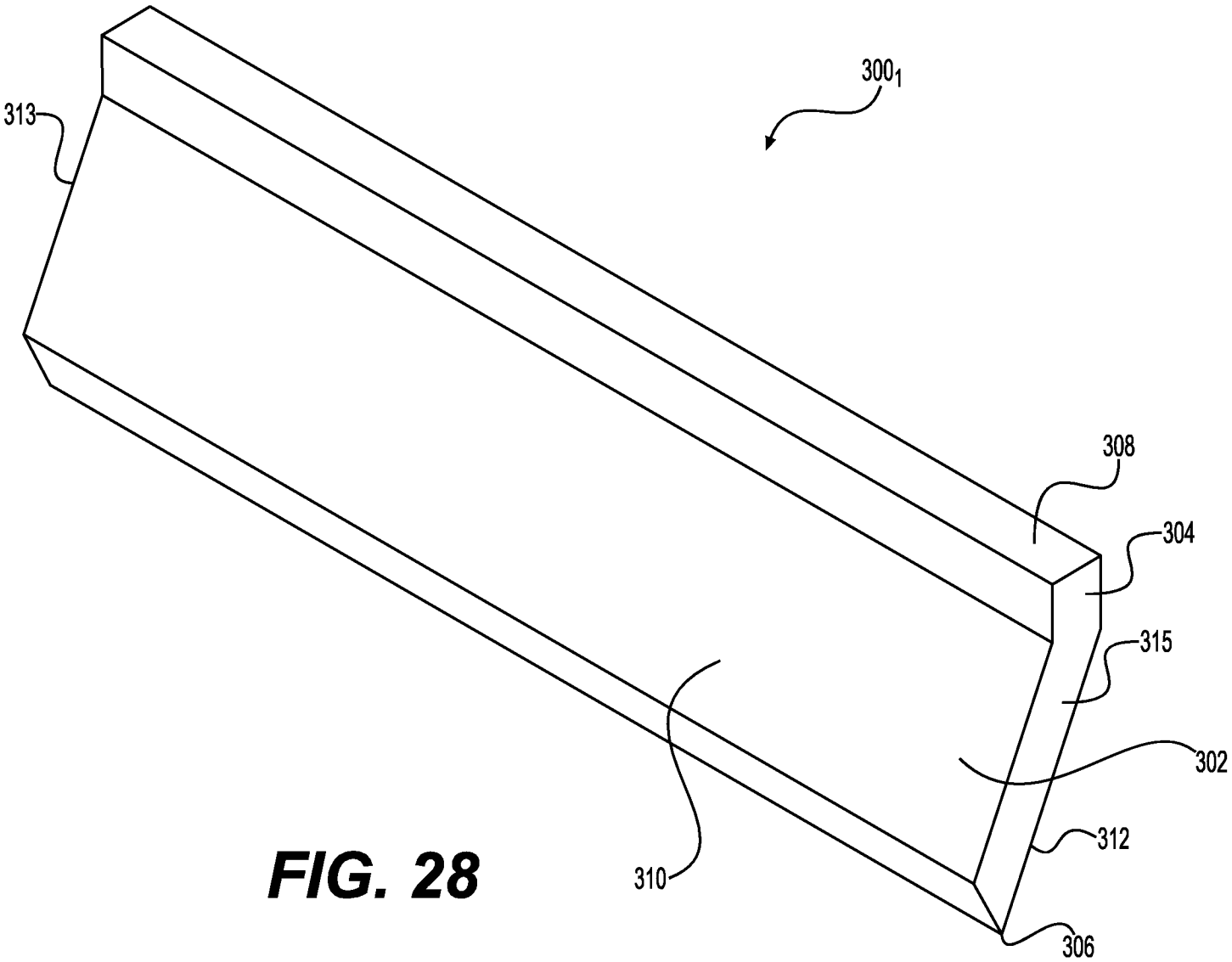
FIG. 28 is a perspective view of a baffle member of the sound dampening device of FIG. 27.
Figure 29:
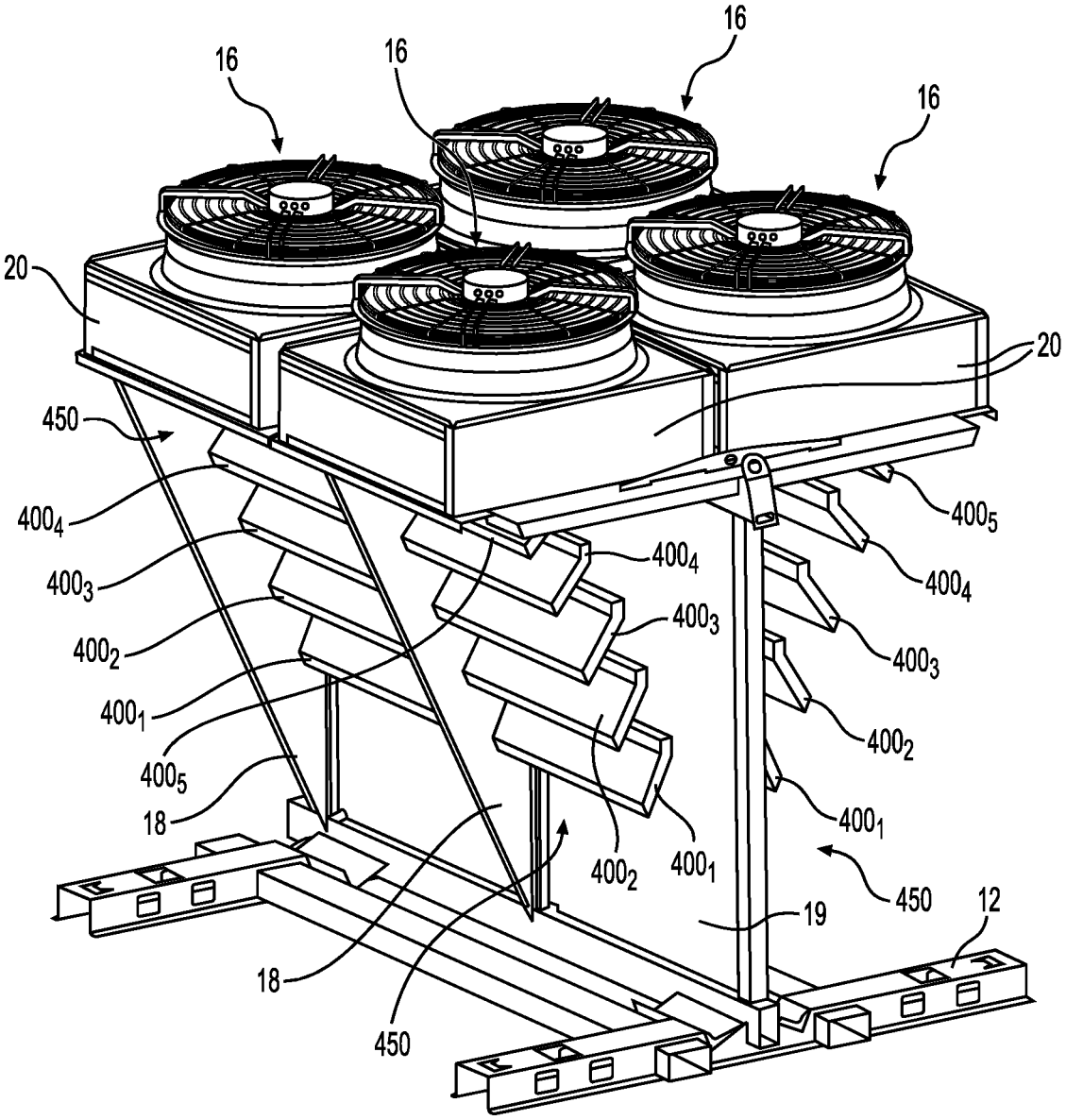
FIG. 29 is a perspective view of part of the heat exchanger assembly provided with sound dampening devices in accordance with another embodiment, the heat exchanger panels and some side enclosing panels being removed to expose the sound dampening devices.
Figure 30:
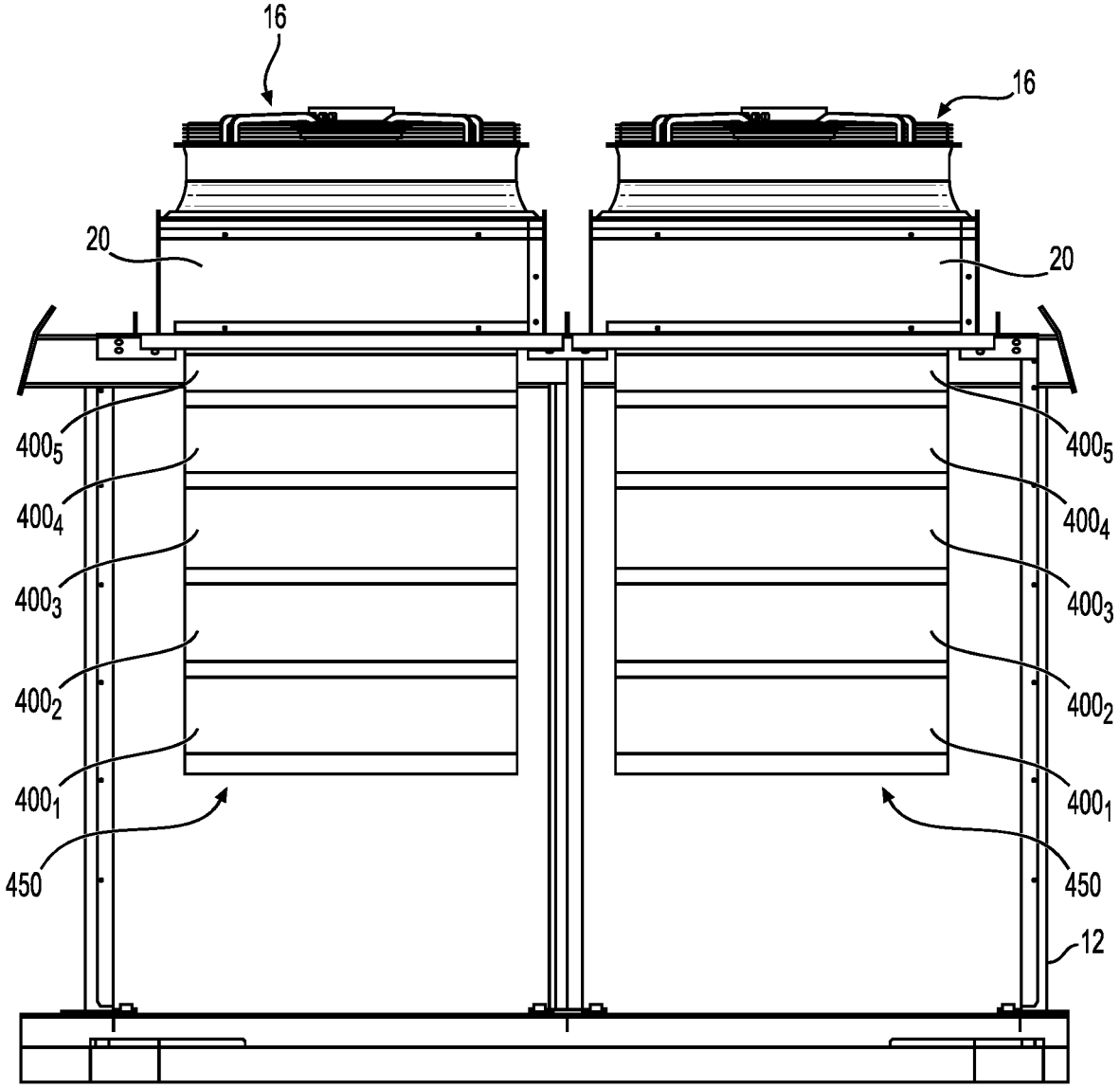
FIG. 30 is a front elevation view of the part of the heat exchanger assembly of FIG. 29.

As shown in FIG. 28, each baffle member $300_i$ extends from a first lateral end 313 to a second lateral end 315, defining a width of the baffle member $300_i$ therebetween. The baffle member $300_i$ has a first portion 302 and a second portion 304 extending from the first portion 302, and more particularly extending upwardly at an angle relative to the first portion 304. As such, the second portion 304 defines the upper end 308 of the baffle member $300_i$ while the first portion 302 defines the lower end 306 of the baffle member $300_i$. In this embodiment, the second portion 304 extends generally vertically. Both portions 302, 304 extend across an entirety of the width of the baffle member $300_i$, however it is contemplated that one of the portions 302, 304 could extend along a limited part of the width of the baffle member $300_i$ (i.e., one of the portions 302, 304 could have a shorter span in the width direction than the other).

Figure 26:
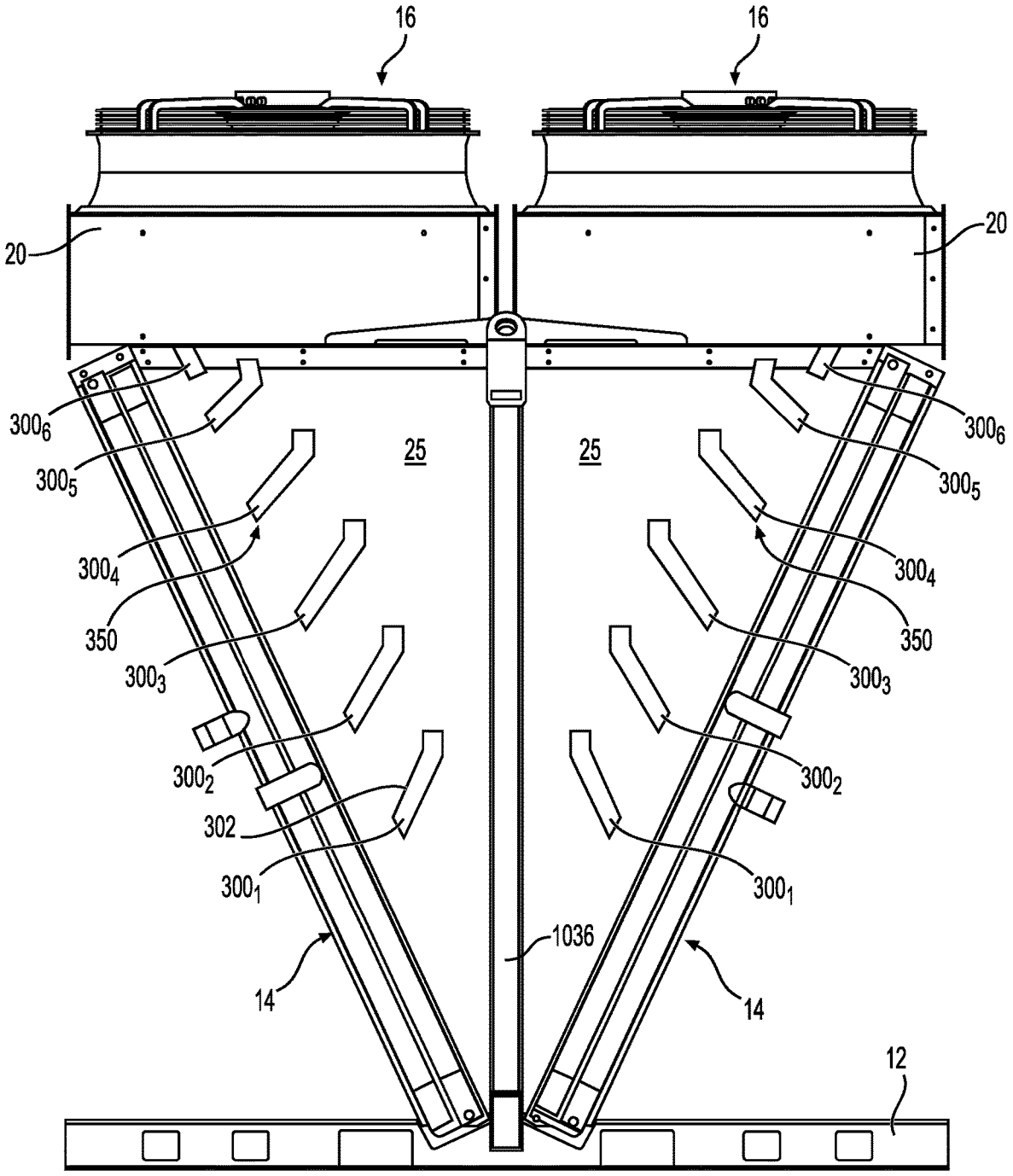
FIG. 26 is a side elevation view of the heat exchanger assembly of FIG. 24, with side enclosing panels thereof removed to expose the sound dampening devices.

As can be seen in FIG. 26, when the sound dampening device 350 is in position in the interior space 25 of the dry cooler 10, the first portion 302 is positioned closer to the heat exchanger panel 14 than the second portion 304. As such, air pulled into the dry cooler 10 and flowing through the sound dampening device 350 traverses along the first portion 302 of each baffle member $300_i$ before reaching the second portion 304 thereof. The first portion 302 extends at an angle $\alpha$ (FIG. 27) relative to a horizontal plane so as to direct air flow upwardly. In this embodiment, the angle $\alpha$ may be between 40° and 75° inclusively. The angle $\alpha$ may vary for each baffle member $300_i$. For instance, as shown in FIG. 27, in this embodiment, the angle $\alpha$ is greater for lower ones of the baffle members $300_1$-$300_5$ (e.g., the baffle member $300_1$) and smaller for upper ones of the baffle members $300_1$-$300_5$ (e.g., the baffle member $300_5$). Moreover, as the second portion 304 extends upwardly at an angle relative to the first portion 302, the second portion 304 deflects air flow incoming from a direction of the first portion 304.

Figure 27:
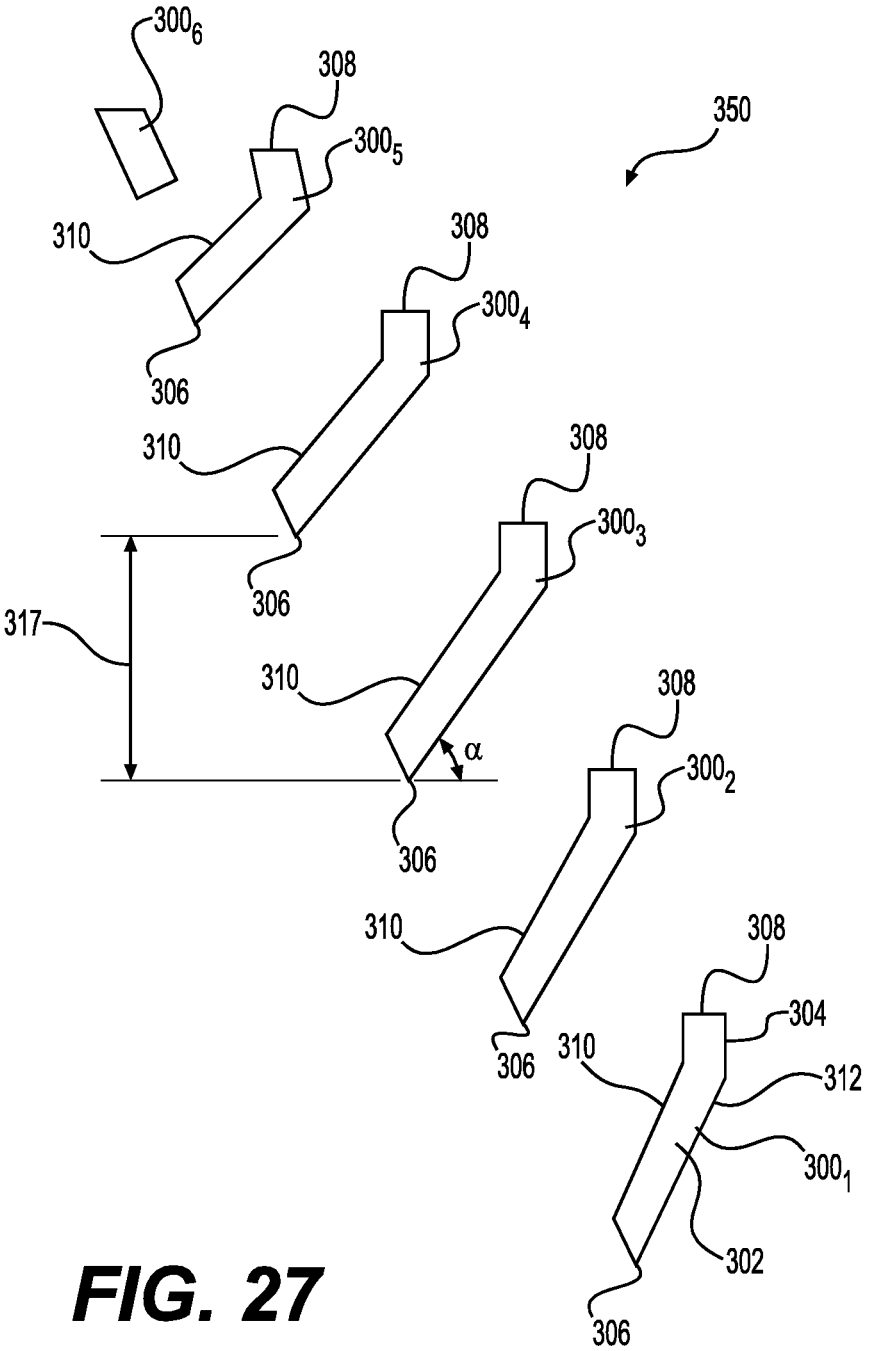
FIG. 27 is a side elevation of one of the sound dampening devices of FIG. 24.

With reference to FIG. 27, in this embodiment, a spacing 317 between consecutive ones of the baffle members $\mathbf{300}_1$-$\mathbf{300}_5$ is variable. Notably, the spacing 317 may be greater between the more centrally positioned baffle members $\mathbf{300}_2$ and $\mathbf{300}_3$, as well as between the baffle members $\mathbf{300}_3$ and $\mathbf{300}_4$. This may help reduce pressure loss caused by the presence of the sound dampening devices 350 within the interior space 25 of the dry cooler 10. For simplicity, the spacing 317 is measured between the lower end 306 of a given one of the baffle members $\mathbf{300}_1$-$\mathbf{300}_5$ and a consecutive one of the baffle members $\mathbf{300}_1$-$\mathbf{300}_5$ below the given one of the baffle members $\mathbf{300}_1$-$\mathbf{300}_5$. It is contemplated that the spacing 317 may be constant between the consecutive baffle members $\mathbf{300}_1$-$\mathbf{300}_5$ in other embodiments.

Furthermore, the baffle members $\mathbf{300}_1$-$\mathbf{300}_5$ are positioned relative to one another such that consecutive ones of the baffle members $\mathbf{300}_1$-$\mathbf{300}_5$ overlap one another vertically. This may ensure that air does not flow past the baffle members $\mathbf{300}_1$-$\mathbf{300}_5$ without being redirected thereby. More specifically, as shown in FIG. 27, the lower end 306 of a given one of the baffle members $\mathbf{300}_1$-$\mathbf{300}_5$ is positioned vertically lower than the upper end 308 of a consecutive baffle member $\mathbf{300}_i$ positioned below the given one of the baffle members $\mathbf{300}_1$-$\mathbf{300}_5$.

In this embodiment, the sound dampening device 350 also includes an upper baffle member $\mathbf{300}_6$ which is disposed vertically higher than all of the baffle members $\mathbf{300}_1$-$\mathbf{300}_5$. The baffle member $\mathbf{300}_6$ restricts air flow above the baffle member $\mathbf{300}_5$. The upper baffle member $\mathbf{300}_6$ is positioned to direct part of the air flow entering through the heat exchanger panel 14 towards the upper end 26 of thereof (i.e., towards the spoiler 60 and its inner wall 62).

The sound dampening device 350 is held in place by a frame similar to the frame described with respect to the sound dampening device 250.

The baffle members $\mathbf{300}_1$-$\mathbf{300}_6$ of the sound dampening device 350 are constructed similarly to the baffle members $\mathbf{200}_1$-$\mathbf{200}_5$ described above. In particular, each baffle member $\mathbf{300}_i$ comprises a sound absorbing material and a protective layer similar to those of the baffle members $\mathbf{200}_1$-$\mathbf{200}_5$. The construction of the baffle members $\mathbf{300}_1$-$\mathbf{300}_6$ will therefore not be described in detail herein.

Another embodiment of the sound dampening device will now be described with particular reference to FIGS. 29 to 33. In this embodiment, the dry cooler 10 is provided with a plurality of sound dampening devices 450 disposed within the interior space 25 of the dry cooler 10 and positioned such that at least a portion of air pulled into the interior space 25 through the heat exchanger panels 14 flows through a respective one of the sound dampening devices 450 before being discharged from the dry cooler 10 via the respective fan assembly 16.

Each sound dampening device 450 includes a plurality of baffle members $\mathbf{400}_1$-$\mathbf{400}_5$ spaced apart from one another for allowing air flow therebetween. Each of the baffle members $\mathbf{400}_1$-$\mathbf{400}_5$ is shaped and positioned so as to direct air flow upwardly toward the fan assembly 16. Notably, the baffle members $\mathbf{400}_1$-$\mathbf{400}_5$ are generally configured in the same manner as the baffle members $\mathbf{300}_1$-$\mathbf{300}_5$ of the sound dampening device 350 described above. As such, the baffle members $\mathbf{400}_1$-$\mathbf{400}_5$ will not be described herein in detail except for the notable differences thereof relative to the baffle members $\mathbf{300}_1$-$\mathbf{300}_5$. The features of the sound dampening device 450 and of the baffle members $\mathbf{400}_1$-$\mathbf{400}_5$ thereof have therefore been denoted with the same reference numbers as those equivalent features of the sound dampening device 350 and of the baffle members $\mathbf{300}_1$-$\mathbf{300}_5$, with the numbers however being in the "400" series instead of the "300" series.

Figure 31:
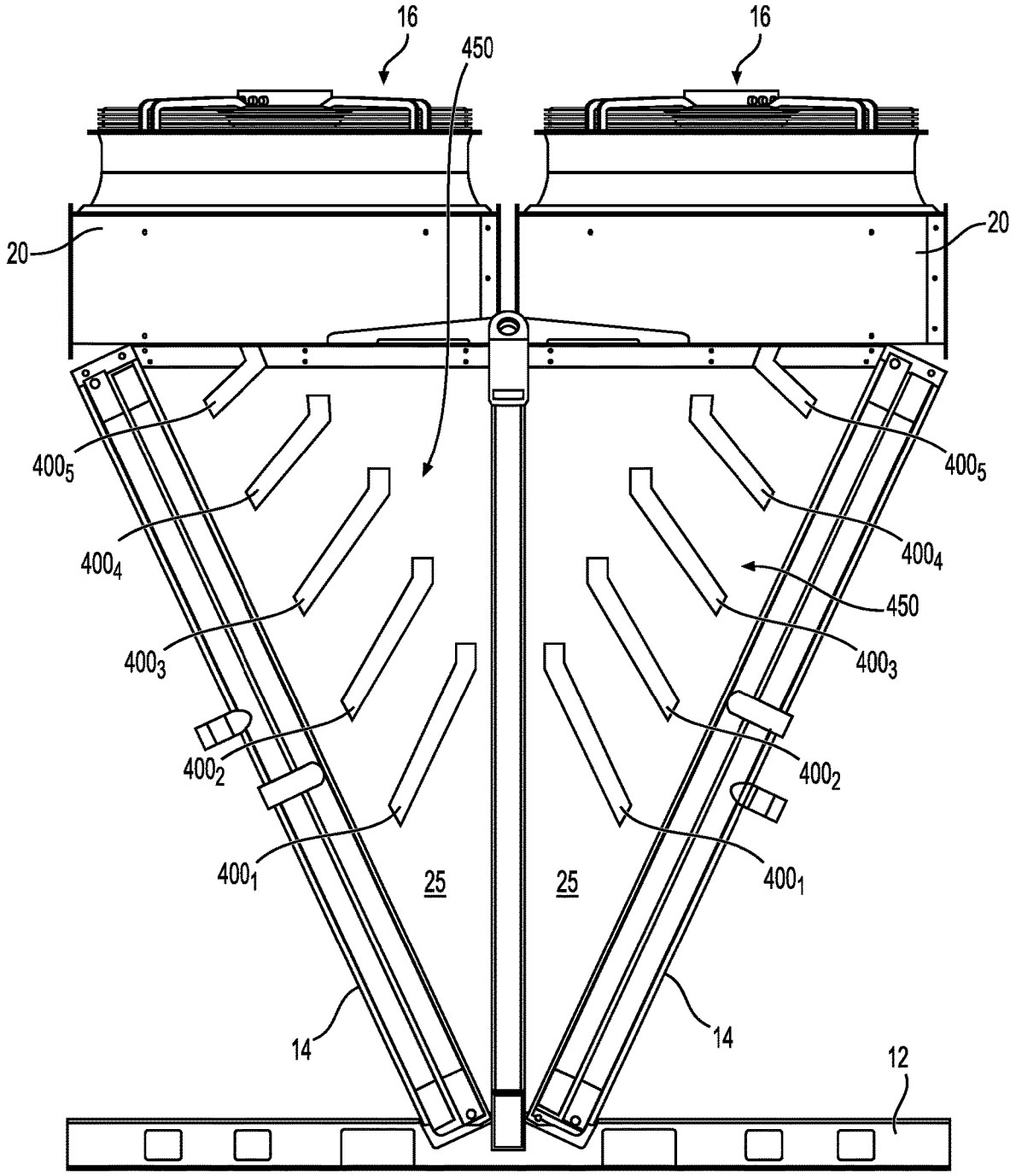
FIG. 31 is a side elevation view of the heat exchanger assembly of FIG. 29, with side enclosing panels thereof removed to expose the sound dampening devices.

As can be seen clearly in FIG. 31, the baffle members $\mathbf{400}_1$-$\mathbf{400}_5$ are longer than the baffle members $\mathbf{300}_1$-$\mathbf{300}_5$. For instance, a straight line distance between the lower end 406 and the upper end 408 of each baffle member $\mathbf{400}_i$ is greater than a straight line distance between the lower end 306 and the upper end 308 of each baffle member $\mathbf{300}_i$. Similarly, a vertical distance between the lower end 406 and the upper end 408 of each baffle member $\mathbf{400}_i$ is greater than a vertical distance between the lower end 306 and the upper end 308 of each baffle member $\mathbf{300}_i$. Moreover, as the baffle members $\mathbf{400}_1$-$\mathbf{400}_8$ are no longer in this embodiment, they may be operable to absorb sound to a greater extent than the corresponding one.

As such, the vertical overlap between consecutive baffle members $\mathbf{400}_1$-$\mathbf{400}_5$ is greater than for the baffle members $\mathbf{300}_1$-$\mathbf{300}_5$. More specifically, as shown in FIG. 31, the lower end 406 of a given one of the baffle members $\mathbf{400}_1$-$\mathbf{400}_5$ is positioned vertically lower than the upper end 408 of a consecutive baffle member $\mathbf{400}_i$ positioned below the given one of the baffle members $\mathbf{400}_1$-$\mathbf{400}_5$.

Figure 32:
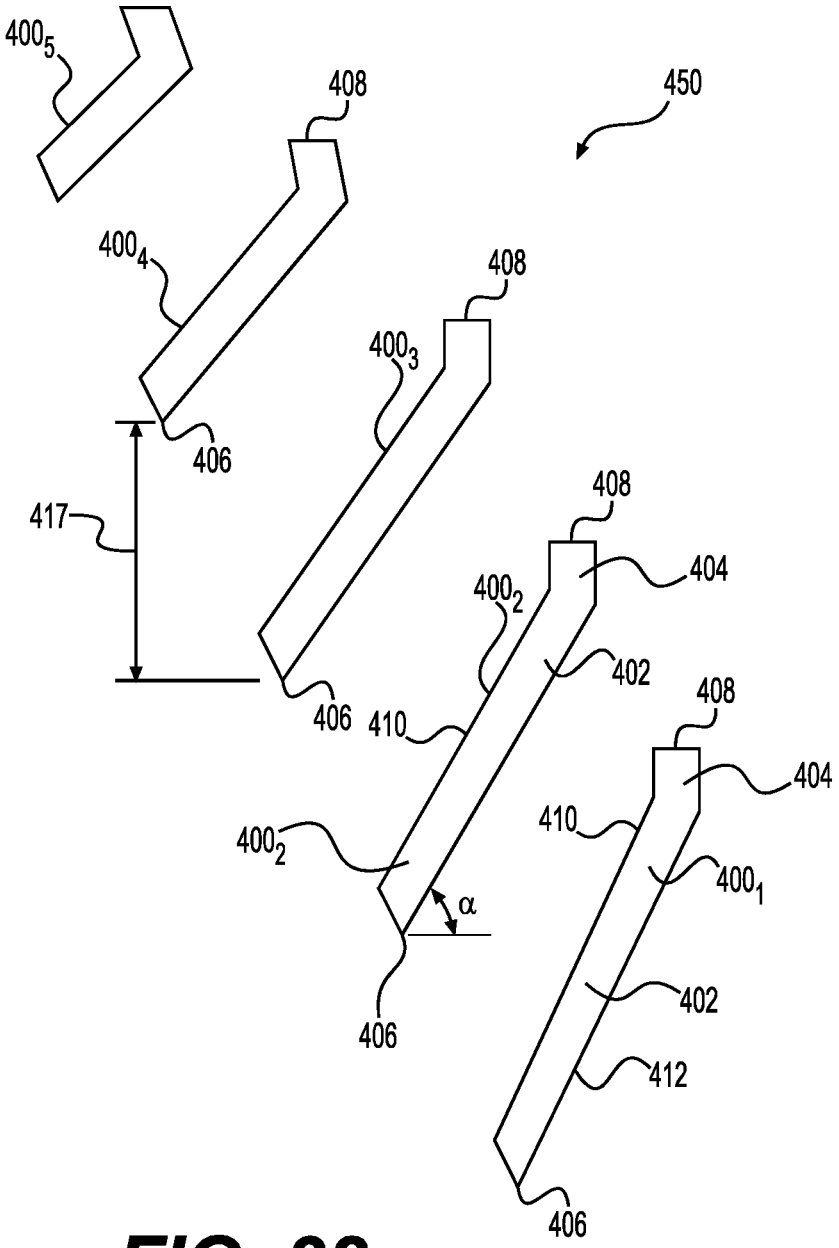
FIG. 32 is a side elevation of one of the sound dampening devices of FIG. 29.
Figure 33:
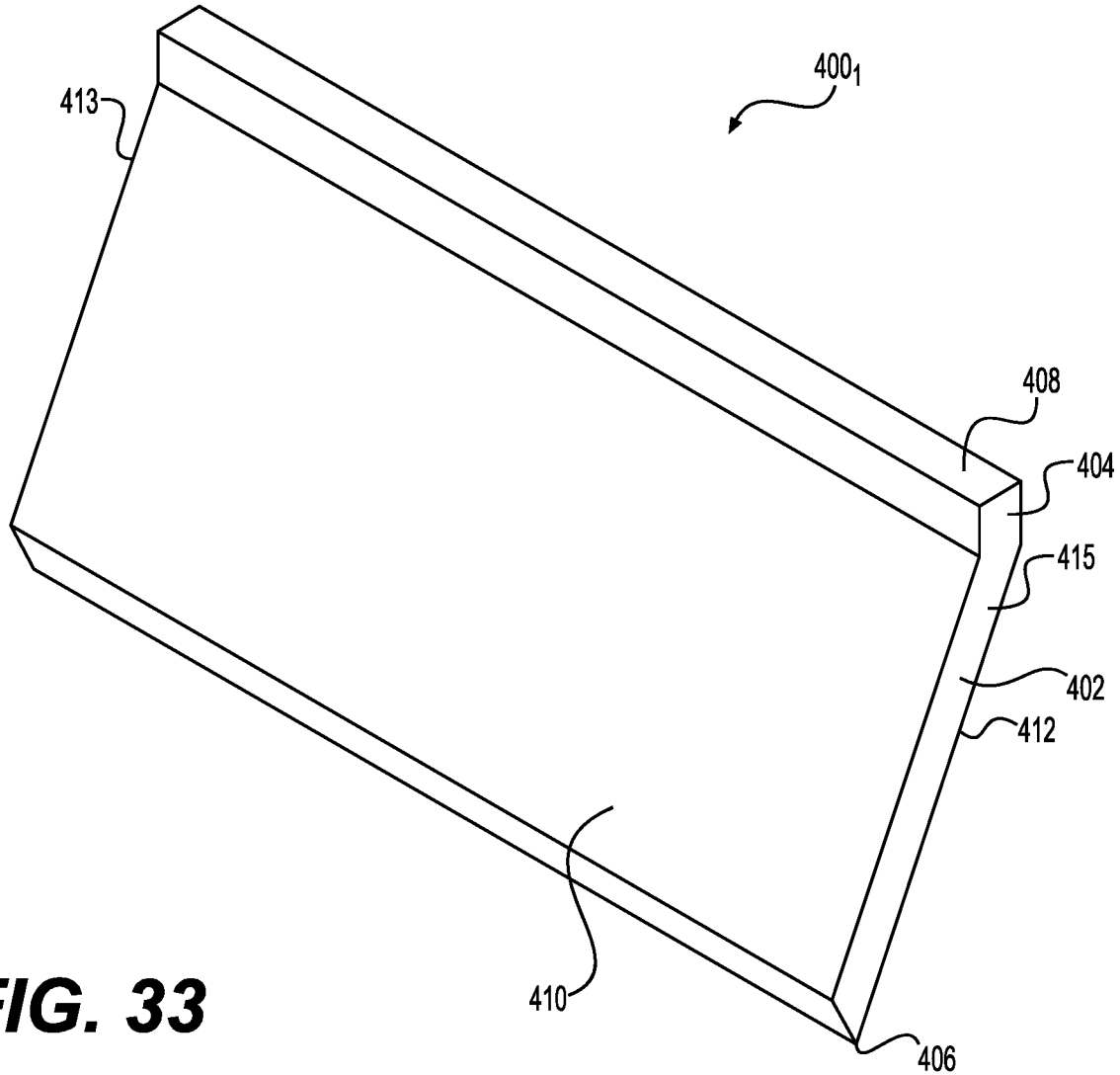
FIG. 33 is a perspective view of a baffle member of the sound dampening device of FIG. 32.
Figure 34:
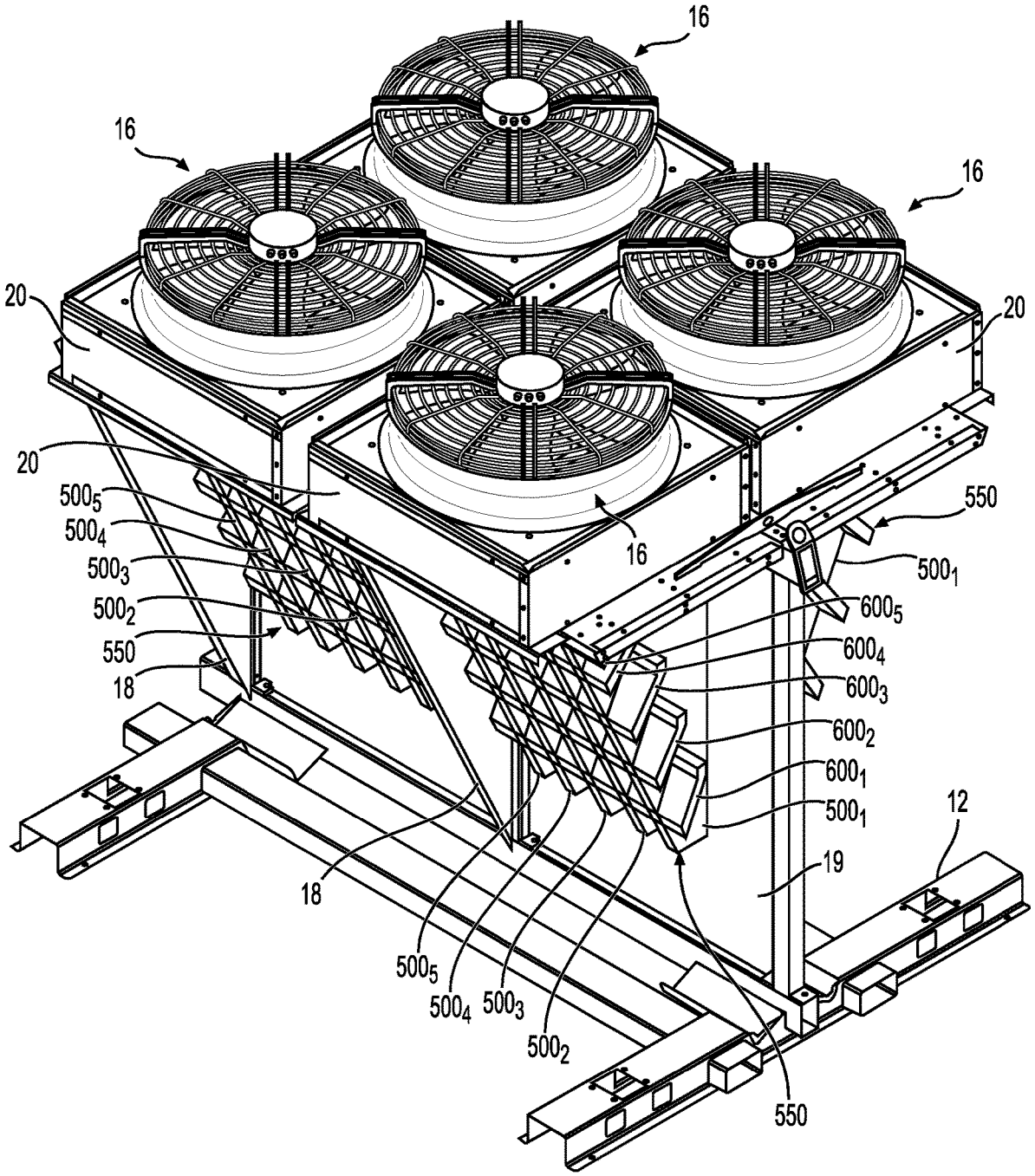
FIG. 34 is a perspective view of part of the heat exchanger assembly provided with sound dampening devices in accordance with another embodiment, the heat exchanger panels and some side enclosing panels being removed to expose the sound dampening devices.

Furthermore, in this embodiment, the lengths of the baffle members $\mathbf{400}_1$-$\mathbf{400}_5$ (i.e., the distance between the lower and upper ends 406, 408) are different. In particular, as shown in FIG. 32, the baffle members $\mathbf{400}_1$-$\mathbf{400}_5$ are increasingly longer from the bottommost baffle member $\mathbf{400}_5$ to the topmost baffle member $\mathbf{400}_1$. Thus, the bottommost baffle member $\mathbf{400}_5$ is longer than the other baffle members $\mathbf{400}_1$-$\mathbf{400}_4$, and the topmost baffle member $\mathbf{400}_1$ is the shorter than the other baffle members $\mathbf{400}_2$-$\mathbf{400}_5$. As air flow entering the sound dampening device 450 at the bottom of the heat exchanger panel 14 has a greater distance to travel to the fan assembly 16, this configuration may provide greater directionality to that air flow as the baffle members $\mathbf{400}_1$-$\mathbf{400}_5$ located near the bottom of the heat exchanger panel 14 guide air flow over a longer distance (i.e., further upwardly) thus providing a better distribution of air flow.

Another embodiment of the sound dampening device will now be described with particular reference to FIGS. 34 to 39. In this embodiment, the dry cooler 10 is provided with a plurality of sound dampening devices 550 disposed within the interior space 25 of the dry cooler 10 and positioned such that at least a portion of air pulled into the interior space 25 through the heat exchanger panels 14 flows through a respective one of the sound dampening devices 550 before being discharged from the dry cooler 10 via the respective fan assembly 16.

In this embodiment, each sound dampening device 550 includes two types of baffle members which are affixed to one another to form the sound dampening device 550. In particular, the sound dampening device 550 includes a plurality of upright baffle members $\mathbf{500}_1$-$\mathbf{500}_5$ and a plurality of angled baffle members $\mathbf{600}_1$-$\mathbf{600}_5$. The upright baffle members $\mathbf{500}_1$-$\mathbf{500}_5$ are similar to the baffle members $\mathbf{200}_1$-$\mathbf{200}_5$ described above with respect to the sound dampening device 250, and therefore the particular configuration of the upright baffle members $\mathbf{500}_1$-$\mathbf{500}_5$ will not be described in detail herein, except to describe notable differences therebetween. The features of the upright baffle members $\mathbf{500}_1$-$\mathbf{500}_5$ have therefore been denoted with the same reference numbers as those equivalent features of the baffle members $\mathbf{200}_1$-$\mathbf{200}_5$, with the numbers however being in the "500" series instead of the "200" series. Similarly, the angled baffle members $\mathbf{600}_1$-$\mathbf{600}_5$ are similar to the baffle members $\mathbf{300}_1$-$\mathbf{300}_5$ described above with respect to the sound dampening device 350, and therefore the particular configuration of the angled baffle members $600_1$-$600_5$ will not be described in detail herein, except to describe notable differences therebetween. The features of the angled baffle members $600_1$-$600_5$ have therefore been denoted with the same reference numbers as those equivalent features of the baffle members $300_1$-$300_5$, with the numbers however being in the "600" series instead of the "300" series.

Figure 35:
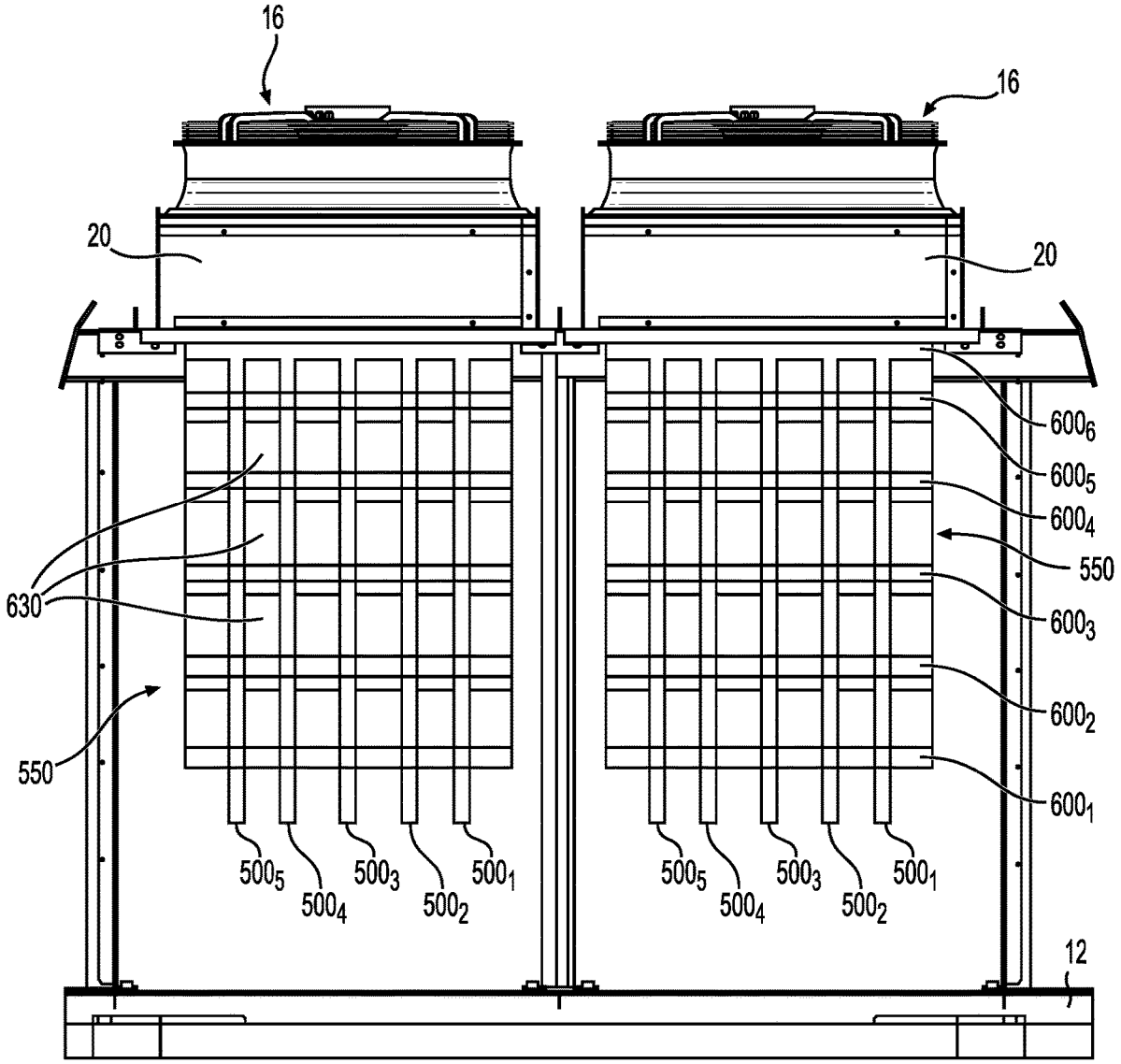
FIG. 35 is a front elevation view of the part of the heat exchanger assembly of FIG. 34.
Figure 36:
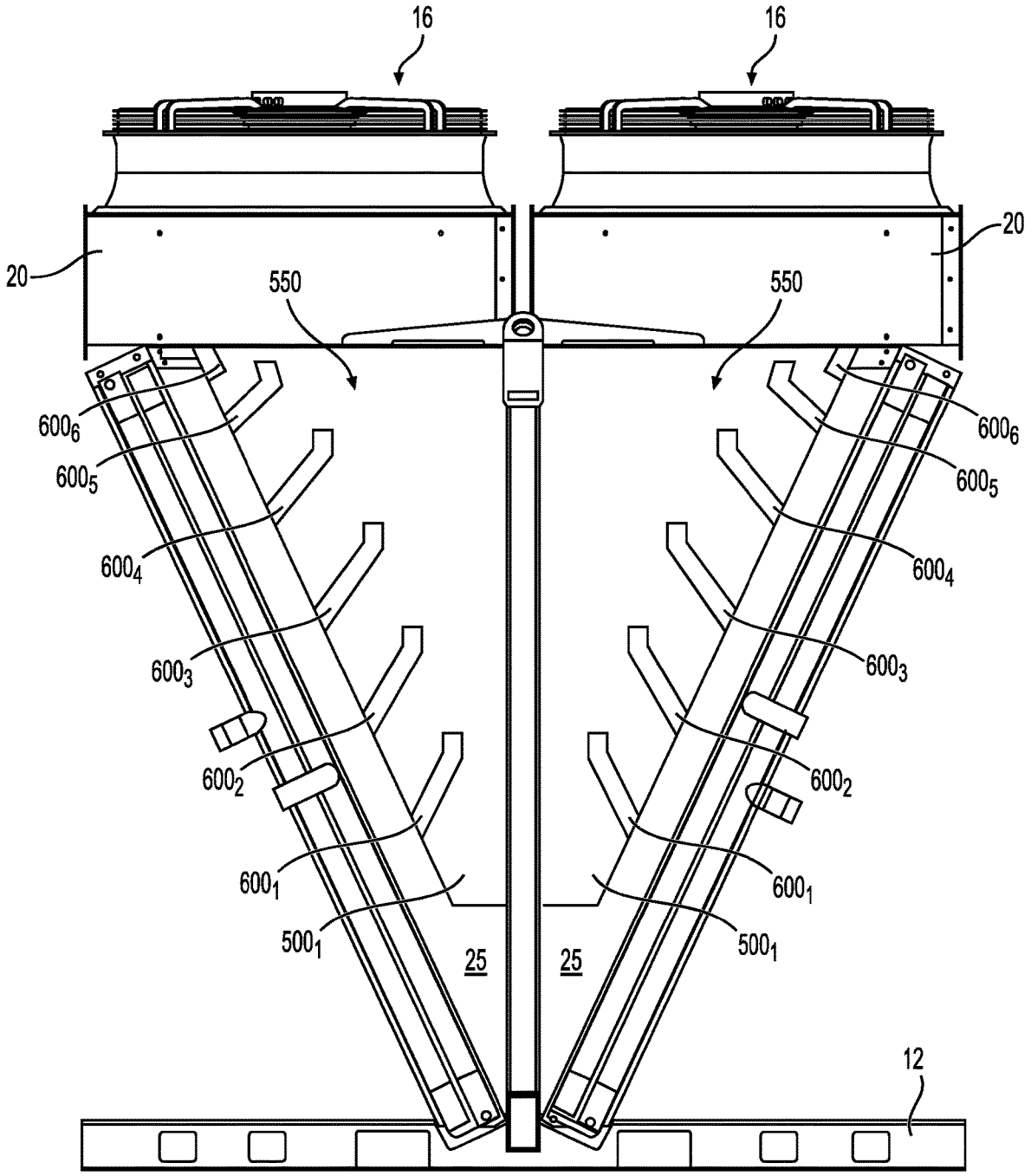
FIG. 36 is a side elevation view of the heat exchanger assembly of FIG. 34, with side enclosing panels thereof removed to expose the sound dampening devices.
Figure 37:
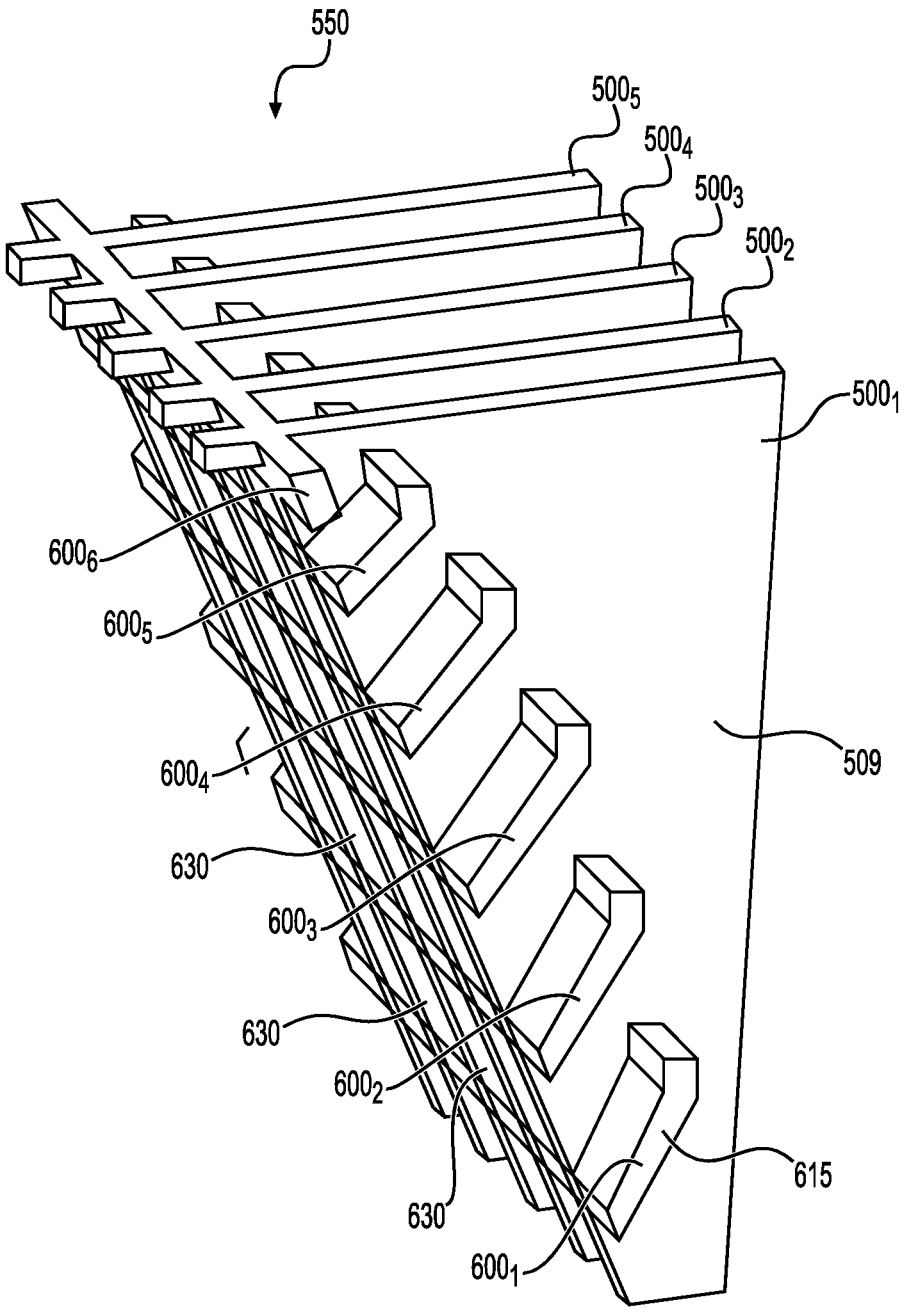
FIG. 37 is a perspective view of one of the sound dampening devices of FIG. 34.
Figure 38:
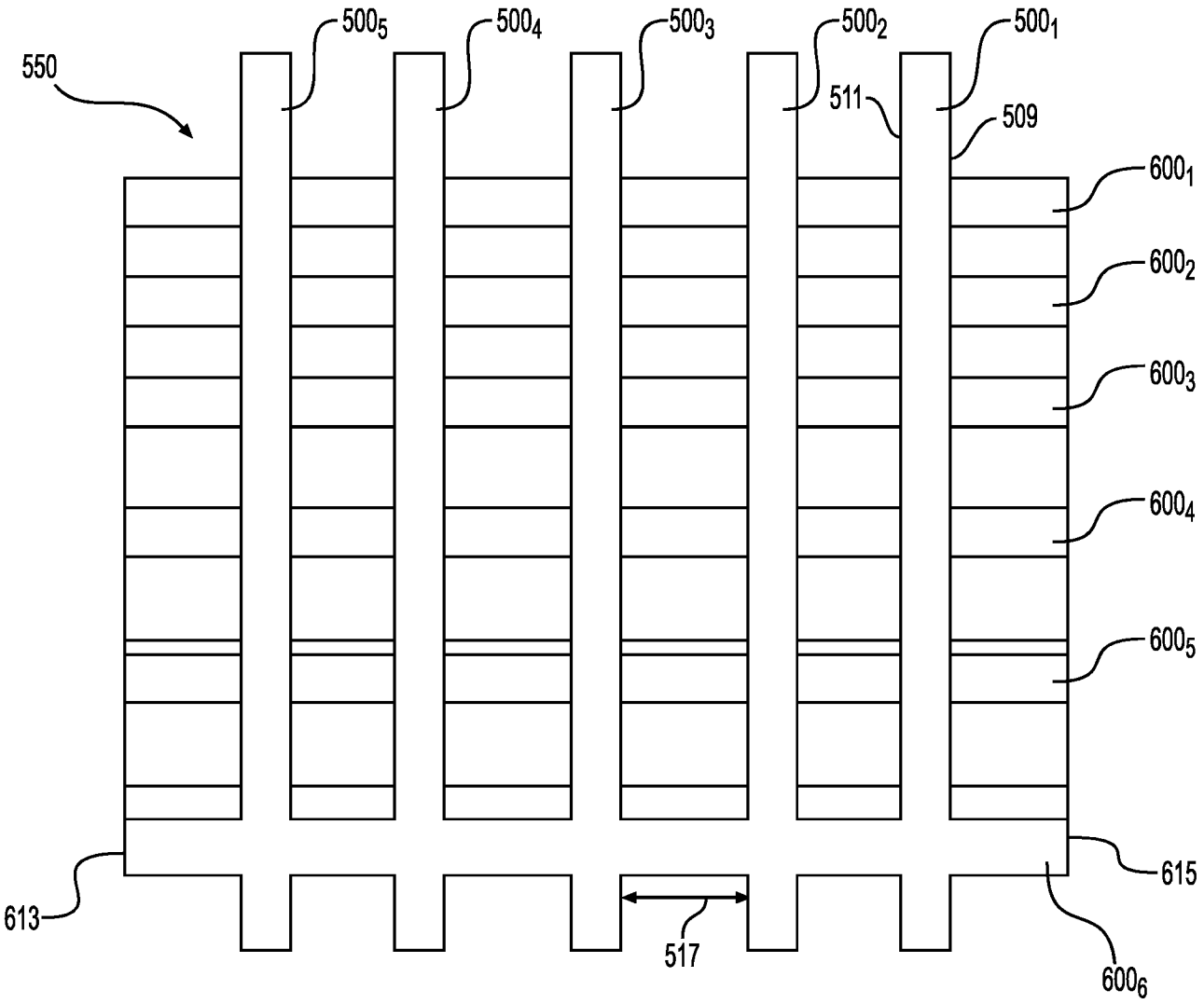
FIG. 38 is a top plan view of the sound dampening device of FIG. 37.
Figure 39:
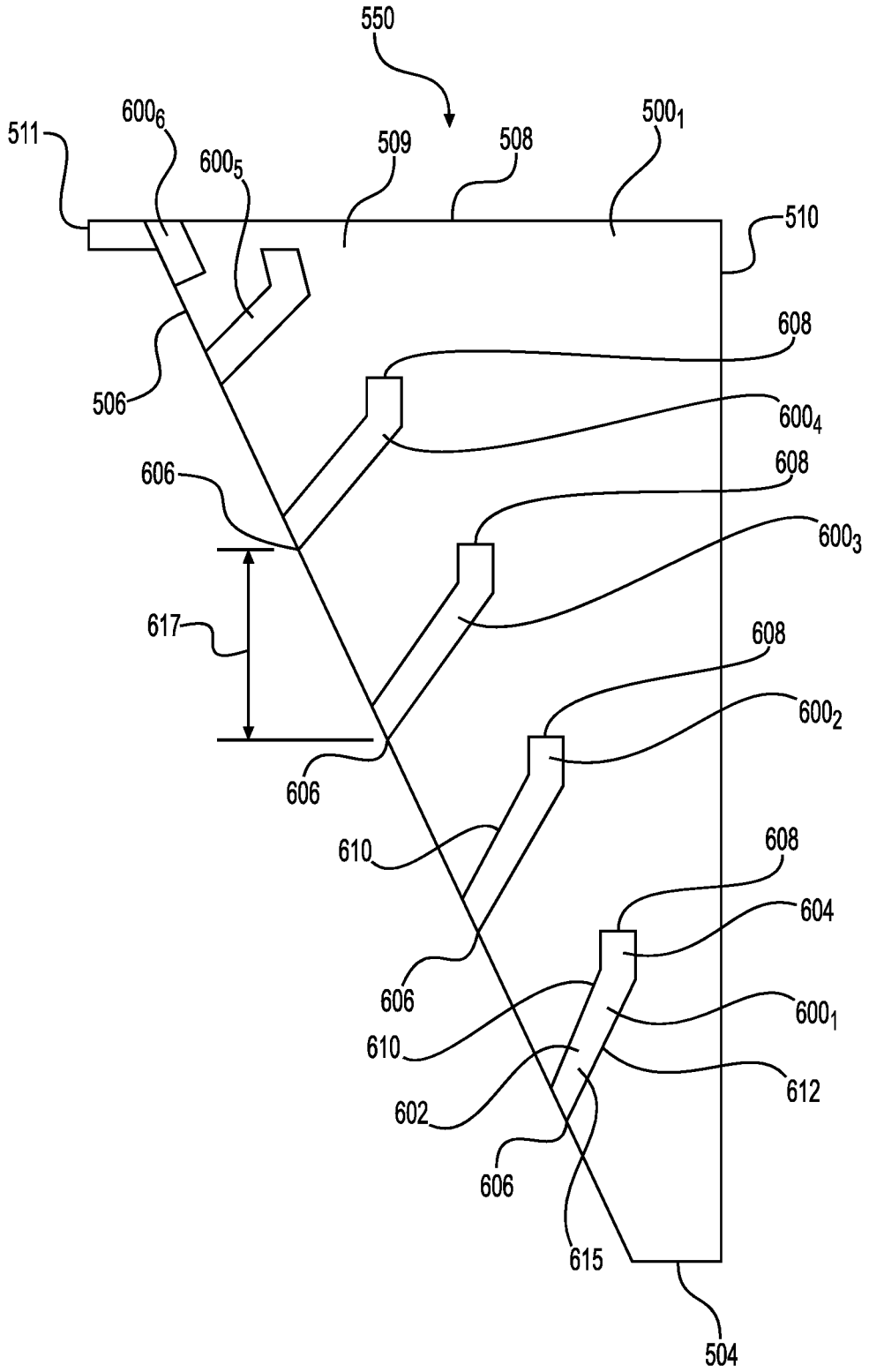
FIG. 39 is a side elevation view of the sound dampening device of FIG. 37.
Figure 40:
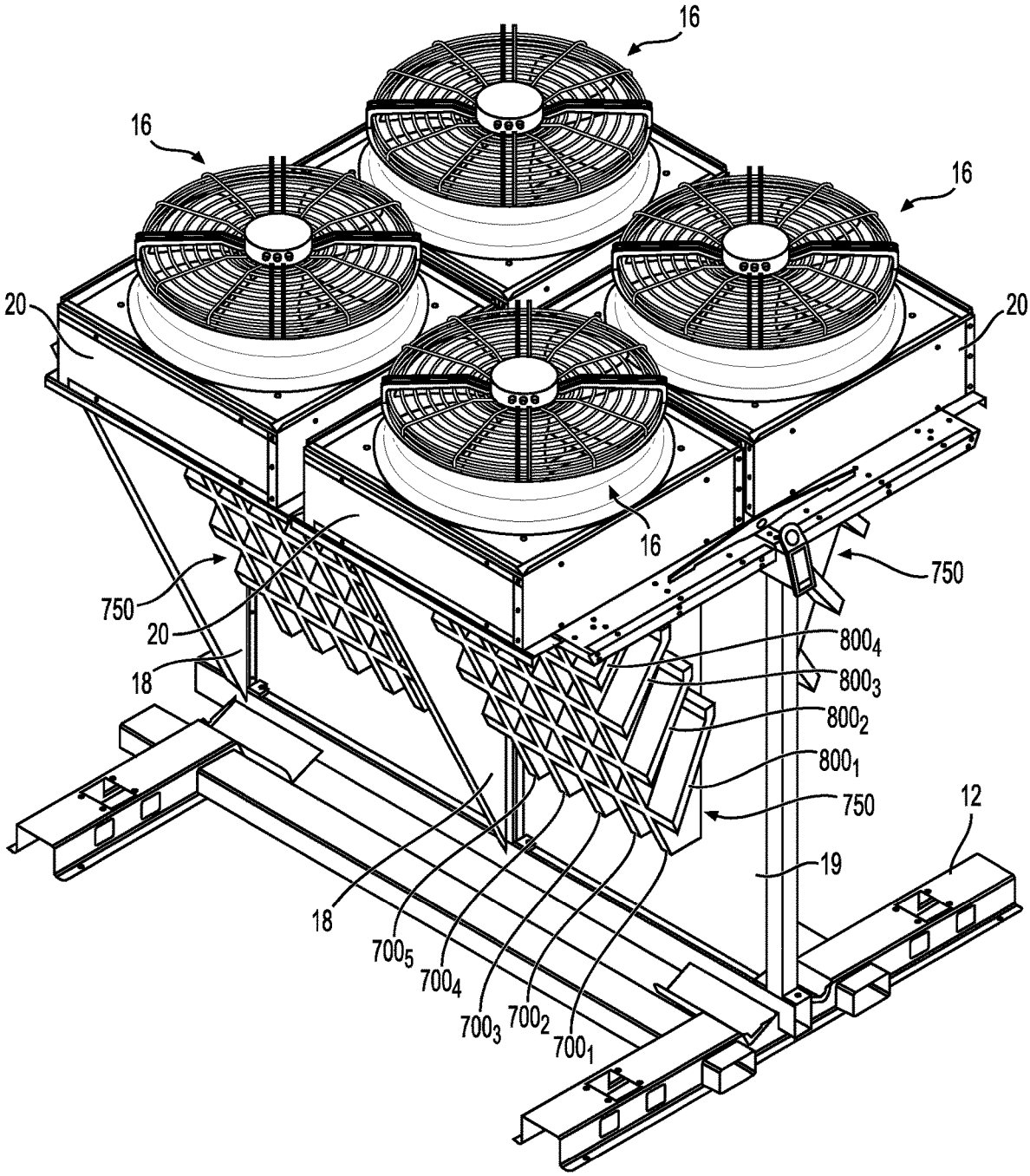
FIG. 40 is a perspective view of part of the heat exchanger assembly provided with sound dampening devices in accordance with another embodiment, the heat exchanger panels and some side enclosing panels being removed to expose the sound dampening devices.
Figure 41:
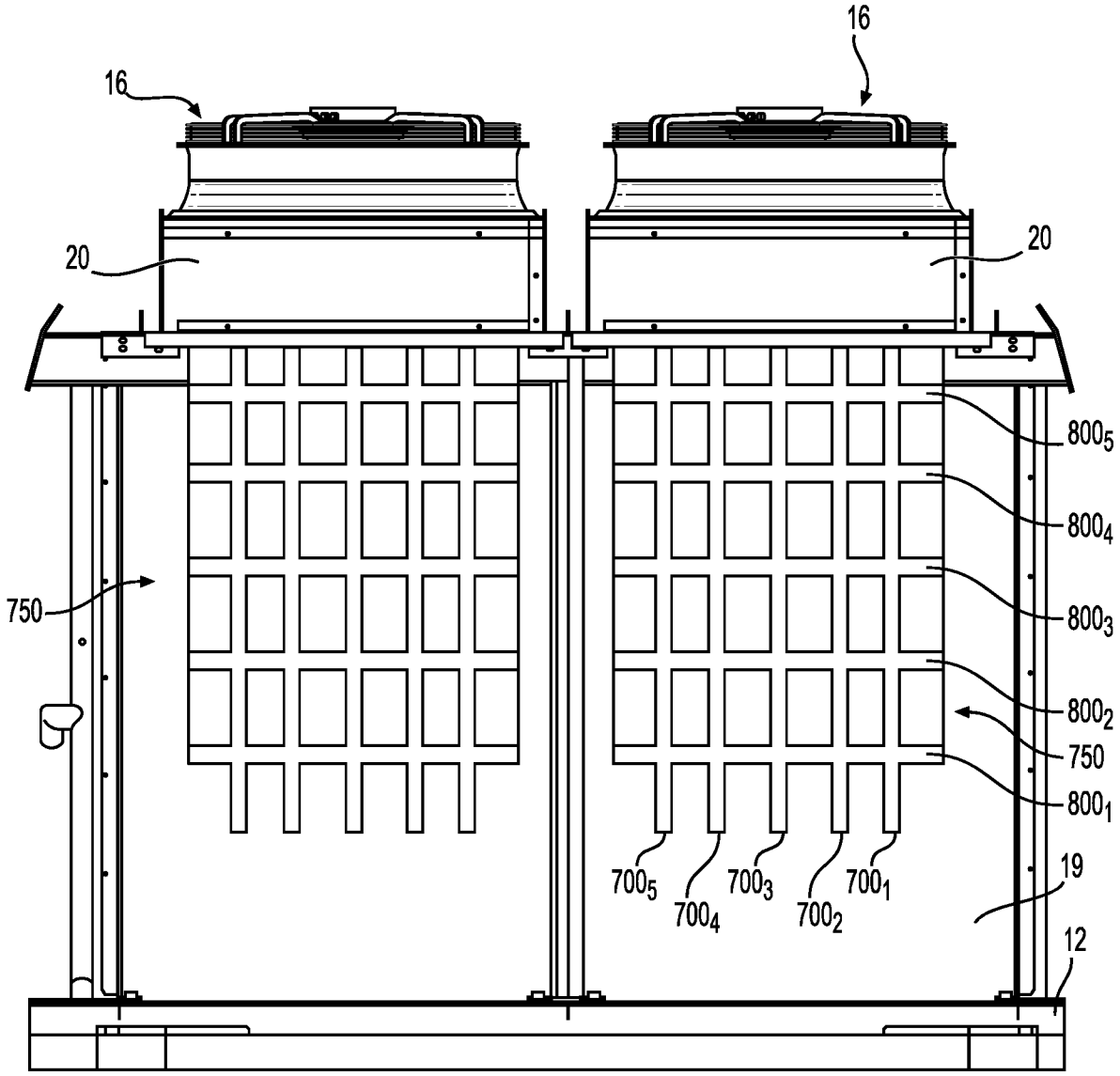
FIG. 41 is a front elevation view of the part of the heat exchanger assembly of FIG. 40.
Figure 42:
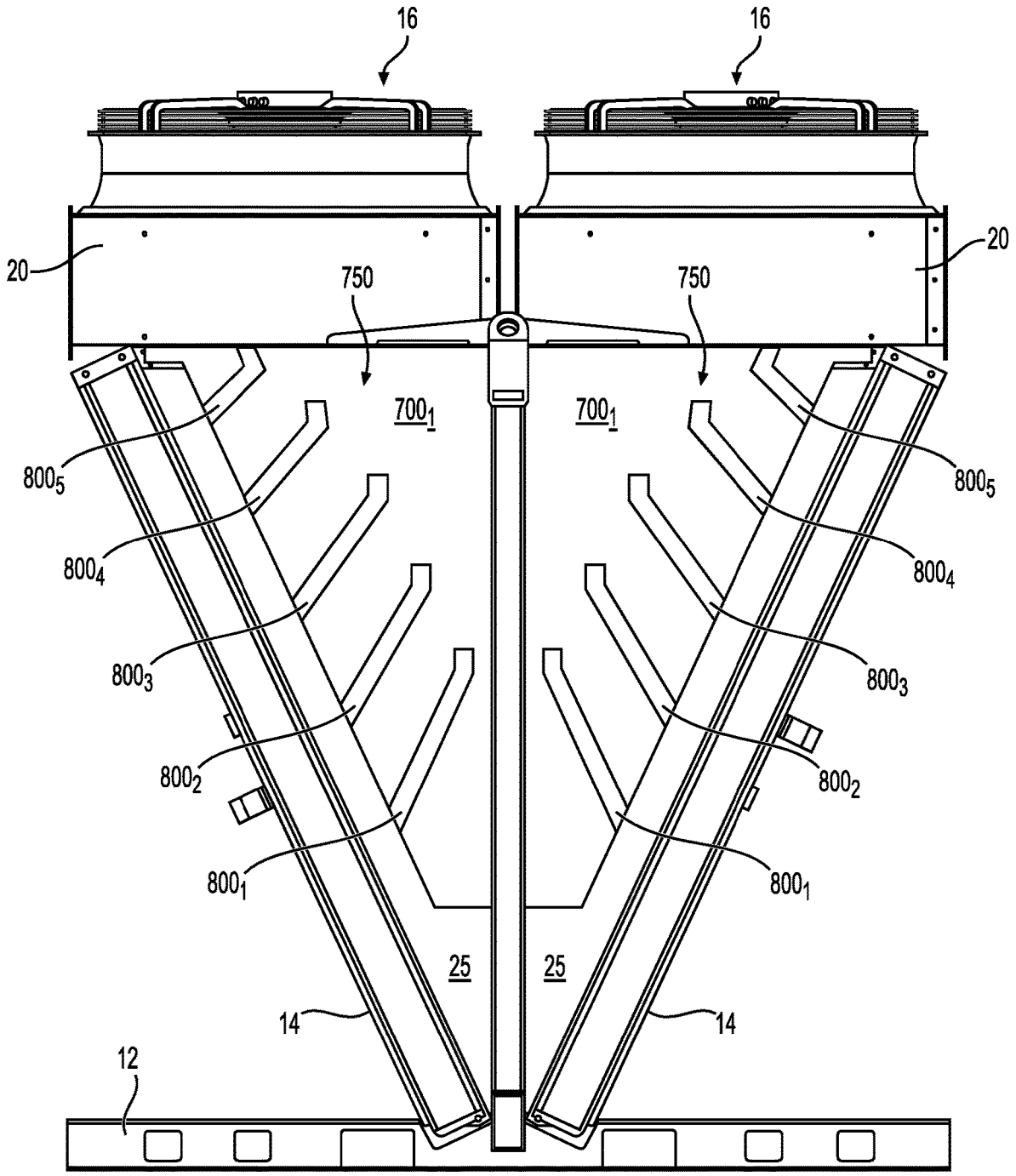
FIG. 42 is a side elevation view of the heat exchanger assembly of FIG. 40, with side enclosing panels thereof removed to expose the sound dampening devices.
Figure 43:
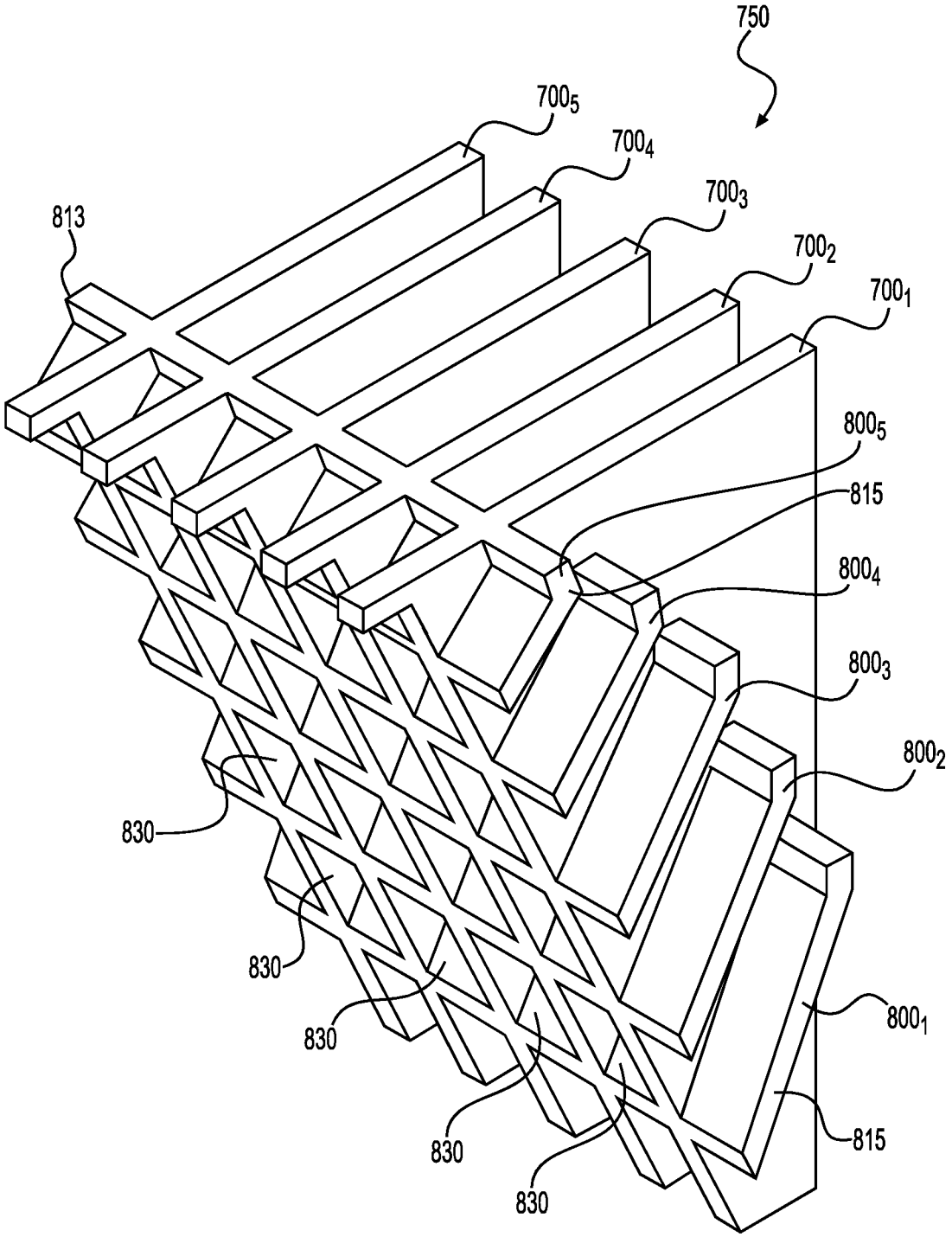
FIG. 43 is a perspective view of one of the sound dampening devices of FIG. 40.
Figure 44:
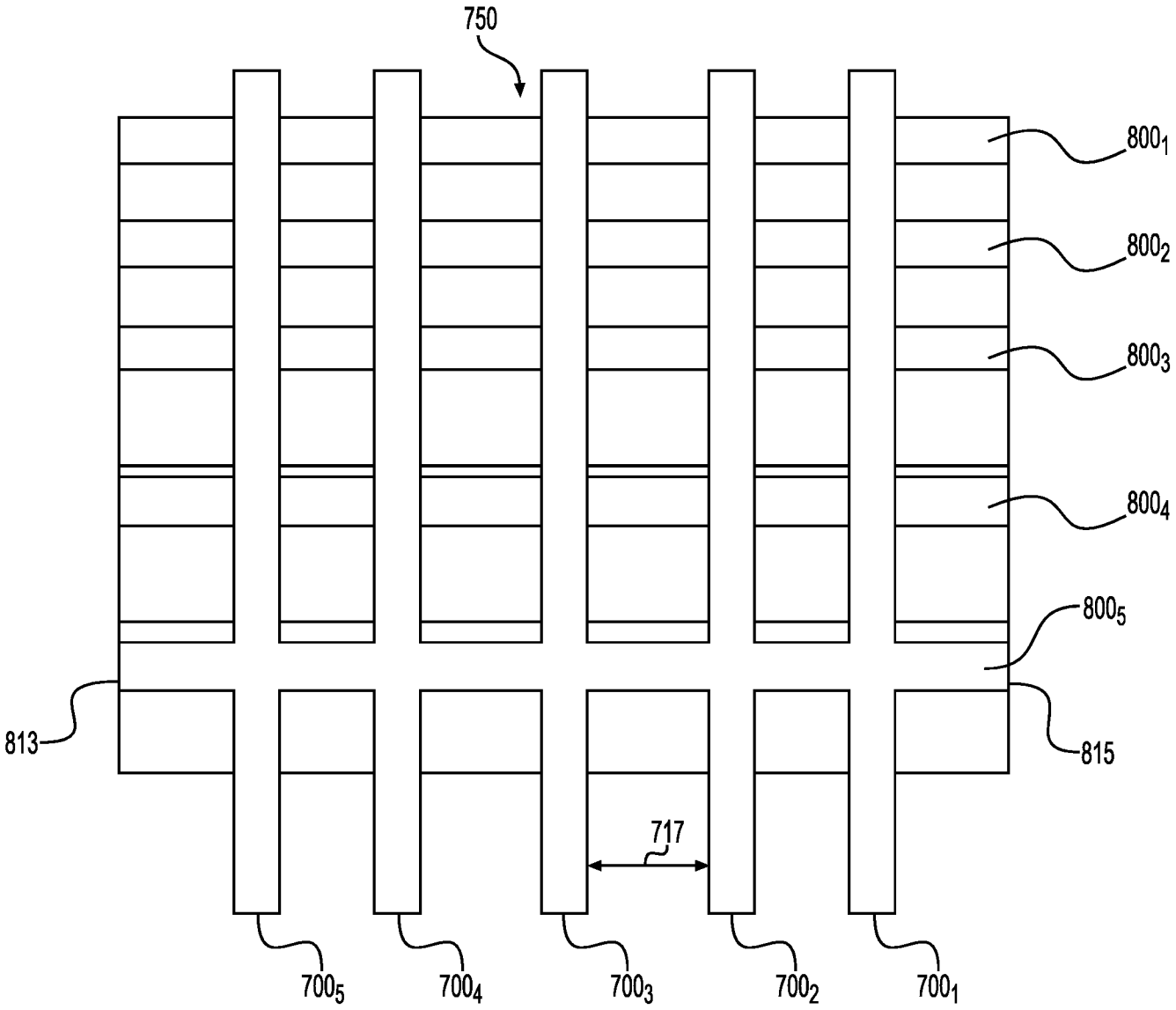
FIG. 44 is a top plan view of the sound dampening device of FIG. 43.
Figure 45:
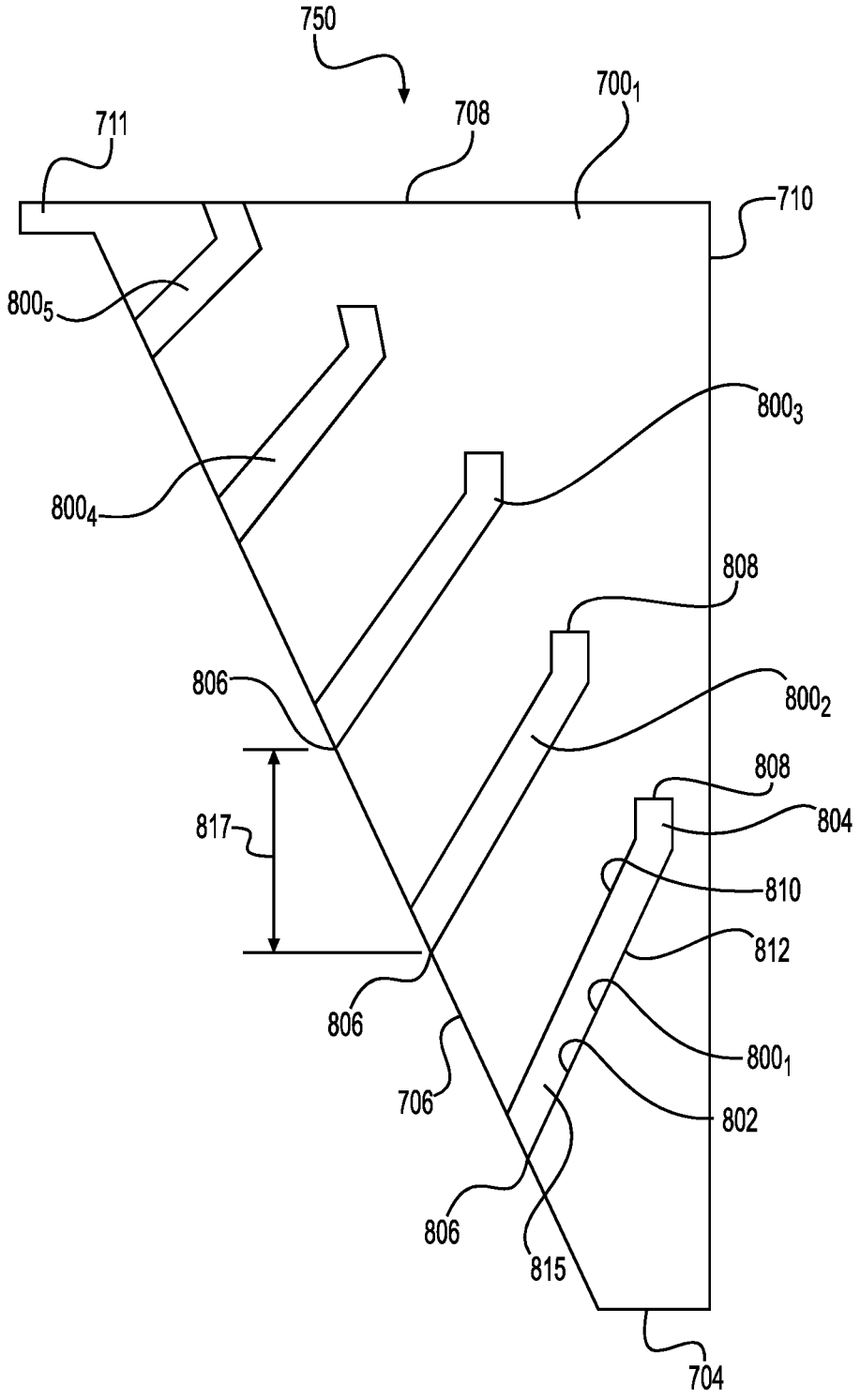
FIG. 45 is a side elevation view of the sound dampening device of FIG. 43.

As can be seen, the upright baffle members $500_1$-$500_5$ extend perpendicular to the angled baffle members $600_1$-$600_5$ and to the plane extending through the upper and lower ends 26, 24 of the corresponding heat exchanger panel 14. As the upright baffle members $500_1$-$500_5$ are spaced apart from one another (by a variable spacing 517—FIG. 38) and the angled baffle members $600_1$-$600_5$ are also spaced apart from one another (by variable spacing 617—FIG. 39), together, the upright and angled baffle members $500_1$-$500_5$, $600_1$-$600_5$ form air ducts 630 therebetween, as shown in FIGS. 35 and 37. Notably, each air duct 630 is defined by: (i) the rear face 612 of one of the angled baffle members $600_2$-$600_5$; (ii) the front face 610 of a consecutive lower one of the angled baffle members $600_1$-$600_4$; (iii) the lateral face 509 of one of the upright baffle members $500_2$-$500_5$; and (iv) the opposite lateral face 511 of a consecutive one of the upright baffle members $500_1$-$500_4$. As such, as can be seen in FIG. 35, the upright and angled baffle members $500_1$-$500_5$, $600_1$-$600_5$ form a rectangular grid which defines the air ducts 630.

In this embodiment, the upright and angled baffle members $500_1$-$500_5$, $600_1$-$600_5$ are affixed to one another by forming recesses in the upright baffle members $500_1$-$500_5$ or the angled baffle members $600_1$-$600_5$ in which the other of the upright baffle members $500_1$-$500_5$ or the angled baffle members $600_1$-$600_5$ are received. In other words, the upright and angled baffle members $500_1$-$500_5$, $600_1$-$600_5$ are interlocked with one another. The upright and angled baffle members $500_1$-$500_5$, $600_1$-$600_5$ may be affixed to one another in any other suitable way in other embodiments.

The sound dampening device 550 thus offers the benefits of having both types of baffle members, notably providing directionality to the air flow via the angled baffle members $600_1$-$600_5$ while also providing greater sound absorption due to the size and weight of the baffle members $500_1$-$500_5$.

Another embodiment of the sound dampening device is shown in FIGS. 40 to 45. In this embodiment, the dry cooler 10 is provided with a plurality of sound dampening devices 750 disposed within the interior space 25 of the dry cooler 10 and positioned such that at least a portion of air pulled into the interior space 25 through the heat exchanger panels 14 flows through a respective one of the sound dampening devices 750 before being discharged from the dry cooler 10 via the respective fan assembly 16.

As can be seen, the sound dampening device 750 is similar to the sound dampening device 550 described above. Notably, in this embodiment, each sound dampening device 750 includes two types of baffle members which are affixed to one another to form the sound dampening device 550. In particular, the sound dampening device 750 includes a plurality of upright baffle members $700_1$-$700_5$ and a plurality of angled baffle members $800_1$-$800_5$. The upright baffle members $700_1$-$700_5$ are similar to the baffle members $200_1$-$200_5$ described above with respect to the sound dampening device 250, and therefore the particular configuration of the upright baffle members $700_1$-$700_5$ will not be described in detail herein, except to describe notable differences therebetween. The features of the upright baffle members $700_1$-$700_5$ have therefore been denoted with the same reference numbers as those equivalent features of the baffle members $200_1$-$200_5$, with the numbers however being in the "700" series instead of the "200" series. Similarly, the angled baffle members $800_1$-$800_5$ are similar to the baffle members $400_1$-$400_5$ described above with respect to the sound dampening device 350, and therefore the particular configuration of the angled baffle members $800_1$-$800_5$ will not be described in detail herein, except to describe notable differences therebetween. The features of the angled baffle members $800_1$-$800_5$ have therefore been denoted with the same reference numbers as those equivalent features of the baffle members $400_1$-$400_5$, with the numbers however being in the "800" series instead of the "400" series.

Thus, in this embodiment, the sound dampening device 750 has longer angled baffle members $800_1$-$800_5$ than is provided for in the sound dampening device 550 described above. As explained with reference to the sound dampening device 450, the longer angled baffle members $800_1$-$800_5$ may provide greater directionality to the air flow than if shorter angled baffle members were used instead.

The sound dampening devices described above are all interiorly contained within the dry cooler 10. That is, each embodiment of the sound dampening device described above is disposed within the interior space 25 of the dry cooler 10. This results in a less burdensome dry cooler 10 than if an outer sound dampening solution were implemented, while also leaving space free outside of the dry cooler 10 for other systems which can benefit the operation of the dry cooler 10. For example, in some cases, it may be desirable to install an atomizer unit outside of the dry cooler 10 configured to spray water in the direction of the heat exchanger panels 14 such as to cool the air flowing into the dry cooler 10. Therefore, having a sound dampening device installed in the interior space 25 of the dry cooler 10 affords space outside of the dry cooler 10 for such an atomizer unit or other equipment which can be mounted outside of the dry cooler.

Furthermore, the sound dampening devices described above are relatively light and therefore do not add significant weight to the dry cooler 10 while reducing its operating noise substantially. In addition, as a result, the sound dampening devices are also easy to install and do not require heaving lifting equipment. Moreover, a dry cooler or other heat exchanger assembly can be retrofitted with such sound dampening devices.

The dry cooler 10 implementing the casings 20 and one of the sound dampening devices described above is particularly quiet. However, it should be noted that even if only the casings 20 or only the sound dampening devices were implemented, the dry cooler 10 would still be significantly quieter compared to a conventional dry cooler. For instance, the sound dampening devices described above absorb sound prior to the air flow's entry into the fan assembly 16 irrespective of whether or not the dry cooler 10 is provided with the casings 20. Similarly, the casings 20 reduce sound generated by the dry cooler 10 irrespective of whether or not the dry cooler 10 is provided with the sound dampening devices. Thus both solutions are workable independently as well as in combination.

Figure 47:
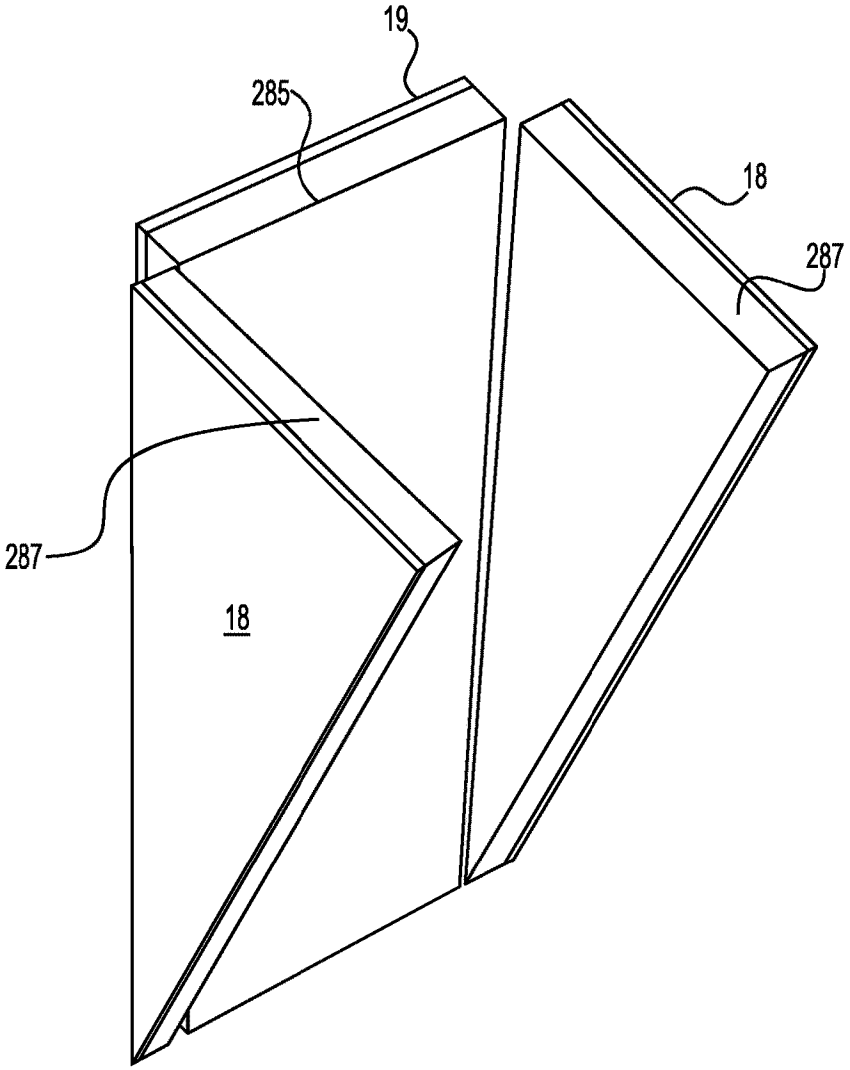
FIG. 47 is a perspective view of part of the heat exchanger assembly, showing acoustic panels thereof connected to the enclosing panels of the heat exchanger assembly.

With reference to FIG. 47, which shows a sub-compartment of the interior space 25 defined in part by two side enclosing panels 18 and a middle panel 19, in some embodiments, the dry cooler 10 may additionally be provided with acoustic panels 285, 287 which are connected to and at least partially cover the enclosing panels 18, 19. Notably, the acoustic panels 285, 287 acoustically insulate the interior space 25 of the dry cooler 10 thus providing quieter operation of the dry cooler 10. In addition, the acoustic panels 285, 287 may rigidify the enclosing panels 18, 19 and thereby dampen vibrations thereof which results in less sound generated thereby. The acoustic panels 285, 287 can be implemented in complement with any of the sound dampening devices described above, or independently thereof.

It is to be understood that, while the dry cooler 10 has been described herein as being oriented vertically or upright such that the fan rotation axes FA extend generally vertically, it is contemplated that similar sound attenuating solutions such as the casings 20, the sound dampening devices and the acoustic panels 285, 287 may be implemented similarly in a dry cooler that is oriented horizontally such that the fan rotation axes FA extend horizontally. In that context, it is to be understood that terms referring to the positioning or orientation of the different component of the dry cooler 10 (e.g., upper, lower, etc.) are to be interpreted with an up-down direction of the dry cooler 10 being consistent with the direction of the fan rotation axes FA.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A heat exchanger assembly, comprising:

a frame;

a heat exchanger panel mounted to the frame and configured to exchange heat with air flowing therethrough, the heat exchanger panel having a lower end and an upper end, the heat exchanger panel being disposed at an inclined orientation such that the upper and lower ends thereof are offset from one another, the heat exchanger panel comprising:

a tubing arrangement for circulating fluid therein; and a plurality of fins in thermal contact with the tubing arrangement, the fins being spaced apart from one another for air to flow therebetween and into an interior space of the heat exchanger assembly;

a plurality of enclosing panels connected to the frame and defining in part the interior space of the heat exchanger assembly;

a fan assembly disposed vertically above the heat exchanger panel, the fan assembly comprising a fan impeller rotatable about a fan rotation axis to pull air into the interior space of the heat exchanger assembly through the heat exchanger panel and evacuate heated air upwardly from the interior space of the heat exchanger assembly through the fan assembly; and a sound dampening device disposed within the interior space of the heat exchanger assembly such that air is pulled into the interior space through the heat exchanger panel and then flows through the sound dampening device before being discharged from the heat exchanger assembly via the fan assembly, the sound dampening device comprising:

a plurality of baffle members, the baffle members being spaced apart from one another for allowing air flow therebetween, each of the baffle members extending at an angle relative to a plane extending through the upper and lower ends of the heat exchanger panel so as to direct air flow upwardly toward the fan assembly, wherein:

each of the baffle members has a first portion and a second portion extending from the first portion;

the first portion is positioned closer to the heat exchanger panel than the second portion such that air pulled into the heat exchanger assembly and flowing through the sound dampening device traverses along the first portion of each of the baffle members before reaching the second portion thereof; and the second portion extends upwardly at an angle relative to the first portion to deflect air flow incoming from a direction of the first portion.

2. The heat exchanger assembly of claim 1, wherein the second portion of each baffle member extends generally vertically.

3. The heat exchanger assembly of claim 1, wherein the first portion of each baffle member extends at an angle between 40° and 75° inclusively relative to a horizontal plane.

4. The heat exchanger assembly of claim 1, wherein a spacing between consecutive ones of the baffle members is variable.

5. The heat exchanger assembly of claim 1, wherein:

each of the baffle members has an upper end and a lower end; and the lower end of a given one of the baffle members is positioned vertically lower than the upper end of a consecutive one of the baffle members positioned below the given one of the baffle members.

6. The heat exchanger assembly of claim 1, wherein:

the baffle members are first baffle members;

the sound dampening device further comprises:

a plurality of second baffle members affixed to the first baffle members, the second baffle members extending perpendicular to the first baffle members and to the plane extending through the upper and lower ends of the heat exchanger panel, the second baffle members being spaced apart from one another, the first baffle members and the second baffle members forming air ducts therebetween.

7. The heat exchanger assembly of claim 6, wherein the first baffle members and the second baffle members form a rectangular grid defining the air ducts.

8. The heat exchanger assembly of claim 6, wherein each of the second baffle members has a generally triangular shape.

9. The heat exchanger assembly of claim 8, wherein, each of the second baffle members comprises:

a first edge;

a second edge extending perpendicularly to the first edge; and a third edge extending diagonally relative to the first and second edges, the third edge being adjacent to the heat exchanger panel.

10. The heat exchanger assembly of claim 6, wherein a spacing between consecutive ones of the second baffle members is variable.

11. The heat exchanger assembly of claim 1, further comprising:

a plurality of acoustic panels connected to the enclosing panels for acoustically insulating the interior space of the heat exchanger assembly.

12. The heat exchanger assembly of claim 1, wherein:

the heat exchanger panel is a first heat exchanger panel;

the fan assembly is a first fan assembly, and the fan rotation axis is a first fan rotation axis;

the sound dampening device is a first sound dampening device; and the heat exchanger assembly further comprises:

a second heat exchanger panel mounted to the frame and configured to exchange heat with air flowing therethrough, the second heat exchanger panel having a lower end and an upper end, the second heat exchanger panel being disposed at an inclined orientation such that the upper and lower ends thereof are offset from one another, the first and second heat exchanger panels being disposed in a V-configuration such that a distance between the upper ends of the first and second heat exchanger panels is greater than a distance between the lower ends of the first and second heat exchanger panels, the second heat exchanger panel comprising:

a tubing arrangement for circulating fluid therein; and a plurality of fins in thermal contact with the tubing arrangement of the second heat exchanger panel, the fins of the second heat exchanger panel being spaced apart from one another for air to flow therebetween and into the interior space of the heat exchanger assembly;

a second fan assembly disposed vertically above the second heat exchanger panel, the second fan assembly comprising:

a fan impeller rotatable about a second fan rotation axis to pull air into the interior space of the heat exchanger assembly through the second heat exchanger panel and evacuate heated air upwardly from the interior space of the heat exchanger assembly through the second fan assembly;

and a second sound dampening device disposed within the interior space of the heat exchanger assembly such that air is pulled into the interior space through the second heat exchanger panel and then flows through the second sound dampening device before being discharged from the heat exchanger assembly via the second fan assembly, the second sound dampening device comprising:

a plurality of baffle members, the baffle members of the second sound dampening device being spaced apart from one another for allowing air flow therebetween, each of the baffle members of the second sound dampening device extending at an angle relative to a plane extending through the upper and lower ends of the second heat exchanger panel so as to direct air flow upwardly toward the second fan assembly.

13. The heat exchanger assembly of claim 12, wherein the frame comprises:

a first leg and a second leg laterally spaced apart from the first leg;

at least one lower transversal member extending laterally and interconnecting the first and second legs;

a first upstanding member and a second upstanding member laterally spaced apart from the first upstanding member, the first and second upstanding members extending upwardly from the first and second legs;

an upper transversal member extending laterally and connected to upper ends of the first and second upstanding members; and an upper frame assembly affixed to the upper transversal member and supporting the first and second fan assemblies, wherein:

the first and second heat exchanger panels are disposed on opposite sides of a vertical plane extending through the first and second upstanding members; and the first fan rotation axis and the second fan rotation axis are disposed on opposite sides of the vertical plane extending through the first and second upstanding members.

14. The heat exchanger assembly of claim 1, wherein each of the baffle members comprises a sound absorbing material covered at least in part by a protecting layer, the sound absorbing material being one of: a foam material, fiberglass, mineral wool and cotton.

15. A heat exchanger assembly, comprising:

a frame;

a heat exchanger panel mounted to the frame and configured to exchange heat with air flowing therethrough, the heat exchanger panel having a lower end and an upper end, the heat exchanger panel being disposed at an inclined orientation such that the upper and lower ends thereof are offset from one another, the heat exchanger panel comprising:

a tubing arrangement for circulating fluid therein; and a plurality of fins in thermal contact with the tubing arrangement, the fins being spaced apart from one another for air to flow therebetween and into an interior space of the heat exchanger assembly;

a plurality of enclosing panels connected to the frame and defining in part the interior space of the heat exchanger assembly;

a fan assembly disposed vertically above the heat exchanger panel, the fan assembly comprising a fan impeller rotatable about a fan rotation axis to pull air into the interior space of the heat exchanger assembly through the heat exchanger panel and evacuate heated air upwardly from the interior space of the heat exchanger assembly through the fan assembly; and a sound dampening device disposed within the interior space of the heat exchanger assembly such that air is pulled into the interior space through the heat exchanger panel and then flows through the sound dampening device before being discharged from the heat exchanger assembly via the fan assembly, the sound dampening device comprising:

a plurality of first baffle members, the first baffle members being spaced apart from one another for allowing air flow therebetween, each of the first baffle members extending at an angle relative to a plane extending through the upper and lower ends of the heat exchanger panel so as to direct air flow upwardly toward the fan assembly; and a plurality of second baffle members affixed to the first baffle members, the second baffle members extending perpendicular to the first baffle members and to the plane extending through the upper and lower ends of the heat exchanger panel, the second baffle members being spaced apart from one another, the first baffle members and the second baffle members forming air ducts therebetween.

16. The heat exchanger assembly of claim 15, wherein the first baffle members and the second baffle members form a rectangular grid defining the air ducts.

17. The heat exchanger assembly of claim 15, wherein each of the second baffle members has a generally triangular shape.

18. The heat exchanger assembly of claim 17, wherein each of the second baffle members comprises:

a first edge;

a second edge extending perpendicularly to the first edge; and a third edge extending diagonally relative to the first and second edges, the third edge being adjacent to the heat exchanger panel.

19. The heat exchanger assembly of claim 15, wherein each of the first and second baffle members comprises a sound absorbing material covered at least in part by a protecting layer, the sound absorbing material being one of: a foam material, fiberglass, mineral wool and cotton.

* * * * *